US006682878B2

(12) United States Patent
Fukui et al.

(10) Patent No.: US 6,682,878 B2
(45) Date of Patent: Jan. 27, 2004

(54) THERMAL DEVELOPMENT PHOTOSENSITIVE MATERIAL

(75) Inventors: Kouta Fukui, Minami-Ashigara (JP); Yasuhiro Yoshioka, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/002,170

(22) Filed: Dec. 5, 2001

(65) Prior Publication Data

US 2002/0102502 A1 Aug. 1, 2002

(30) Foreign Application Priority Data

Dec. 5, 2000 (JP) ..... 2000-369729
Feb. 9, 2001 (JP) ..... 2001-034524

(51) Int. Cl.[7] ..... G03C 5/16; G03C 1/498

(52) U.S. Cl. ..... 430/350; 430/600; 430/611; 430/619; 430/944

(58) Field of Search ..... 430/619, 611, 430/600, 944, 350

(56) References Cited

U.S. PATENT DOCUMENTS

| | | | | |
|---|---|---|---|---|
| 2,910,377 A | | 10/1959 | Owen | |
| 3,152,904 A | | 10/1964 | Sorensen et al. | |
| 3,457,075 A | | 7/1969 | Morgan et al. | |
| 5,637,449 A | * | 6/1997 | Harring et al. | 430/619 |
| 6,146,823 A | * | 11/2000 | Katoh | 430/619 |

FOREIGN PATENT DOCUMENTS

| | | | |
|---|---|---|---|
| EP | 0762196 | * | 3/1997 |

* cited by examiner

*Primary Examiner*—Thorl Chea

(74) *Attorney, Agent, or Firm*—Birch, Stewart, Kolasch & Birch, LLP

(57) ABSTRACT

A thermal development photosensitive material suitable for medical diagnoses, industrial photography, printing and COM. The material contains at least one photosensitive silver halide, a non-photosensitive organic silver salt, a binder, at least one of compounds represented by the following formula (I) and at least one of compounds represented by the following formula (II) on one surface of a substrate.

Formula (I)

Formula (II)

The material has high sensitivity and provides an image with a tone close to a pure black tone.

20 Claims, No Drawings

THERMAL DEVELOPMENT PHOTOSENSITIVE MATERIAL

BACKGROUND OF THE PRESENT INVENTION

1. Field of the Present Invention

The present invention relates to a thermal development photosensitive material. More specifically, it relates to a thermal development photosensitive material suitable for medical diagnoses, industrial photography, printing and COM, and an image-forming method using the material.

2. Description of the Related Art

In recent years, for the sake of environmental conservation and space saving, a decrease in amounts of effluent has been in high demand in the fields of films for medical diagnosis and photolithographic films. Accordingly, technology of thermal development photosensitive materials as films for medical diagnosis and photoengraving films which can be exposed with a laser image setter or a laser imager more efficiently to form a clear black image having high resolution and sharpness has been required. With such thermal development photosensitive materials, a thermal development system which does not need solution-type processing chemicals and which can be handled more easily without environmental pollution can be supplied to clients.

There is also the same demand in the field of general image-forming materials. However, since images for medical diagnoses in particular require minute detailing, a high image quality excellent in sharpness and graininess is needed, and an image with a cool black tone is desired in view of easy diagnosis. Various hard copy systems using pigments and dyes, such as an ink jet printer, electrophotography and the like are currently being distributed as general imaging systems. Nevertheless, these are not satisfactory as an output system of medical images.

A thermal imaging system using an organic silver salt is described in, for example, U.S. Pat. Nos. 3,152,904 and 3,457,075 and D. Klosterboer, "Thermally Processed Silver Systems" (Imaging Processes and Materials, Neblette, 8th edition, compiled by J. Sturge, V. Walworth and A. Shepp, chapter 9, p. 279, 1989). Especially, a thermal development photosensitive material generally has a photosensitive layer in which a catalytic amount of a photo-catalyst (for example, a silver halide), a reducing agent, a reducible silver salt (for example, an organic silver salt) and, as required, a color matching agent for controlling the tone of silver are dispersed in a matrix of a binder. After exposure of an image, a thermal development photosensitive material is heated to a high temperature (for example, more than 80° C.), and a black silver image is formed by a redox reaction between a reducible silver salt (that acts as an oxidizer) and a reducing agent. The redox reaction is expedited by catalytic activity of a latent image of the silver halide generated through exposure. Accordingly, a black silver image is formed in an exposed area. This is disclosed in a large number of documents including U.S. Pat. No. 2,910,377 and Japanese Patent Publication No. 43-4924.

With the technological innovation and digitalization of recent years, thermal imaging systems with organic silver salts, which have been employed in output systems of medical images, have used a laser as an exposure light source. Further, the type of laser used is generally a semiconductor laser of an infrared wavelength, because laser power can be obtained at low cost.

A pure black tone is desired in an image for medical diagnosis. In these thermal imaging systems with organic silver salts, it is difficult to give a pure black tone, and the tone is controlled with the color matching agent. Nevertheless, the tone controlling has not been satisfactory, and improvement thereof has been called for.

In an infrared-sensitized thermal development photosensitive material, sensitivity is increased by using a hetero-aromatic mercapto compound or a hetero-aromatic disulfide compound as a strong sensitizer. When the amount of the mercapto compound or the disulfide compound is increased, the sensitivity is increased. However, the image tone is changed, and the pure black tone is hard to obtain. Thus, improvement has been called for.

SUMMARY OF THE PRESENT INVENTION

The present invention aims to attain the following upon solving the problems of the related art. That is, the present invention aims to provide a thermal development photosensitive material for use in medical imaging or photolithography which material gives an image with good tone (close to a pure black tone), and an image-forming method using the material.

The present inventors have assiduously conducted investigations to solve the problems, and have consequently found that a desirable thermal development photosensitive material which brings forth predetermined effects can be prepared using a combination of a specific reducing agent and specific compounds. This finding has led to the completion of the present invention.

Approaches to solve the problems are as follows.

The present invention discloses a thermal development photosensitive material having, on one surface of a substrate, at least one photosensitive silver halide, a non-photosensitive organic silver salt, a reducing agent for silver ions and a binder, the reducing agent including: (a) at least one of polyphenol compounds represented by the following formula (I); and (b) at least one of hindered phenol compounds represented by the following formula (II), wherein a molar addition ratio of the at least one compound represented by formula (II) to the at least one compound represented by formula (I) is from 0.001 to 0.2:

Formula (I)

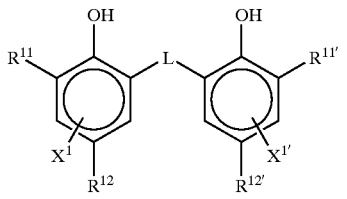

in which formula $R^{11}$ and $R^{11'}$ each independently represents an alkyl group having 1 to 20 carbon atoms; $R^{12}$ and $R^{12'}$ each independently represents a hydrogen atom or a substituent that is substitutable to a benzene ring; L represents —S— or —$CHR^{13}$—; $R^{13}$ represents a hydrogen atom or an optionally substituted alkyl group having 1 to 20 carbon atoms; and $X^1$ and $X^{1'}$ each independently represents a hydrogen atom or a group that is substitutable to a benzene ring, and:

Formula (II)

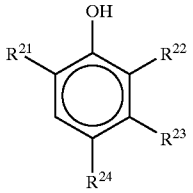

in which formula $R^{21}$ and $R^{22}$ each independently represents a hydrogen atom, an optionally substituted alkyl group or an optionally substituted acylamino group; neither of $R^{21}$ and $R^{22}$ is a 2-hydroxyphenylmethyl group; $R^{21}$ and $R^{22}$ are not both hydrogen atoms; $R^{23}$ represents a hydrogen atom or an optionally substituted alkyl group; and $R^{24}$ represents a substituent that is substitutable to a benzene ring.

In some embodiments, the present invention is the thermal development photosensitive material, wherein in formula (II), $R^{21}$ is an optionally substituted alkyl group.

In some embodiments, the present invention is the thermal development photosensitive material, wherein the photosensitive silver halide is infrared-sensitized.

In some embodiments, the present invention is the thermal development photosensitive material, wherein the molar addition ratio of the at least one compound represented by formula (II) to the at least one compound represented by formula (I) is from 0.005 to 0.1.

In some embodiments, the present invention is the thermal development photosensitive material, wherein at least one compound selected from hetero-aromatic compounds and hetero-aromatic disulfide compounds is further contained.

Further, the present invention discloses an image-forming method which includes exposing the thermal development photosensitive material to a laser having an exposure wavelength of 750 nm to 1,400 nm.

Moreover, the present invention discloses an image-forming method which includes processing the thermal development photosensitive material for a thermal development time of 5 to 20 seconds.

DETAILED DESCRIPTION OF THE PREFERRED EMBODIMENTS

The present invention is described in detail below.

A reducing agent for silver ions to be used in the present invention is described below.

The thermal development photosensitive material of the present invention contains a reducing agent for an organic silver salt. The reducing agent for the organic silver salt may be any material (preferably an organic material) that reduces silver ions to metallic silver. Such a reducing agent is described in Japanese Patent Application Laid-Open (JP-A) No. 11-65021, paragraphs [0043] to [0045] and European Patent Laid-Open No. 0803764A1, page 7, line 34 to page 18, line 12.

In the present invention, a bisphenol reducing agent is preferable as the reducing agent, and at least one of compounds represented by formula (I) is contained.

Formula (I)

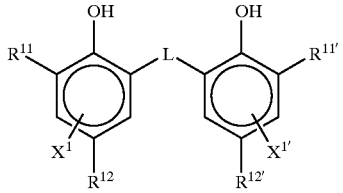

In formula (I), $R^{11}$ and $R^{11'}$ each independently represents an alkyl group having 1 to 20 carbon atoms; $R^{12}$ and $R^{12'}$ each independently represents a hydrogen atom or a substituent that can be substituted to a benzene ring; L represents —S— or —$CHR^{13}$—; $R^{13}$ represents a hydrogen atom or an optionally substituted alkyl group having 1 to 20 carbon atoms; and $X^1$ and $X^{1'}$ each independently represents a hydrogen atom or a group replaceable in a benzene ring.

Formula (I) is described in detail below.

$R^{11}$ and $R^{11'}$ each independently represents an alkyl group having 1 to 20 carbon atoms, which group may be substituted or unsubstituted. The substituent is not particularly limited. Preferable examples thereof include aryl, hydroxy, alkoxy, aryloxy, alkylthio, arylthio, acylamino, sulfonamide, sulfonyl, phosphoryl, acyl, carbamoyl and ester groups and halogen atoms.

The alkyl group is more preferably a secondary or tertiary alkyl group having 3 to 15 carbon atoms, especially preferably a tertiary alkyl group having 4 to 12 carbon atoms. Specific examples thereof include isopropyl, isobutyl, t-butyl, t-amyl, t-octyl, cyclohexyl, cyclopentyl, 1-methylcyclohexyl and 1-methylcyclopropyl groups. Of these, t-butyl, t-amyl and 1-methylcyclohexyl groups are preferable, and a t-butyl group is most preferable.

$R^{12}$ and $R^{12'}$ each independently represents a hydrogen atom or a substituent that can be substituted to a benzene ring. Preferable examples of the substituent replaceable in the benzene ring include an alkyl group, an aryl group, a halogen atom, an alkoxy group and an acylamino group.

$R^{12}$ and $R^{12'}$ are preferably an alkyl group having 1 to 20 carbon atoms. Specific examples thereof include methyl, ethyl, propyl, butyl, isopropyl, t-butyl, t-amyl, cyclohexyl, 1-methylcyclohexyl, benzyl, methoxymethyl and methoxyethyl groups. Methyl, ethyl, propyl, isopropyl and t-butyl groups are preferable.

When $R^{13}$, to be described later, is a hydrogen atom, $R^{12}$ and $R^{12'}$ are more preferably an alkyl group having 2 to 5 carbon atoms. Specifically, ethyl and propyl groups are more preferable, and an ethyl group is most preferable.

When $R^{13}$ is a primary or secondary alkyl group having 1 to 8 carbon atoms, $R^{12}$ and $R^{12'}$ are most preferably a methyl group. The primary or secondary alkyl group having 1 to 8 carbon atoms is described in the section on $R^{13}$.

$X^1$ and $X^{1'}$ each independently represents a hydrogen atom or a group replaceable in a benzene ring. Preferable examples of the group replaceable in the benzene ring include an alkyl group, an aryl group, a halogen atom, an alkoxy group and an acylamino group.

$X^1$ and $X^{1'}$ are each preferably a hydrogen atom, a halogen atom or an alkyl group, and most preferably a hydrogen atom.

L represents —S— or —$CHR^{13}$—. $R^{13}$ represents a hydrogen atom or an optionally substituted alkyl group having 1 to 20 carbon atoms. Examples of a substituent in the alkyl group include halogen atoms and alkoxy, alkylthio, aryloxy, arylthio, acylamino, sulfonamide, sulfonyl, phosphoryl, oxycarbonyl, carbamoyl and sulfamoyl groups.

Specific examples of the unsubstituted alkyl group include methyl, ethyl, propyl, butyl, heptyl, undecyl, isopropyl, 1-ethylpentyl and 2,4,4-trimethylpentyl groups.

L is preferably —$CHR^{13}$—.

$R^{13}$ is preferably a hydrogen atom or an alkyl group having 1 to 15 carbon atoms. A hydrogen atom or an alkyl group having 1 to 10 carbon atoms is more preferable. Specifically, a hydrogen atom and methyl, ethyl, propyl, isopropyl and 2,4,4-trimethylpentyl groups are preferable. A hydrogen atom and methyl, propyl and isopropyl groups are more preferable.

As the primary or secondary alkyl group having 1 to 8 carbon atoms as described for $R^{12}$ and $R^{12'}$, methyl, ethyl, propyl and isopropyl groups are more preferable, and methyl, ethyl and propyl groups are further preferable.

When, $R^{11}$, $R^{11'}$, $R^{12}$ and $R^{12'}$ are all methyl groups, $R^{13}$ is preferably a secondary alkyl group. As the secondary alkyl group, isopropyl, isobutyl and 1-ethylpentyl groups are preferable, and an isopropyl group is more preferable.

Specific examples of compounds represented by formula (I) as the reducing agent of the present invention are shown below. However, the present invention is not limited thereto.

(1-1)

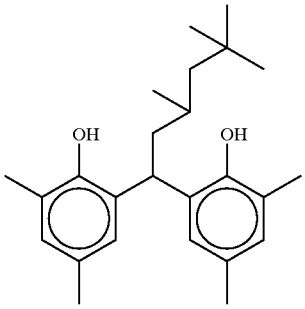

(1-2)

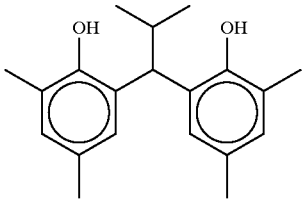

(1-3)

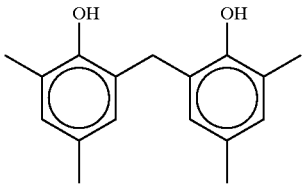

(1-4)

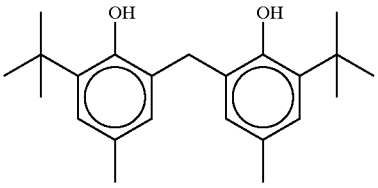

-continued (1-5)

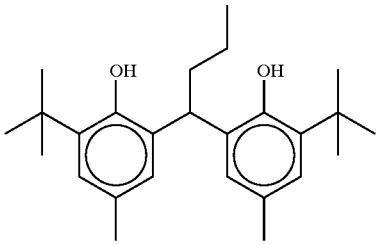

(1-6)

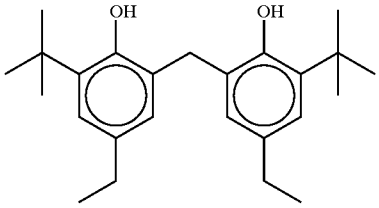

(1-7)

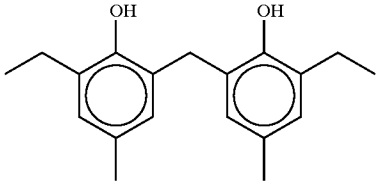

(1-8)

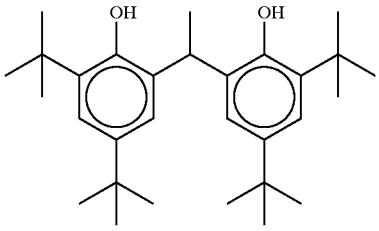

(1-9)

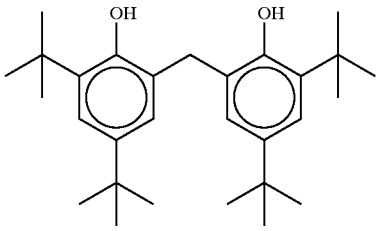

(1-10)

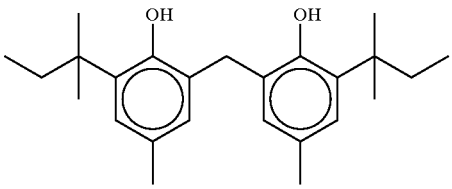

(1-11)

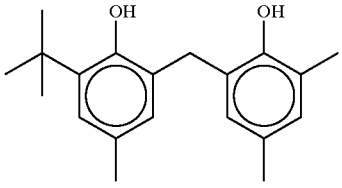

-continued (1-12)

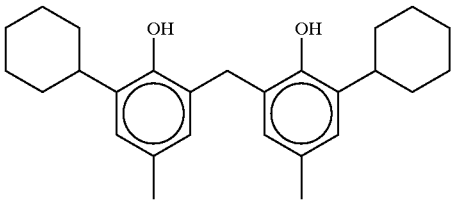

(1-13)

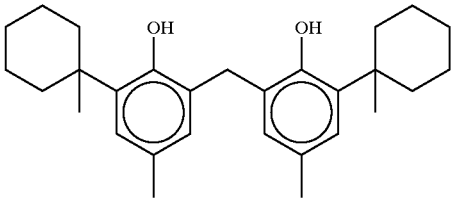

(1-14)

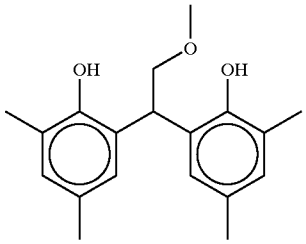

(1-15)

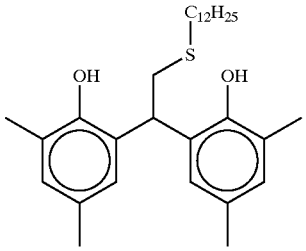

(1-16)

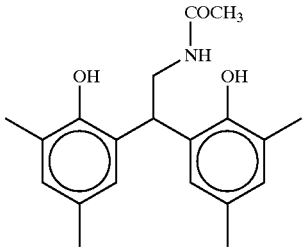

(1-17)

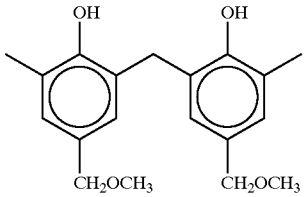

-continued (1-18)

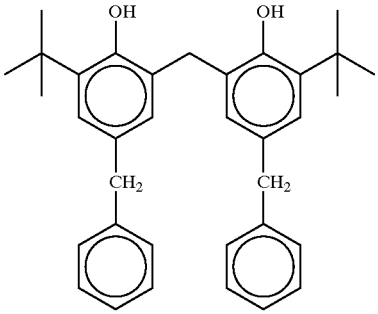

(1-19)

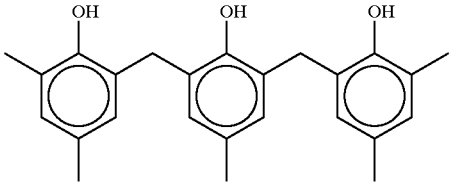

(1-20)

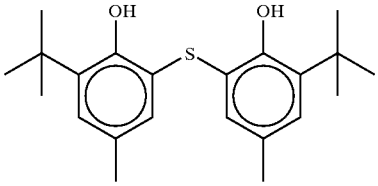

In the present invention, the amount of the compound represented by formula (I) is preferably 0.01 to 5.0 g/$m^2$, more preferably 0.1 to 3.0 g/$m^2$. The amount is also preferably 5 to 50 mol %, more preferably 10 to 40 mol % for each mol of silver on a surface having an imaging layer.

It is advisable that the compound represented by formula (I) is contained in the imaging layer.

The compound represented by formula (I) may be incorporated in a coating solution by any of a solution method, an emulsion dispersion method and a solid fine grain dispersion method, and incorporated in a photosensitive material.

As a well-known emulsion dispersion method, a method can be mentioned in which the compound is dissolved using an oil such as dibutyl phthalate, tricresyl phosphate, glyceryl triacetate or diethyl phthalate or a co-solvent such as ethyl acetate or cyclohexanone, and an emulsion dispersion is mechanically produced.

As the solid fine grain dispersion method, a method can be mentioned in which a powder of the compound represented by formula (I) is dispersed in an appropriate solvent such as water with a ball mill, a colloid mill, a vibration ball mill, a sand mill, a jet mill, a roller mill or ultrasound to form a solid dispersion. At this time, a protective colloid (for example, polyvinyl alcohol) and a surfactant (for example, an anionic surfactant such as sodium triisopropylnaphthalenesulfonate (in which three isopropyl groups have different substitution positions)) may be used. A water dispersion may contain a preservative (for example, benzoisothiazolinone sodium salt).

In the present invention, at least one of hindered phenol compounds represented by formula (II) is also contained.

Formula (II)

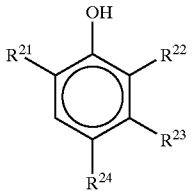

In formula (II), $R^{21}$ and $R^{22}$ each independently represents a hydrogen atom, an alkyl group or an acylamino group; $R^{21}$ and $R^{22}$ are not 2-hydroxyphenylmethyl groups, nor are $R^{21}$ and $R^{22}$ both hydrogen atoms at the same time; $R^{23}$ represents a hydrogen atom or an optionally substituted alkyl group; and $R^{24}$ represents a substituent that can be substituted to a benzene ring.

Formula (II) is described in detail below.

When $R^{21}$ is an alkyl group, an alkyl group having 1 to 30 carbon atoms is preferable, and an alkyl group having 1 to 10 carbon atoms is more preferable.

The alkyl group may be an optionally substituted alkyl group. Specifically, as the unsubstituted alkyl group, methyl, ethyl, butyl, octyl, isopropyl, t-butyl, t-octyl, t-amyl, sec-butyl, cyclohexyl and 1-methylcyclohexyl groups are preferable. A group sterically greater than an isopropyl group is more preferable, examples thereof being isononyl, t-butyl, t-amyl, t-octyl, cyclohexyl, 1-methylcyclohexyl and adamantyl groups. Of these, t-butyl, t-octyl and t-amyl groups, which are tertiary alkyl groups, are especially preferable.

When the alkyl group is a substituted alkyl group, examples of the substituent include halogen atoms and aryl, alkoxy, amino, acyl, acylamino, alkylthio, arylthio, sulfonamide, acyloxy, oxycarbonyl, carbamoyl, sulfamoyl, sulfonyl and phosphoryl groups.

When $R^{22}$ is an alkyl group, an alkyl group having 1 to 30 carbon atoms is preferable, and an unsubstituted alkyl group having 1 to 24 carbon atoms is more preferable.

The alkyl group may be an optionally substituted alkyl group. Preferable examples of the unsubstituted alkyl group include methyl, ethyl, butyl, octyl, isopropyl, t-butyl, t-octyl, t-amyl, sec-butyl, cyclohexyl and 1-methylcyclohexyl groups.

Examples of the substituent are the same as for $R^{21}$.

When $R^{21}$ or $R^{22}$ is an acylamino group, an acylamino group having 1 to 30 carbon atoms is preferable, and an acylamino group having 1 to 10 carbon atoms is more preferable.

The acylamino group may be unsubstituted or substituted. Specific examples thereof include acetylamino, alkoxyacetylamino and aryloxyacetylamino groups.

For $R^{21}$, among a hydrogen atom, an alkyl group and an acylamino group, an alkyl group is preferable.

For $R^{22}$, among a hydrogen atom, an alkyl group and an acylamino group, a hydrogen atom and an unsubstituted alkyl group having 1 to 24 carbon atoms are preferable. Specific examples thereof include methyl, isopropyl and t-butyl groups.

$R^{21}$ and $R^{22}$ cannot be 2-hydroxyphenylmethyl groups, nor can they both be hydrogen atoms at the same time.

$R^{23}$ represents a hydrogen atom or an alkyl group. Among these, a hydrogen atom or an alkyl group having 1 to 30 carbon atoms is preferable, and a hydrogen atom or an unsubstituted alkyl group having 1 to 24 carbon atoms is more preferable. Description of the alkyl group is the same as for $R^{22}$. Specific examples thereof include methyl, isopropyl and t-butyl groups.

It is preferable that one of $R^{22}$ and $R^{23}$ is a hydrogen atom.

$R^{24}$ represents a group replaceable in a benzene ring, which is the same as those described for $R^{12}$ and $R^{12'}$ in the compounds of formula (I). Preferable examples of the group of $R^{24}$ include a substituted or unsubstituted alkyl group having 1 to 30 carbon atoms, and an oxycarbonyl group having 2 to 30 carbon atoms. An alkyl group having 1 to 24 carbon atoms is more preferable. Examples of the substituent of the substituted alkyl group include aryl, amino, alkoxy, oxycarbonyl, acylamino, acyloxy, imido and ureido groups. Aryl, amino, oxycarbonyl and alkoxy groups are preferable.

Of the compounds of formula (II), a preferable structure is represented by formula (III).

Formula (III)

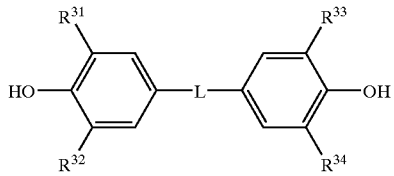

$R^{31}$, $R^{32}$, $R^{33}$ and $R^{34}$ each independently represents a substituted or unsubstituted alkyl group having 1 to 20 carbon atoms. An alkyl group having 1 to 10 carbon atoms is preferable. The substituent of the substituted alkyl group is not particularly limited. Preferable examples thereof include aryl, hydroxy, alkoxy, aryloxy, alkylthio, arylthio, acylamino, sulfonamide, sulfonyl, phosphoryl, acyl, carbamoyl and ester groups, and halogen atoms. It is preferable that at least one group sterically greater than an isopropyl group (for example, isononyl, t-butyl, t-amyl, t-octyl, cyclohexyl, 1-methylcyclohexyl and adamantyl groups) is present. It is more preferable that at least two such groups are present. As a group which is sterically greater than an isopropyl group, t-butyl, t-octyl and t-amyl groups, which are tertiary alkyl groups, are especially preferable. L is the same as described for the compounds of formula (I).

Specific examples of the compounds of formulas (II) and (III) in the present invention are shown below. However, these are not limiting.

(2-1)
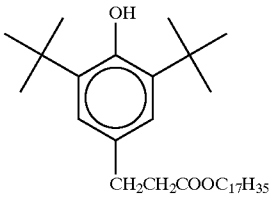
(2-2)
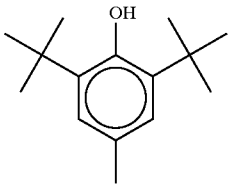
(2-3)
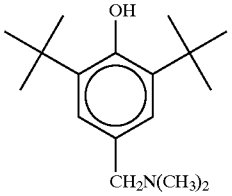
(2-4)
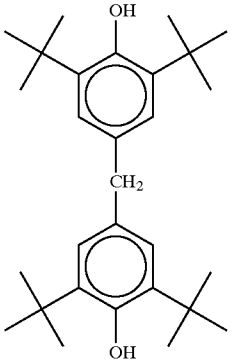
(2-5)
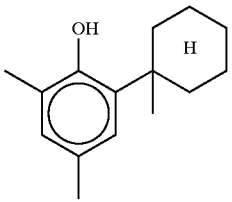
(2-6)
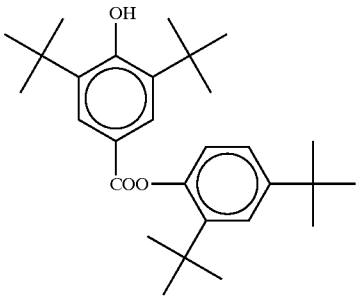
(2-7)
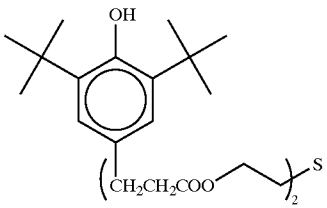
(2-8)
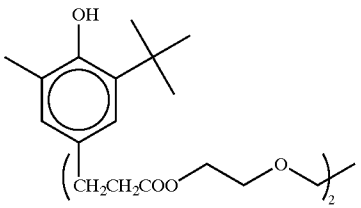

-continued
(2-9)
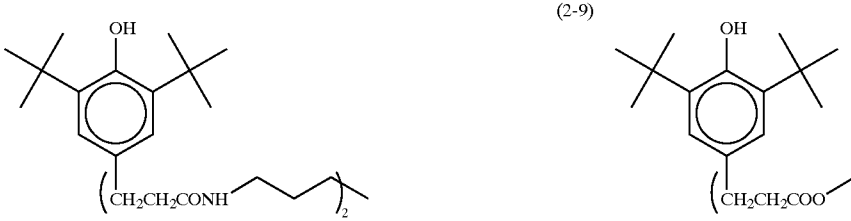
(2-10)
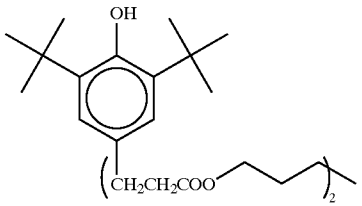
(2-11)
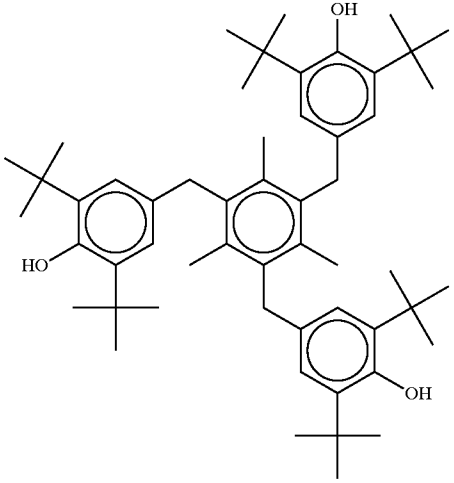
(2-12)
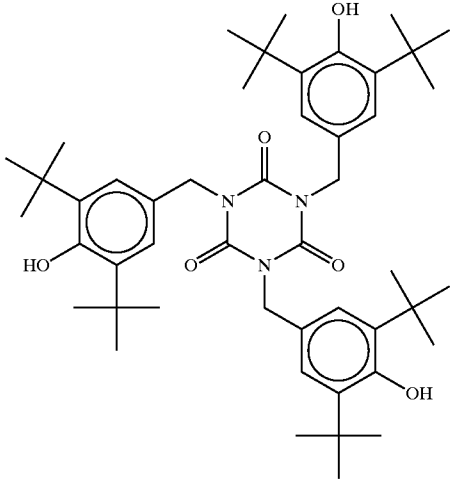
(2-13)
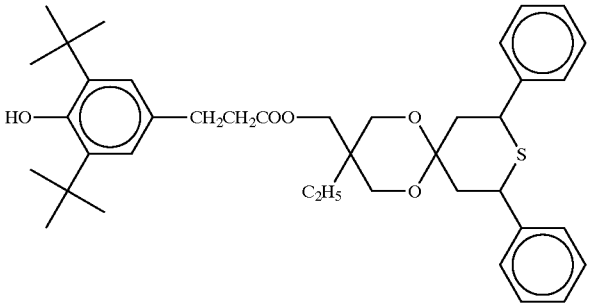

-continued
(2-14)
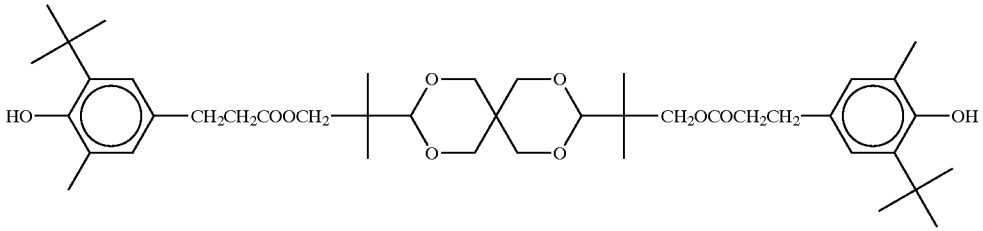
(2-15)
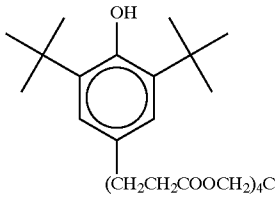
(2-16)
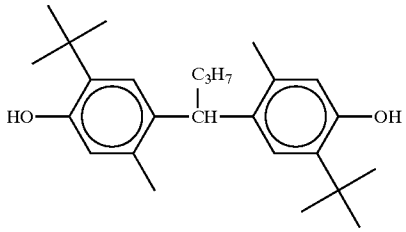
(2-17)
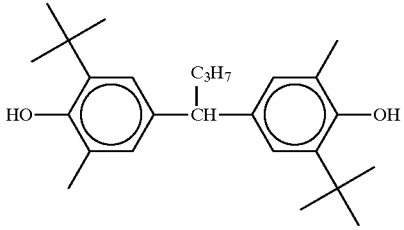
(2-18)
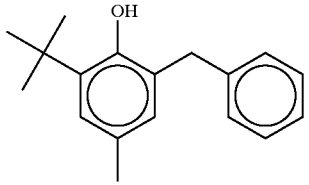
(2-19)
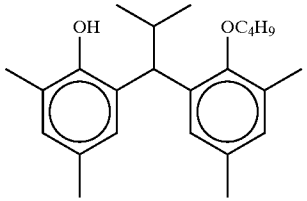
(2-20)
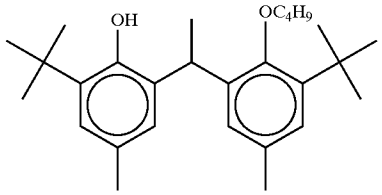

-continued
(2-21)
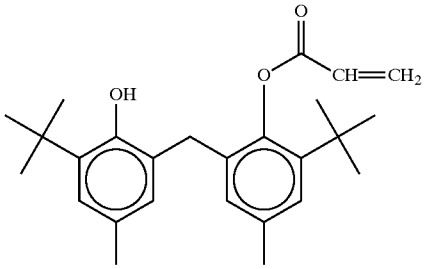
(2-22)
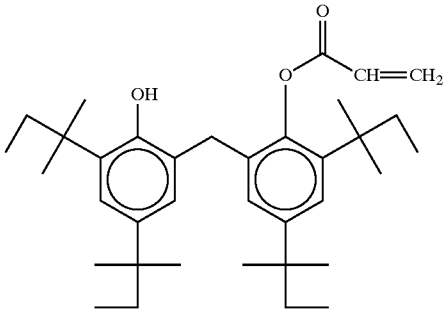
(2-23)
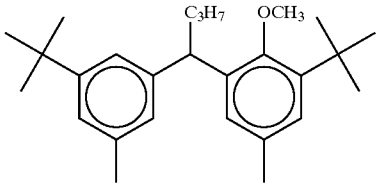
(2-24)
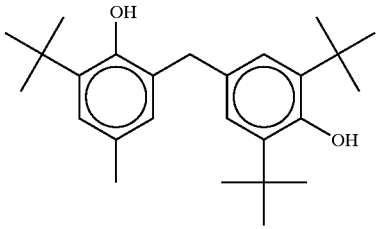
(2-25)
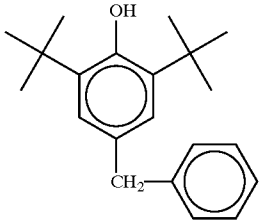
(2-26)
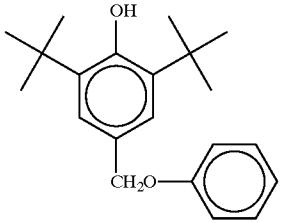
(2-27)
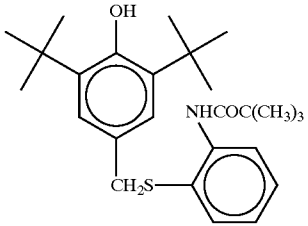
(2-28)
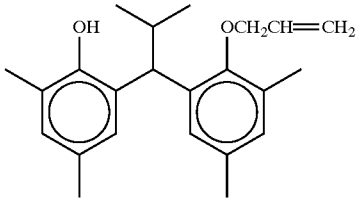

-continued
(2-29)
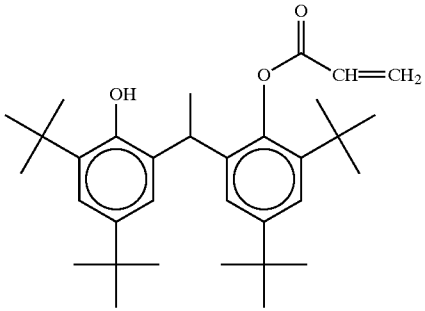
(2-30)
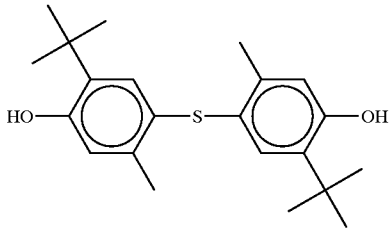
(2-31)
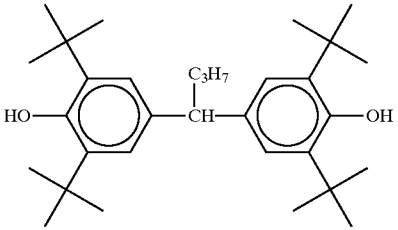
(2-32)
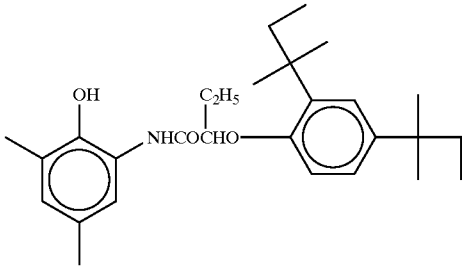
(2-33)
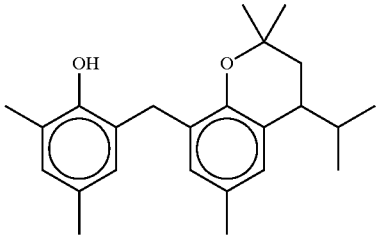
(2-34)
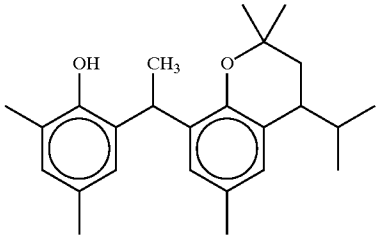
(2-35)
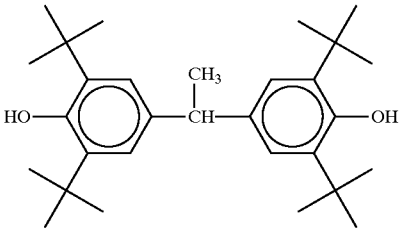
(2-36)
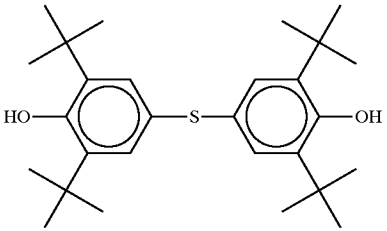

-continued
(2-37)
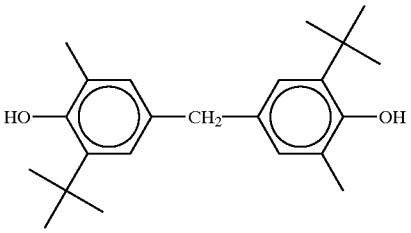
(2-38)
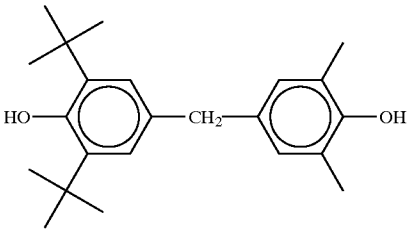
(2-39)
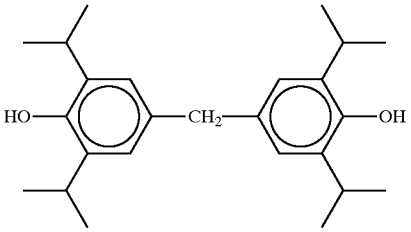
(2-40)
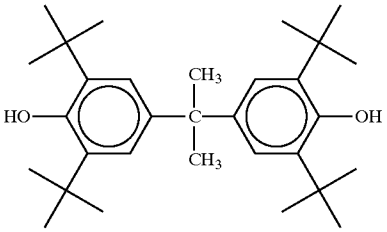

The compound represented by formula (II) or (III) can be added by the same methods as the compound represented by formula (I). It may be incorporated in a coating solution by any of a solution method, an emulsion dispersion method and a solid fine grain dispersion method, and incorporated in the photosensitive material.

A ratio of the compound of formula (I) (a polyphenol bound in the o-position) and the compound of formula (II) or formula (III) (a hindered phenol compound) (amount of the compound of formula (II) or (III)(mol)/amount of the compound of formula (I)(mol)) is 0.001 to 0.2, preferably 0.005 to 0.1, and more preferably 0.008 to 0.05.

It is advisable that the compounds of formulas (I) and (II) or (III) are incorporated in an imaging layer containing an organic silver salt. It is also possible that one thereof is incorporated in an imaging layer and the other in a non-imaging layer adjacent thereto, or that both compounds are incorporated in a non-imaging layer. Further, when the imaging layer is structured of plural layers, the compounds may be incorporated in separate layers.

In the thermal development photosensitive material of the present invention, phenol derivatives represented by formula (A) described in Japanese Patent Application No. 11-73951 are preferably used as a development accelerator.

When the reducing agent in the present invention has an aromatic hydroxyl group (—OH), especially if it is a bisphenol, it is advisable to use a non-reducible compound having a group capable of forming a hydrogen bond in combination with this group. Examples of the group capable of forming a hydrogen bond with a hydroxyl group or an amino group include phosphoryl, sulfoxide, sulfonyl, carbonyl, amide, ester, urethane, ureido, tertiary amino and nitrogen-containing aromatic groups. Preferable are compounds having a phosphoryl group, a sulfoxide group, an aminde group (free from >N—H and blocked like >N—Ra (Ra is a substituent except H)), an urethane group (free from >N—H and blocked in the manner >N—Ra (Ra is a substituent that is not H)) or a ureido group (free from >N—H and blocked in the manner >N—Ra).

In the present invention, especially preferable examples of the hydrogen-bonding compounds are compounds represented by formula (A).

Formula (A)

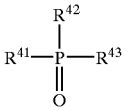

In formula (A), $R^{41}$ to $R^{43}$ each independently represents an alkyl, aryl, alkoxy, aryloxy, amino or heterocyclic group. These groups may be unsubstituted or substituted. When any of $R^{41}$ to $R^{43}$ is a substituted group, examples of the substituent include halogen atoms and alkyl, aryl, alkoxy, amino, acyl, acylamino, alkylthio, arylthio, sulfonamide, acyloxy, oxycarbonyl, carbamoyl, sulfamoyl, sulfonyl and phosphoryl groups. Alkyl and aryl groups are preferable. Specific examples thereof include methyl, ethyl, isopropyl, t-butyl, t-octyl, phenyl, 4-alkoxyphenyl and 4-acyloxyphenyl groups.

Specific examples of alkyl groups of $R^{41}$ to $R^{43}$ include methyl, ethyl, butyl, octyl, dodecyl, isopropyl, t-butyl, t-amyl, t-octyl, cyclohexyl, 1-methylcyclohexyl, benzyl, phenetyl and 2-phenoxypropyl groups.

Examples of aryl groups of $R^{41}$ to $R^{43}$ include phenyl, cresyl, xylyl, naphthyl, 4-t-butylphenyl, 4-t-octylphenyl, 4-anisidyl and 3,5-dichlorophenyl groups. Phenyl and 4-t-butylphenyl groups are preferable, and a 4-t-butylphenyl group is especially preferable.

Examples of alkoxy groups of $R^{41}$ to $R^{43}$ include methoxy, ethoxy, butoxy, octyloxy, 2-ethylhexyloxy, 3,5,5-trimethylhexyloxy, dodecyloxy, cyclohexyloxy, 4-methylcyclohexyloxy and benzyloxy groups.

Examples of aryloxy groups of $R^{41}$ to $R^{43}$ include phenoxy, cresyloxy, isopropylphenoxy, 4-t-butylphenoxy, naphthoxy and biphenyloxy groups.

Examples of amino groups of $R^{41}$ to $R^{43}$ include dimethylamino, diethylamino, dibutylamino, dioctylamino, N-methyl-N-hexylamino, dicyclohexylamino, diphenylamino and N-methyl-N-phenylamino groups.

Examples of heterocyclic groups of $R^{41}$ to $R^{43}$ include pyridyl, pyrimidyl and triazinyl groups.

As $R^{41}$ to $R^{43}$, alkyl, aryl, alkoxy and aryloxy groups are preferable. In view of the effects of the present invention, it is preferable that at least one of $R^{41}$ to $R^{43}$ is an alkyl group or an aryl group, and it is more preferable that at least two of $R^{41}$ to $R^{43}$ are alkyl or aryl groups. $R^{41}$ to $R^{43}$ are preferably all the same group because then the compound can be procured at low cost.

Specific examples of hydrogen-bonding compounds such as the compounds of formula (A) in the present invention are shown below. However, the present invention is not limited thereto.

(3-1)

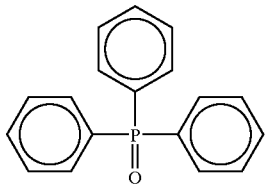

(3-2)

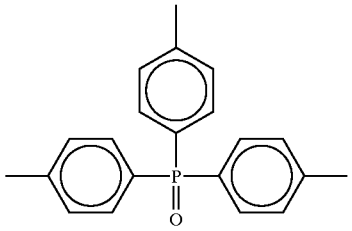

(3-3)

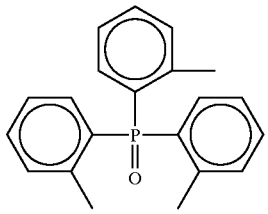

(3-4)

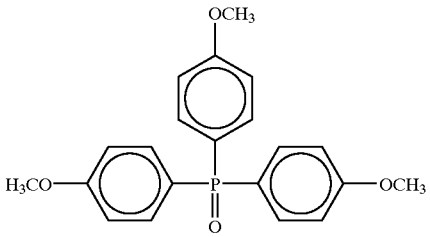

-continued (3-5)

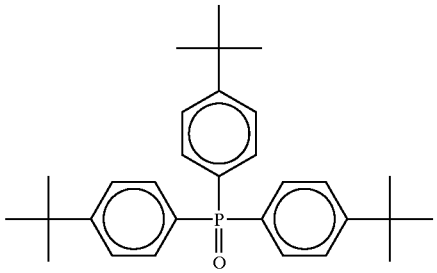

(3-6)

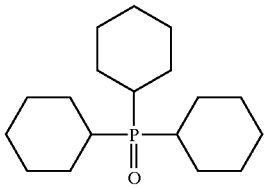

(3-7)

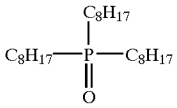

(3-8)

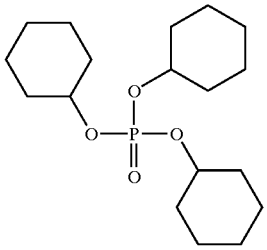

(3-9)

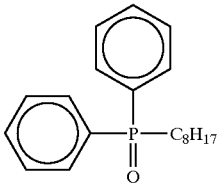

(3-10)

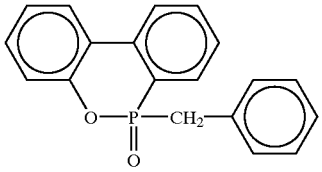

(3-11)

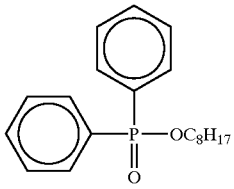

(3-12)

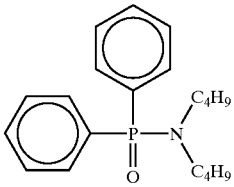

-continued (3-13)

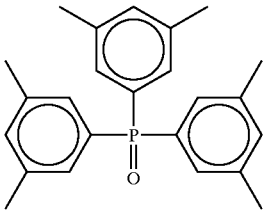

(3-14)

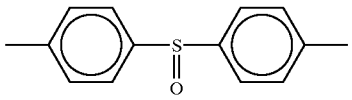

(3-15)

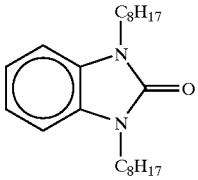

(3-16)

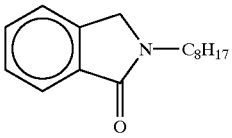

(3-17)

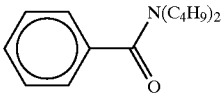

Specific examples of the hydrogen-bonding compounds include, in addition to the above compounds, those described in Japanese Patent Application Nos. 2000-192191 and 2000-194811.

The compound of formula (A) of the present invention, like the reducing agent, can be incorporated in a coating solution in the form of a solution, an emulsion dispersion or a solid fine grain dispersion, and used in the photosensitive material. The compound of the present invention forms a hydrogen-bonding complex with a compound having a phenolic hydroxyl group or an amino group in a solution state, and can be isolated in a crystalline state as the complex by combination between the reducing agent and the compound of formula (A) of the present invention. For obtaining stable performance, it is especially preferable that the thus-isolated crystalline powder is used as a solid fine grain dispersion. Further, a method in which the reducing agent and the compound of formula (A) of the present invention are mixed in powdery form and the complex is formed in the dispersion using an appropriate dispersing agent with a sand grinder mill can be preferably used.

In the present invention, the amount of the compound of formula (A) is preferably 1 to 200 mol %, more preferably 10 to 150 mol %, and further preferably 30 to 100 mol % relative to the reducing agent.

The non-photosensitive organic silver salt used in the present invention is described below.

The thermal development photosensitive material of the present invention contains a non-photosensitive organic silver salt (hereinafter sometimes referred to simply as "organic silver salt"). Although the organic silver salt is relatively stable to light, it is a silver salt that forms a silver image when heated to 80° C. or more in the presence of an exposed photocatalyst (photosensitive silver halide latent image) and the reducing agent. The organic silver salt may be any organic material that contains a source capable of reducing silver ions. Such non-photosensitive organic silver salts are described in JP-A No. 10-62899, paragraphs [0048] and [0049], European Patent Laid-Open No. 0803764A1, page 18, line 24 to page 19, line 37, European Patent Laid-Open No. 0962812A1, and JP-A Nos. 11-349591, 2000-7683 and 2000-72711. An organic acid silver salt is preferable, and a long-chain aliphatic carboxylic acid silver salt (having 10 to 30 carbon atoms, preferably 15 to 28 carbon atoms) is especially preferable. Preferable examples of the organic silver salt include silver behenate, silver arachidate, silver stearate, silver oleate, silver laurate, silver caproate, silver myristate, silver palmitate and mixtures thereof. In the present invention, among these organic silver salts, an organic acid salt containing 75 mol % or more of silver behenate is preferable.

The form of the organic silver salt that can be used in the present invention is not particularly limited. Preferable examples of the form are acicular, bar-shaped, tabular and flaky forms. The acicular and flaky forms are especially preferable. The flaky form is especially preferable.

In the present specification, a flaky organic silver salt is defined as follows. The organic acid silver salt is observed with an electron microscope, and the form of the organic acid silver salt grain is deemed to approximate to a rectangular solid. Sides of this rectangular solid are designated a, b and c in order from the shortest side (c may be the same as b). At this time, a value x is calculated as follows from the shorter values a and b.

$$x=b/a$$

In this manner, x is calculated for 200 grains. If the average value of x meets the relation x (average)≧1.5, the form can be regarded as flaky. Preferable is 30≧x (average)≧1.5. More preferable is 20≧x (average)≧2.0. In the acicular form, 1≧x (average)≧1.5.

In flaky grains, a can be regarded as a thickness of a tabular grain in which a surface having sides b and c is a main plane. The average of a is preferably from 0.01 μm to 0.23 μm, more preferably from 0.11 μm to 0.20 μm. The average of c/b is preferably from 1 to 6, more preferably from 1.05 to 4, further preferably from 1.1 to 3, and especially preferably from 1.1 to 2.

A grain size distribution of the organic silver salt is preferably monodisperse. In "monodispersion", a percent value calculated by dividing a standard deviation of the length of a short axis or a long axis by the short axis or the long axis is preferably 100% or less, more preferably 80% or less, and further preferably 50% or less. The form of the organic silver salt can be measured from a transmission electron microscope image of the organic silver salt dispersion. As another method of measuring monodispersion property, there is a method in which the standard deviation of the volume weighted average diameter of the organic silver salt is measured. A percent value of that value divided by the volume weighted average diameter (fluctuation coefficient) is preferably 100% or less, more preferably 80% or less, further preferably 50% or less. This can be found from a grain size (volume weighted average diameter) obtained by, for example, irradiating the organic silver salt dispersed in a solution with a laser beam and calculating an autocorrelation function of fluctuation of scattered light relative to change of time.

Preparation of the organic acid silver salt used in the present invention and a dispersion thereof can be conducted by known methods referring to, for example, JP-A No. 10-62899, European Patent Laid-Open Nos. 0803763A1 and 0962812A1, JP-A Nos. 11-349591, 2000-7683 and 2000-72711 and Japanese Patent Application Nos. 11-348228 to 11-348230, 11-203413, 2000-90093, 2000-195621, 2000-191226, 2000-213813, 2000-214155 and 2000-191226.

If a photosensitive silver salt is present when the organic silver salt is dispersed, fogging increases, which notably decreases sensitivity. Accordingly, it is preferable that photosensitive silver salt is substantially absent at the time of dispersion. In the present invention, the amount of photosensitive silver salt in the water dispersion is 0.1 mol % or less per mol of the organic acid silver salt in the dispersion, and deliberate addition of the photosensitive silver salt is not conducted.

In the present invention, the photosensitive material can be prepared by mixing the organic silver salt water dispersion with the photosensitive silver salt water dispersion. A mixing ratio of the organic silver salt and the photosensitive silver salt can be selected according to purposes. The ratio of the photosensitive silver salt to the organic silver salt is preferably 1 to 30 mol %, more preferably 3 to 20 mol %, and especially preferably 5 to 15 mol %. A method of mixing at least two organic silver salt water dispersions with at least two photosensitive silver salt water dispersions is preferably used for adjusting photographic characteristics.

The organic silver salt of the present invention can be used in a desired amount. It is preferably 0.1 to 5 g/m$^2$, more preferably 1 to 3 g/m$^2$, in terms of an amount of silver.

A photosensitive silver halide used in the present invention is described below.

The thermal development photosensitive material of the present invention contains the photosensitive silver halide. The photosensitive silver halide is not particularly limited as a halogen composition, and silver chloride, silver chlorobromide, silver bromide, silver iodobromide and silver iodochloride are usable. Of these, silver bromide and silver iodobromide are preferable. The distribution of the halogen composition in grains may be uniform, or the halogen composition may vary stepwise or continuously. Further, silver halide grains having a core/shell structure can be preferably used. The core/shell structure is preferably a 2- to 5-layer structure, more preferably a 2- to 4-layer structure. Moreover, a technique in which silver bromide is localized on the surface of a silver chloride or silver chlorobromide grain can also be preferably used.

Methods of forming the photosensitive silver halide are well known to those skilled in the art. Examples thereof include methods described in Research Disclosure No. 17029, June 1978 and U.S. Pat. No. 3,700,458. Specifically, a method can be employed in which a silver-donating compound and a halogen-donating compound are added to a gelatin or other polymer solution to form the photosensitive silver halide, which is then mixed with the organic silver salt. Further, a method described in JP-A No. 11-119374, paragraphs [0217] to [0224], and methods described in Japanese Patent Application Nos. 11-98708 and 2000-42336 are also desirable.

A smaller grain size of the photosensitive silver halide is preferable for suppressing cloudiness after imaging. Specifically, it is preferably 0.20 μm or less, more preferably from 0.01 μm to 0.15 μm, and further preferably from 0.02 μm to 0.12 μm. The grain size as referred to here means a diameter calculated for a circular image having the same area as a projected area of a silver halide grain (projected area of a main plane in the case of tabular grains).

With respect to form of the silver halide grains, cubic grains, octahedral grains, tabular grains, spherical grains, bar-like grains and potato-like grains can be listed. In the present invention, cubic grains are preferable. Silver halide grains having round corners can also be preferably used. A mirror index of the outer surface of the photosensitive silver halide grains is not particularly limited. It is preferable that a ratio of a [100] surface, which has a high spectral sensitization efficiency when adsorbing a spectral sensitization coloring matter, is high. This ratio is preferably 50% or more, more preferably 65% or more, and further preferably 80% or more. The mirror index ratio of the [100] surface can be found by a method using adsorption dependence of [111] and [100] surfaces in adsorption of sensitization coloring matter, as described by T. Tani, *J. Imaging Sci.,* 29, 165 (1985).

In the present invention, silver halide grains in which a hexacyano metal complex is present on the outermost surface of the grains are preferable. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]_{3-}$, $[Ir(CN)_6]^{3-}$, $[Cr(CN)_6]^{3-}$ and $[Re(CN)_6]^{3}$, –. In the present invention, hexacyano Fe complexes are preferable.

The hexacyano metal complex is present in an aqueous solution in the form of ions, so counter cations are not required. It is, however, advisable to use an alkali metal ion, such as a sodium ion, a potassium ion, a rubidium ion, a cesium ion or a lithium ion, an ammonium ion or an alkylammonium ion (such as a tetramethylammonium ion, a tetraethylammonium ion, a tetrapropylammonium ion or a tetra(n-butyl)ammonium ion) which is easily miscible with water and suited for precipitation of a silver halide emulsion.

The hexacyano metal complex can be added by being mixed with water, a mixed solvent of water and an appropriate organic solvent that is miscible with water (for example, alcohols, ethers, glycols, ketones, esters and amides), or gelatin.

The amount of the hexacyano metal complex is preferably from $1\times10^{-5}$ mol to $1\times10^{-2}$, more preferably from $1\times10^{-4}$ mol to $1\times10^{-3}$ mol, per mol of silver.

For the hexacyano metal complex to be present on the outermost surface of the silver halide grains, the hexacyano metal complex is directly added from a time after finishing addition of a silver nitrate aqueous solution used in forming the grains till a chemical sensitization step of conducting chalcogen sensitization such as sulfur sensitization, selenium sensitization or tellurium sensitization, or noble metal sensitization such as gold sensitization. That is, the complex is added before completion of a charging step, during a water-washing step, during a dispersing step or before a chemical sensitization step. In order not to further grow the silver halide grains, it is preferable to add the hexacyano metal complex soon after formation of the grains, and it is more preferable to add the same before completion of a charging step.

The addition of the hexacyano metal complex may be started after 96% by mass of the total amount of silver nitrate has been added to form the grains. It is preferable to start after 98% by mass of the same has been added. It is especially preferable to start after 99% by mass of the same has been added.

When the hexacyano metal complex is added after the addition of the silver nitrate aqueous solution and just before completing formation of the grains, it can be adsorbed on the outermost surfaces of the silver halide grains, and most of the grains form sparingly-soluble salts with silver ions present on the surfaces of grains. Since a hexacyano iron (II) silver salt is more sparingly soluble than AgI, re-dissolution of the grains can be prevented, and silver halide grains having a small grain size can be prepared.

The photosensitive silver halide grains of the present invention can contain metals of Groups 8 to 10 in the periodic table (of groups designated 1 to 18) or complexes of these metals. As the metals of Groups 8 to 10, or center metals of the metal complexes, rhodium, ruthenium and iridium are preferable. The metal complexes may be used singly, or complexes of the same metals or of different metals may be used in combination. The content thereof is preferably $1\times10^{-9}$ to $1\times10^{-3}$ mol per mol of silver. The noble metals or metal complexes and addition methods thereof are described in JP-A No. 7-225449, JP-A No. 11-65021, paragraphs [0018] to [0024], and JP-A No. 11-119374, paragraphs [0227] to [0240].

Metal atoms (for example, $[Fe(CN)_6]^{4-}$) that can be contained in the silver halide grains used in the present invention, a desalting method of a silver halide emulsion and a chemical sensitization method are described in, for example, JP-A No. 11-84574, paragraphs [0046] to [0050], JP-A No. 11-65021, paragraphs [0025] to [0031] and JP-A No. 11-119374, paragraphs [0242] to [0250].

It is advisable that the photosensitive silver halide grains in the present invention are chemically sensitized by a sulfur sensitization method, a selenium sensitization method or a tellurium sensitization method. As a compound preferably used in the sulfur sensitization method, the selenium sensitization method or the tellurium sensitization method, known compounds, for example, compounds described in JP-A No. 7-128768, can be used. In the present invention, tellurium sensitization is preferable, and compounds described in JP-A No. 11-65021, paragraph [0030], and compounds represented by formulas (II), (III) and (IV) of JP-A No. 5-313284 are more preferable.

In the present invention, the chemical sensitization can be conducted at any stage after formation of the grains and before coating. It can be conducted after desalting, (1) before spectral sensitization, (2) simultaneously with spectral sensitization, (3) after spectral sensitization or (4) just before coating. Especially, it is preferable to conduct the same after spectral sensitization.

The amount of a sulfur, selenium or tellurium sensitizer used in the present invention varies with the silver halide grains used and chemical ageing conditions. The amount is $10^{-8}$ to $10^{-2}$ mol, preferably $10^{-7}$ to $10^{-3}$ mol, per mol of silver halide. Conditions of the chemical sensitization in the present invention are not particularly limited. A pH value is 5 to 8, pAg is 6 to 11, and temperature is around 40° C. to 95° C.

A thiosulfonic acid compound may be added to the silver halide emulsion used in the present invention by a method indicated in European Patent Laid-Open No. 293,917.

With respect to the photosensitive silver halide emulsion in the photosensitive material used in the present invention, one type alone or a combination of two or more types (for example, compounds different in average grain size, compounds different in halogen composition, compounds different in crystal habit or compounds different in conditions of chemical sensitization) may be used. The use of plural photosensitive silver halides different in sensitivity enables adjustment of gradation. Techniques with such compounds are described in JP-A Nos. 57-119341, 53-106125, 47-3929, 48-55730, 46-5187, 50-73627 and 57-150841, etc. With respect to differences in sensitivity, it is preferable to provide a difference of 0.2 logE or more in each emulsion.

The amount of the photosensitive silver halide is preferably 0.03 to 0.6 g/m$^2$, more preferably 0.07 to 0.4 g/m$^2$, and most preferably 0.05 to 0.3 g/m$^2$, in terms of a coating silver amount for 1 m$^2$ of the photosensitive material. Further, the amount of the photosensitive silver halide is preferably from 0.01 to 0.5 mol, more preferably from 0.02 to 0.3 mol, per mol of the organic silver salt.

With respect to method and conditions when mixing the separately formed photosensitive silver halide and organic silver salt, there are a method in which the separately formed silver halide grains and organic silver salt are mixed with a high-speed stirrer, a ball mill, a sand mill, a colloid mill, a vibration mill or a homogenizer, and a method in which the already formed photosensitive silver halide is mixed in at any stage during preparation of the organic silver salt. The method is not particularly limited so long as the effects of the present invention are satisfactorily brought forth. Further, a method in which at least two organic silver salt water dispersions and at least two photosensitive silver salt water dispersions are mixed is preferable for adjusting photographic characteristics.

A time to add the silver halide of the present invention to an imaging layer coating solution is from 180 minutes before coating till just before coating, preferably from 60 minutes to 10 seconds before coating. A mixing method and conditions are not particularly limited so long as the effects of the present invention are satisfactorily brought forth. Specific examples of the mixing method include a method of mixing in a tank in which an average retention time calculated from an addition flow rate and amount of solution fed to a coater becomes a desired time, and a method using a static mixer as described in chapter 8 of "Liquid Mixing Technology", N. Harnby, M. F. Edwards and A. W. Nienow, translated by Takahashi K. (Nikkan Kogyo Shinbunsha, 1989).

As a gelatin contained in the photosensitive silver halide emulsion used in the present invention, various gelatins are usable. For maintaining a good dispersion state of the photosensitive silver halide emulsion in an organic silver salt-containing coating solution, low-molecular gelatins, having a molecular weight of 500 to 60,000, are preferably used. These low-molecular gelatins may be used in forming grains or during dispersion after a desalting treatment. It is preferable to use them during the dispersion after the desalting treatment.

It is advisable that the thermal development photosensitive material of the present invention is infrared-sensitized. "Infrared-sensitized" means that the photosensitive silver halide is spectrally sensitized to a wavelength zone of 750 nm to 1,400 nm with a sensitization coloring matter. As the sensitization coloring matter, known compounds can be used. The material can be spectrally sensitized advantageously with various known coloring matters such as cyanine, merocyanine, styryl, hemicyanine, oxonol, hemioxonol and xanthene coloring matters. Useful cyanine coloring matters are, for example, those having basic nuclei, such as a thiazoline nucleus, an oxazoline nucleus, a pyrroline nucleus, a pyridine nucleus, an oxazole nucleus, a thiazole nucleus, a selenazole nucleus and an imidazole nucleus. Preferable useful merocyanine coloring matters are those having, in addition to the basic nuclei, acid nuclei, such as a thiohydantoin nucleus, a rhodamine nucleus, an oxazolidinedione nucleus, a thiazolinedione nucleus, a barbituric acid nucleus, a thiazolinone nucleus, a malononitrile nucleus and a pyrazolone nucleus. Of the cyanine and merocyanine coloring matters, those having an imino group or a carboxyl group are especially effective. The coloring matters can be suitably selected from known coloring matters described in U.S. Pat. Nos. 3,761,279, 3,719,495 and 3,877,943, British Patent Nos. 1,466,291, 1,469,117 and 1,422,057, Japanese Patent Publication Nos. 3-10391 and 6-52387 and JP-A Nos. 5-341432, 6-194781 and 6-301141.

These sensitization coloring matters may be used either singly or in combination. A time to add the sensitization coloring matter to the silver halide emulsion in the present invention is preferably from after desalting till coating, more preferably from after desalting till before starting chemical ageing.

The amount of the sensitization coloring matter in the present invention can be a desired amount according to properties such as sensitivity and fogging. It is preferably $10^{-6}$ to 1 mol, more preferably $10^{-4}$ to $10^{-1}$ mol, per mol of the silver halide in the photosensitive layer.

In order to improve spectral sensitization efficiency, a strong color sensitizer can be used in the present invention. As the strong color sensitizer used in the present invention, compounds described in European Patent Laid-Open No. 587,338, U.S. Pat. Nos. 3,877,943 and 4,873,184 and JP-A Nos. 5-341432, 11-109547 and 10-111543 are mentioned.

It is advisable that the thermal development photosensitive material of the present invention contains at least one compound selected from hetero-aromatic mercapto compounds and hetero-aromatic disulfide compounds. Hetero-aromatic mercapto compounds and hetero-aromatic disulfide compounds are described below.

Hetero-aromatic mercapto compounds used in the present invention are preferably compounds represented by the formula Ar—SM wherein M is a hydrogen atom or an alkali metal atom, and Ar is an aromatic ring or a fused aromatic ring having at least one nitrogen, sulfur, oxygen, selenium or tellurium atom. Preferable examples of the hetero-aromatic ring include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. Benzimidazole, benzothiazole, benzoxazole and benzotetrazole are more preferable. Further, the hetero-aromatic ring may have a substituent selected from, for example, a halogen (for example, Br or Cl), hydroxy, amino, carboxy, alkyl (for example, alkyl having one or more carbon atoms, preferably alkyl having 1 to 4 carbon atoms), alkoxy (for example, alkoxy having one or more carbon atoms, preferably alkoxy having 1 to 4 carbon atoms) and an aryl (which may have a substituent).

Examples of the hetero-aromatic mercapto compounds include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-[3-(5-mercaptotetrazolyl)phenyl]urea and 2-mercapto-4-phenyloxazole. However, the present invention is not limited thereto.

The amounts of the hetero-aromatic mercapto compounds are preferably 0.001 to 1 mol, more preferably 0.003 to 0.1 mol, per mol of silver in the emulsion layer. One mol of silver as referred to here means one mol of silver halide.

The hetero-aromatic disulfide compounds are preferably compounds represented by the formula Ar—S—S—Ar wherein Ar is an aromatic ring or a fused aromatic ring having at least one nitrogen, sulfur, oxygen, selenium or tellurium atom. Preferable examples of the hetero-aromatic ring include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyridine, purine, quinoline and quinazolinone. Benzimidazole, benzothiazole, benzoxazole and benzotetrazole are more preferable.

The hetero-aromatic ring may have a substituent selected from the group consisting of a halogen (for example, Br or Cl), hydroxy, amino, carboxy, alkyl (for example, alkyl having one or more carbon atoms, preferably alkyl having 1 to 4 carbon atoms), alkoxy (for example, alkoxy having one or more carbon atoms, preferably alkoxy having 1 to 4 carbon atoms) and an aryl (which may have a substituent).

The amounts of the hetero-aromatic disulfide compounds are preferably 0.001 to 1 mol, more preferably 0.003 to 0.1 mol, per mol of silver in the emulsion layer. One mol of silver as referred to here means one mol of silver halide.

A binder used in the present invention is described below.

The organic silver salt-containing layer in the thermal development photosensitive material of the present invention contains the binder. The binder may be any polymer. An appropriate binder is transparent or semitransparent, and generally colorless. Examples include natural resins, synthetic resins, polymers, copolymers and other film-forming mediums such as gelatins, rubbers, poly(vinyl alcohol) types, hydroxyethyl celluloses, cellulose acetates, cellulose acetate butyrates, polyvinylpyrrolidones, casein, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (for example polyvinyl formal and polyvinyl butyral), polyesters, polyurethanes, phenoxy resins, polyvinylidene chlorides, polyepoxides, polycarbonates, polyvinyl acetates, polyolefins, cellulose esters and polyamides. The binder may be coating-formed with water, an organic solvent or an emulsion.

In the present invention, the glass transition temperature of the binder of the layer containing the organic silver salt is preferably from 10° C. to 80° C. (hereinafter sometimes referred to as a high Tg binder), more preferably 20° C. to 70° C., further preferably from 23° C. to 65° C.

In the present specification, Tg is calculated using the following formula:

$$1/Tg=\Sigma(Xi/Ti)$$

wherein i is 1 to n.

That is, a polymer herein is one obtained by copolymerizing n numbers (from i=1 to i=n) of monomer components. Xi is a weight percent ($\Sigma Xi=1$) of an i-th monomer, and Tgi is a glass transition temperature (absolute temperature) of a homopolymer of the i-th monomer. $\Sigma$ is a sum of values from i=1 to i=n. For the value of the glass transition temperature (Tgi) of a homopolymer of each monomer, a value in *Polymer Handbook* (3rd Edition, J. Brandrup, E. H. Immergut, Wiley-Interscience, 1989) can be employed.

As the binder, these polymers may be used either singly or in combination. Further, a combination of a polymer having a glass transition temperature of 20° C. or more and a polymer having a glass transition temperature of less than 20° C. may be used. When two or more polymers different in Tg are used by being blended, the weight average Tg thereof is preferably in the aforementioned ranges.

In the present invention, performance is improved when the organic silver salt-containing layer is formed by coating a coating solution in which at least 30% by mass of the solvent is water, and drying the same, and further improved when the binder of the organic silver salt-containing layer is soluble or dispersible in an aqueous solvent, and especially when the binder is formed of a latex of a polymer in which an equilibrium water content at 25° C., 60% RH is 2% by mass or less. Most preferable is that the binder is formed such that ionic conductivity is 2.5 mS/cm or less. As a method therefor, a method in which, after a polymer is formed, it is purified using a separation film is mentioned.

The aqueous solvent in which the polymer is soluble or dispersible as referred to here means water or a mixture of water and 70% by mass or less of a water-miscible organic solvent. Examples of the water-miscible organic solvent include alcohols such as methyl alcohol, ethyl alcohol and propyl alcohol, cellosolves such as methyl cellosolve, ethyl cellosolve and butyl cellosolve, ethyl acetate and dimethylformamide.

In cases of a system in which the polymer is not dissolved thermodynamically but is present in a so-called dispersed state, the term "aqueous solvent" is also applied thereto.

Further, the "equilibrium water content at 25° C., 60% RH" is represented by the following formula, using a weight w1 of the polymer in moisture equilibrium under an atmosphere of 25° C. and 60% RH and a weight w0 of the polymer in an absolute dry state at 25° C.

$$\text{Equilibrium water content at 25° C. and 60\% RH} = ((w1-w0)/w0)\times 100(\%\text{ by mass}))$$

With respect to the definition of the water content and the method of measuring the same, for example, *Kobunshi Kogaku Koza* 14 and *Kobunshi Zairyo Shikenho* (compiled by Kobunshi Gakkai and Chijin Shokan) can be referred to.

The equilibrium water content at 25° C. and 60% RH of the binder polymer in the present invention is preferably 2% by mass or less, more preferably from 0.01% by mass to 1.5% by mass, and further preferably from 0.02% by mass to 1% by mass.

In the present invention, a polymer dispersible in the aqueous solvent is most preferable. Examples of the dispersed state include a latex in which fine particles of a water-insoluble hydrophobic polymer are dispersed, and a state in which polymer molecules are dispersed in a molecular state or by forming micelles. Both cases are preferable. The average particle diameter of the dispersed particles is preferably 1 nm to 50,000 nm, more preferably 5 nm to 1,000 nm. Particle size distribution of the dispersed particles is not particularly limited. A wide particle size distribution and a monodisperse particle size distribution are both usable.

In the present invention, preferable examples of the polymer dispersible in the aqueous solvent can include hydrophobic polymers such as acrylic polymers, polyesters, rubbers (for example, an SBR resin), polyurethanes, polyvinyl chlorides, polyvinyl acetates, polyvinylidene chlorides and polyolefins. These polymers may be linear polymers, branched polymers and crosslinked polymers. So-called homopolymers obtained by polymerizing single monomers and copolymers obtained by polymerizing two or more monomers are also usable. In the case of copolymers, random copolymers and block copolymers are usable. It is advisable that the molecular weight of these polymers is 5,000 to 1,000,000, preferably 10,000 to 200,000, in terms of number average molecular weight. When the number average molecular weight is 5,000 to 1,000,000, a satisfactory dynamic strength of an emulsion layer and good film formability can be obtained.

Preferable examples of a polymer latex are shown below. In the following list, the polymer latex is shown by starting monomers, the parenthesized value is % by mass, and the molecular weight is a number average molecular weight. In cases of using a polyfunctional monomer, the concept of molecular weight cannot be used because a crosslinked structure is formed. Thus, "crosslinked" is shown, and description of the molecular weight is omitted. Tg indicates a glass transition temperature.

P-1: MMA(70)-EA(27)-MAA(3) latex (molecular weight 37,000)

P-2: MMA(70)-2EHA(20)-St(5)-AA(5) latex (molecular weight 40,000)

P-3: St(50)-Bu(47)-MAA(3) latex (crosslinked)

P-4: St(68)-Bu(29)-AA(3) latex (crosslinked)

P-5: St(71)-Bu(26)-AA(3) latex (crosslinked, Tg 24° C.)

P-6: St(70)-Bu(27)-IA(3) latex (crosslinked)

P-7: St(75)-Bu(24)-AA(1) latex (crosslinked)

P-8: St(60)-Bu(35)-DVB(3)-MAA(2) latex (crosslinked)

P-9: St(70)-Bu(25)-DVB(2)-AA(3) latex (crosslinked)

P-10: VC(50)-MMA(20)-EA(20)-AN(5)-AA(5) latex (molecular weight 80,000)

P-11: VDC(85)-MMA(5)-EA(5)-MAA(5) latex (molecular weight 67,000)

P-12: Et(90)-MMA(10) latex (molecular weight 12,000)

P-13: St(70)-2EHA(27)-AA(3) latex (molecular weight 130,000)

P-14: MMA(63)-EA(35)-AA(2) latex (molecular weight 33,000)

P-15: St(70.5)-Bu(26.5)-AA(3) latex (crosslinked, Tg 23° C.)

P-16: St(69.5)-Bu(27.5)-AA(3) latex (crosslinked, Tg 20.5° C.)

The abbreviations in the above structures indicate the following monomers.

MMA: methyl methacrylate

EA: ethyl acrylate

MAA: methacrylic acid

2EHA: 2-ethylhexyl acrylate

St: styrene

Bu: butadiene

AA: acrylic acid

DVB: divinylbenzene

VC: vinyl chloride

AN: acrylonitrile

VDC: vinylidene chloride

Et: ethylene

IA: itaconic acid

The polymer latexes listed above are commercially usable, and the following polymers can be utilized. Examples of the acrylic polymers include SEVIAN A-4635, 4718 and 4601 (manufactured by Daicel Chemical Industries, Ltd.), and NIPOL Lx 811, 814, 821, 820 and 857 (manufactured by Nippon Zeon Co., Ltd.). Examples of the polyesters include FINETEX ES 650, 611, 675 and 850 (manufactured by Dainippon Ink And Chemicals, Inc.), and WD-size WMS (manufactured by Eastman Chemical). Examples of the polyurethanes include HYDRAN AP 10, 20, 30 and 40 (manufactured by Dainippon Ink And Chemicals, Inc.). Examples of the rubbers include LACSTAR 7310K, 3307B, 4700H and 7132C (manufactured by Dainippon Ink And Chemicals, Inc.), and NIPOL Lx 416, 410, 438C and 2507 (manufactured by Nippon Zeon Co., Ltd.). Examples of the polyvinyl chloride series include G350 and G576 (manufactured by Nippon Zeon Co., Ltd.). Examples of the polyvinylidene chloride series include L502 and L513 (manufactured by Asahi Chemical Industry Co., Ltd.). Examples of the polyolefins include CHEMIPEARL S120 and SA100 (manufactured by Mitsui Petrochemical Industries, Ltd.).

These polymer latexes may be used either singly or by blending two or more types as required.

As the polymer latex used in the present invention, a styrene-butadiene copolymer latex is especially preferable. The weight ratio of styrene monomer units and butadiene monomer units in the styrene-butadiene copolymer is preferably from 40:60 to 95:5. The ratio that the styrene monomer units and the butadiene monomer units occupy in the copolymer is preferably 60 to 99% by mass. The preferable range of molecular weight is the same as mentioned above.

As the styrene-butadiene copolymer latex used in the present invention, P-3 to P-8, P-14, P-15, and commercial products LACSTAR-3307B, LACSTAR-7132C and NIPOL Lx 416 are mentioned.

The organic silver salt-containing layer of the photosensitive material in the present invention may contain, as required, hydrophilic polymers such as gelatin, polyvinyl alcohol, methyl cellulose, hydroxypropyl cellulose and carboxymethyl cellulose. The amount of the hydrophilic polymers is preferably 30% by mass or less, more preferably 20% by mass or less, based on the total binder of the organic silver salt-containing layer.

The organic silver salt-containing layer (the imaging layer) of the present invention is preferably formed by using the polymer latex. For the amount of the binder in the organic silver salt-containing layer, a total binder/organic silver salt weight ratio is from 1/10 to 10/1, preferably 1/5 to 4/1.

This organic silver salt-containing layer is usually a photosensitive layer (emulsion layer) containing photosensitive silver halide as the photosensitive silver salt. In this case, the total binder/silver halide weight ratio is preferably 400 to 5, more preferably 200 to 10.

The total amount of the binder in the imaging layer of the present invention is preferably 0.2 to 30 g/m$^2$, more preferably 1 to 15 g/m$^2$. The imaging layer of the present invention may contain a crosslinking agent for crosslinking and a surfactant for improving coating property.

Other components contained in the thermal development photosensitive material of the present invention are described below.

A solvent (for simplicity, solvents and dispersion media are here referred to in common as "a solvent") of the organic silver salt-containing layer coating solution of the photosensitive material in the present invention may be an aqueous solvent containing 30% by mass or more of water. As a component other than water, any water-miscible organic solvent may be used, examples thereof being methyl alcohol, ethyl alcohol, isopropyl alcohol, methyl cellosolve, ethyl cellosolve, dimethylformamide and ethyl acetate. The water content of the solvent in the coating solution is preferably 50% by mass or more, more preferably 70% by mass or more. Examples of preferable solvent compositions include, other than just water, water/methyl alcohol=90/10, water/methyl alcohol=70/30, water/methyl alcohol/ dimethylformamide=80/15/5, water/methyl alcohol/ethyl cellosolve=85/10/5 and water/methyl alcohol/isopropyl alcohol=85/10/5 (numerical values are % by mass).

Examples of an antifogging agent, a stabilizer and a stabilizer precursor that can be used in the present invention include those described in JP-A No. 10-62899, paragraph [0070], European Patent Laid-Open No. 0803764A1, page 20, line 57 to page 21, line 7, and compounds described in JP-A Nos. 9-281637 and 9-329864. Antifogging agents preferably used in the present invention include organic halides, and compounds described in JP-A No. 11-65021, paragraphs [0111] and [0112], are mentioned. Especially, organic halogen compounds represented by formula (P) in Japanese Patent Application No. 11-87297, organic polyhalogen compounds represented by formula (II) in JP-A No. 10-339934, and organic polyhalogen compounds described in Japanese Patent Application No. 11-205330 are preferable.

The preferable organic polyhalogen compounds of the present invention are specifically described below. The preferable organic polyhalogen compounds of the present invention are compounds represented by formula (P).

$$Q—(Y)_n—C(Z_1)(Z_2)X \qquad \text{Formula (P)}$$

Q represents an alkyl group, an aryl group or a heterocyclic group. Y represents a divalent binding group. n represents 0 or 1. $Z_1$ and $Z_2$ each represents a halogen atom, and X represents a hydrogen atom or an electron-attractive group.

In formula (P), Q represents preferably a phenyl group substituted with an electron-attractive group of which a Hammett substituent constant $\sigma_p$ is a positive value. With respect to the Hammett substituent constant, *Journal of Medicinal Chemistry,* 1973, vol. 16, No. 11, pp. 1207 to 1216, and the like can be referred to. Examples of the electron-attractive group include halogen atoms (for example, a fluorine atom ($\sigma_p$: 0.06), a chlorine atom ($\sigma_p$: 0.23), a bromine atom ($\sigma_p$: 0.23) or an iodine atom ($\sigma_p$: 0.18)), a trihalomethyl group (tribromomethyl ($\sigma_p$: 0.29), trichloromethyl ($\sigma_p$: 0.33) or trifluoromethyl ($\sigma_p$: 0.54)), a cyano group ($\sigma_p$: 0.66), a nitro group ($\sigma_p$: 0.78), an aliphatic aryl or heterocyclic sulfonyl group (for example, methanesulfonyl ($\sigma_p$: 0.72)), an aliphatic aryl or heterocyclic acyl group (for example, acetyl ($\sigma_p$: 0.50) or benzoyl ($\sigma_p$: 0.43)), an alkinyl group (for example, C≡CH ($\sigma_p$: 0.23)), an aliphatic aryl or heterocyclic oxycarbonyl group (for example, methoxycarbonyl ($\sigma_p$: 0.45) or phenoxycarbonyl ($\sigma_p$: 0.44)), a carbamoyl group ($\sigma_p$: 0.36), a sulfamoyl group ($\sigma_p$: 0.57), a sulfoxide group, a heterocyclic group and a phosphoryl group. $\sigma_p$ is preferably 0.2 to 2.0, and more preferably 0.4 to 1.0. Especially preferable as the electron-attractive group are a carbamoyl group, an alkoxycarbonyl group, an alkylsulfonyl group and an alkyphosphoryl group. Of these, a carbamoyl group is most preferable.

X is preferably an electron-attractive group, more preferably a halogen atom, an aliphatic aryl or heterocyclic sulfonyl group, an aliphatic aryl or heterocyclic acyl group, an aliphatic aryl or heterocyclic oxycarbonyl group, a carbamoyl group, or a sulfamoyl group. A halogen atom is especially preferable. As the halogen atom, a chlorine atom, a bromine atom and an iodine atom are preferable. A chlorine atom and a bromine atom are further preferable. A bromine atom is especially preferable.

Y is preferably —C(=O)—, —SO— or —$SO_2$—. —C(=O)— and —$SO_2$— are more preferable, and —$SO_2$— is especially preferable. n represents 0 or 1, and 1 is preferable.

Specific examples of the compounds of formula (P) in the present invention are listed below.

(4-1)

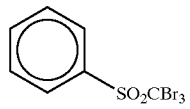

(4-2)

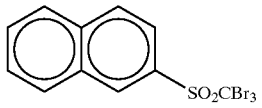

(4-3)

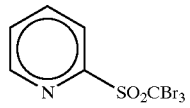

(4-4)

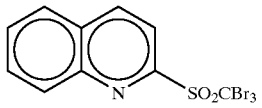

(4-5)

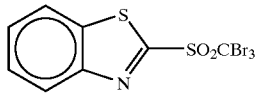

(4-6)

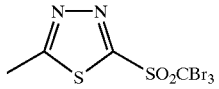

(4-7)

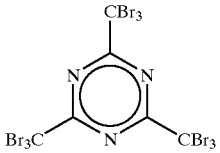

(4-8)

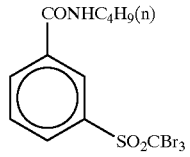

(4-9)

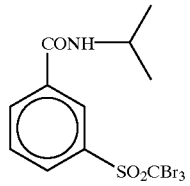

(4-10)

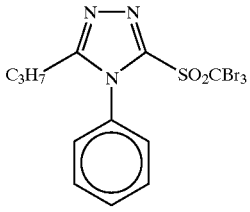

-continued (4-11)

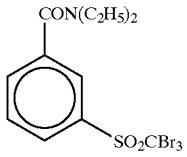

(4-12)

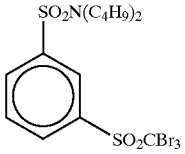

(4-13)

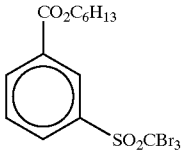

(4-14)

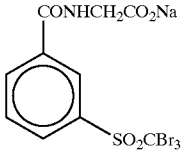

(4-15)

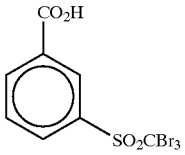

(4-16)

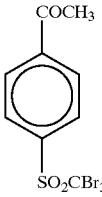

(4-17)

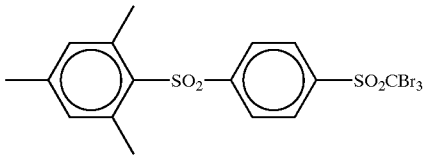

(4-18)

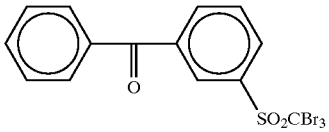

(4-19)

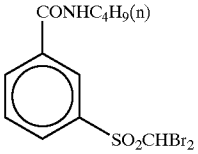

-continued (4-20)

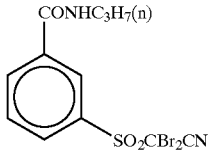

(4-21)

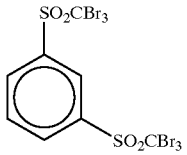

(4-22)

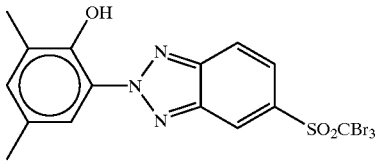

(4-23)

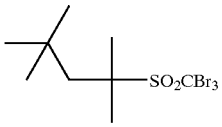

The compound represented by formula (P) in the present invention is used in an amount of preferably $10^{-4}$ to 1 mol, more preferably $10^{-3}$ to 0.8 mol, further preferably $5\times10^{-3}$ to 0.5 mol, per mol of the non-photosensitive silver salt of the imaging layer.

In the present invention, as a method of incorporating the antifogging agent in the photosensitive material, the method of incorporating the reducing agent described earlier can be mentioned.

Examples of the antifogging agent include mercury (II) salts in JP-A No. 11-65021, paragraph [0113], benzoic acids in the same document, paragraph [0114], salicylic acid derivatives in JP-A No. 2000-206642, formalin scavenger compounds represented by formula (S) in JP-A No. 2000-221634, triazine compounds in claim 9 of JP-A No. 11-352642, compounds represented by formula (III) in JP-A No. 6-11791 and 4-hydroxy-6-methyl-1,3,3a,7-tetrazaindene.

The thermal development photosensitive material of the present invention may contain an azolium salt for preventing fogging. Examples of the azolium salt include compounds of formula (XI) described in JP-A No. 59-193447, compounds described in Japanese Patent Publication No. 55-12581 and compounds of formula (II) described in JP-A No. 60-153039. The azolium salt may be added to any part of the photosensitive material. As a layer to which the azolium salt is added, it is preferable to add the azolium salt to a layer on a surface having the photosensitive layer. It is more preferable to add the azolium salt to the organic silver salt-containing layer. The addition of the azolium salt may be conducted at any step of preparing a coating solution. When the azolium salt is added to the organic silver salt-containing layer, addition may be conducted at any step from the preparation of the organic silver salt to the preparation of the coating solution. It is preferable to conduct the addition from after the preparation of the organic silver salt till just before coating. The azolium salt can be added in the form of a powder, a solution or a fine grain dispersion. Further, it may be added as a solution containing other additives, such as a sensitization coloring matter, a reducing agent and a color matching agent. In the present invention, the amount of the azolium salt is not particularly limited. It is preferably from $1\times10^{-6}$ mol to 2 mols, more preferably from $1\times10^{-3}$ mol to 0.5 mol, per mol of silver.

It is advisable that a color matching agent is added to the thermal development photosensitive material of the present invention. The color matching agent is described in JP-A No. 10-62899, paragraphs [0054] and [0055], European Patent Laid-Open No. 0803764A1, page 21, lines 23 to 48, JP-A No. 2000-356317 and Japanese Patent Application No. 2000-187298. Especially preferable are phthalazinones (phthalazinone and phthalazinone derivatives or metal salts such as 4-(1-naphthyl)phthalazinone, 6-chlorophthalazinone, 5,7-dimethoxyphthalazinone and 2,3-dihydro-1,4-phthalazinedione), combinations of phthalazinones and phthalic acids (such as phthalic acid, 4-methylphthalic acid, 4-nitrophthalic acid, diammonium phthalate, sodium phthalate, potassium phthalate and tetrachlorophthalic anhydride), phthalazines (phthalazine and phthalazine derivatives or metal salts such as 4-(1-naphthyl) phthalazine, 6-isopropylphthalazine, 6-t-butylphthalazine, 6-chlorophthalazine, 5,7-dimethoxyphthalazine and 2,3-dihydrophthalazine), and combinations of phthalazines and phthalic acids. Especially, combinations of phthalazines and phthalic acids are preferable.

A plasticizer and a lubricant that can be used in the photosensitive layer of the present invention are described in JP-A No. 11-65021, paragraph [0117]. As a superhigh contrast agent for superhigh contrast imaging, a method of adding the same and an amount, compounds of formula (H), compounds of formulas (1) to (3) and compounds of formulas (A) and (B) are described in JP-A No. 11-65021, paragraph [0118], JP-A No. 11-223898, paragraphs [0136] to [0193], and Japanese Patent Application No. 11-87297, respectively, and compounds of formulas (III) to (V) are described in Japanese Patent Application No. 11-91652 (specifically, compounds of formulas 21 to 24). A superhigh contrast accelerator is described in JP-A No. 11-65021, paragraph [0102], and JP-A No. 11-223898, paragraphs [0194] and [0195].

When formic acid or a formic acid salt is used as a strong blushing material, it is advisable to incorporate the same in the imaging layer containing the photosensitive silver halide in an amount of, preferably, 5 mmols or less, more preferably 1 mmol or less, per mol of silver.

When a superhigh contrast agent is used in the thermal development photosensitive material of the present invention, it is advisable to use an acid obtained by hydrating diphosphorus pentoxide or a combination of salts thereof. Examples of an acid obtained by hydrating diphosphorus pentoxide or salts thereof can include metaphosphoric acid (salt), pyrophosphoric acid (salt), orthophosphoric acid (salt), triphosphoric acid (salt), tetraphosphoric acid (salt) and hexametaphosphoric acid (salt). Especially preferable examples of the acid obtained by hydrating diphosphorus pentoxide or salts thereof can include orthophosphoric acid (salt) and hexametaphosphoric acid (salt). Specific examples of the salt include sodium orthophosphate, sodium dihydrogenorthophosphate, sodium hexametaphosphate and ammonium hexametaphosphate.

The amount of the acid obtained by hydrating diphosphorus pentoxide or its salt (coating amount for 1 $m^2$ of the photosensitive material) may be a desired amount according to properties such as sensitivity and fogging. It is preferably 0.1 to 500 $mg/m^2$, more preferably 0.5 to 100 $mg/m^2$.

In the thermal development photosensitive material of the present invention, a surface protecting layer can be formed for preventing adhesion of the imaging layer. The surface protecting layer may be a single layer or plural layers. The surface protecting layer is described in JP-A No. 11-65021, paragraphs [0119] and [0120], and Japanese Patent Application No. 2000-171936.

As a binder of the surface protecting layer in the present invention, gelatin is preferable. It is advisable that polyvinyl alcohol (PVA) is used alone or in combination. As the gelatin, inert gelatin (for example, Nitta Gelatin 750) and phthalic gelatin (for example, Nitta Gelatin 801) can be used. As PVA, those described in JP-A No. 2000-171936, paragraphs [0009] to [0020], are mentioned. Preferable examples thereof include completely saponified polyvinyl alcohol PVA-105, partially saponified polyvinyl alcohols PVA-205 and PVA-335 and modified polyvinyl alcohol MP-203 (manufactured by Kuraray Co., Ltd.). The coating amount (for 1 $m^2$ of a substrate) of polyvinyl alcohol of the protecting layer (for one layer) is preferably 0.3 to 4.0 $g/m^2$, more preferably 0.3 to 2.0 $g/m^2$.

When the thermal development photosensitive material of the present invention is used in printing that involves problems of dimensional variations, it is advisable to use a polymer latex in a surface protecting layer or a back layer. Such a polymer latex is described in "*Goseijushi Emarujon*" (compiled by Okuda H. and Inagaki H., published by Kobunshi Kankokai (1978)), "*Gosei Ratekkusu No Oyo*" (compiled by Sugimura H., Kataoka Y., Suzuki S. and Kasahara K., published by Kobunshi Kankokai (1993)), and "*Gosei Ratekkusu No Kagaku*" (compiled by Muroi S., published by Kobunshi Kankokai (1970)). Specific examples thereof include a methyl methacrylate (33.5% by mass)/ethyl acrylate (50% by mass)/methacrylic acid (16.5% by mass) copolymer latex, a methyl methacrylate (47.5% by mass)/butadiene (47.5% by mass)/itaconic acid (5% by mass) copolymer latex, an ethyl acrylate/methacrylic acid copolymer latex, a methyl methacrylate (58.9% by mass)/2-ethylhexyl acrylate (25.4% by mass)/styrene (8.6% by mass)/2-hydroxyethyl methacrylate (5.1% by mass)/acrylic acid (2.0% by mass) copolymer latex, and a methyl methacrylate (64.0% by mass)/styrene (9.0% by mass)/butyl acrylate (20.0% by mass)/2-hydroxyethyl methacrylate (5.0% by mass)/acrylic acid (2.0% by mass) copolymer latex. Further, as a binder for the surface protecting layer, a combination of polymer latexes in Japanese Patent Application No. 11-6872, a technique described in Japanese Patent Application No. 11-143058, paragraphs [0021] to [0025], a technique described in Japanese Patent Application No. 11-6872, paragraphs [0027] and [0028], and a technique described in Japanese Patent Application No. 10-199626, paragraphs [0023] to [0041], may be employed. The ratio of polymer latex in the surface protecting layer is preferably at least 10% by mass to 90% by mass, more preferably at least 20% by mass to 80% by mass based on the total binder.

The coating amount (for 1 $m^2$ of the substrate) of the total binder (comprising the water-soluble polymer and the latex polymer) based on the surface protecting layer (for one layer) is preferably 0.3 to 5.0 $g/m^2$, more preferably 0.3 to 2.0 $g/m^2$.

A temperature at which to prepare the imaging layer coating solution of the present invention is preferably from 30° C. to 65° C., more preferably from 35° C. to 60° C., further preferably from 35° C. to 55° C. Further, it is advisable that the temperature of the imaging layer coating solution just after the addition of the polymer latex is maintained at from 30° C. to 65° C.

An image-forming method using the thermal development photosensitive material of the present invention is described below.

As the imaging layer of the present invention, one or more layers are formed on the substrate. When the imaging layer is made of one layer, that layer comprises the organic silver salt, the photosensitive silver halide, the reducing agent for silver ions and the binder, and, as required, contains additives such as a color matching agent, a coating aid and other aids. When the imaging layer is made of two or more layers, it is required that a first imaging layer (usually a layer adjacent to the substrate) contains the organic silver salt and the photosensitive silver halide and a second imaging layer, or both layers, contains other components. A multicolor photosensitive thermal development photographic material may include a combination of two such layers for each color, or all components may be contained in a single layer as described in U.S. Pat. No. 4,708,928. In the case of a multi-dye, multicolor photosensitive thermal development photographic material, emulsion layers are generally arranged separately from each other by functional or non-functional barrier layers between photosensitive layers, as described in U.S. Pat. No. 4,460,681.

In the photosensitive layer of the present invention, various dyes or pigments (for example, C. I. Pigment Blue 60, C. I. Pigment Blue 64 and C. I. Pigment Blue 15:6) can be used in view of tone improvement, prevention of occurrence of interference fringes in laser exposure and prevention of irradiation. These are described in detail in WO 98/36322 and JP-A Nos. 10-268465 and 11-338098.

In the thermal development photosensitive material of the present invention, an antihalation layer can be formed on the photosensitive layer at the side thereof to be further from a light source.

The thermal development photosensitive material generally has a non-photosensitive layer in addition to the photosensitive layer. Non-photosensitive layers can be classified by location into (1) a protecting layer formed on the photosensitive layer (remote from the substrate), (2) an intermediate layer formed between plural photosensitive layers or between the photosensitive layer and the protecting layer, (3) an undercoat layer formed between the photosensitive layer and the substrate and (4) a back layer formed at a side of the substrate opposite to the photosensitive layer. A filter layer is formed on the photosensitive layer as a layer (1) or (2). An antihalation layer is formed on the photosensitive material as a layer of type (3) or (4).

The antihalation layer is described in JP-A No. 11-65021, paragraphs [0123] and [0124], and JP-A Nos. 11-223898, 9-230531, 10-36695, 10-104779, 11-231457, 11-352625 and 11-352626.

The antihalation layer contains an antihalation dye having absorption at an exposure wavelength. When the exposure wavelength is in the infrared region, an infrared absorption dye may be used, and a dye having absorption in the visible region is preferable.

When halation is prevented by using a dye having absorption in the visible region, it is preferable that color of the dye substantially does not remain after imaging, and that a method of erasing the color with heat in the thermal development is used. It is especially preferable that a non-photosensitive layer functions as an antihalation layer by adding thereto a heat-erasable dye and a basic precursor. These techniques are described in JP-A No. 11-231457.

The amount of the erasable dye is determined depending on usage of the dye. Generally, the dye is used in such an amount that optical density (absorbance) when measured at the intended wavelength exceeds 0.1. The optical density is preferably 0.2 to 2. An amount of the dye for obtaining such an optical density is generally 0.001 to 1 g/m$^2$.

When the dye is erased in this manner, the optical density after thermal development can be decreased to 0.1 or less. Two or more erasable dyes may be used in combination in a heat-erasable recording medium or a thermal development photosensitive material. Likewise, two or more of the basic precursors may be used in combination.

In the heat-erasing with the erasable dye and the basic precursor, it is advisable, in view of heat erasability, to use a material which decreases a melting point by more than 3° C. in combination with the basic precursor, as described in JP-A No. 11-352626 (for example, diphenylsulfone and 4-chlorophenyl(phenyl)sulfone).

In the present invention, a colorant having maximum absorption at 300 to 450 nm can be added to improve silver tone and change of an image with time. Such a colorant is described in JP-A Nos. 62-210458, 63-104046, 63-103235, 63-208846, 63-306436, 63-314535, 1-61745 and 11-276751.

This colorant is usually added in an amount of 0.1 mg/m$^2$ to 1 g/m$^2$. A layer to which the colorant is added is preferably the back layer formed opposite the photosensitive layer.

The thermal development photosensitive material in the present invention is preferably a single-sided photosensitive material having a photosensitive layer containing the at least one silver halide emulsion layer on one side of the substrate and the back layer on another side thereof.

In the present invention, it is advisable to add a matt agent for improving a transportability. The matt agent is described in JP-A No. 11-65021, paragraphs [0126] and [0127]. An amount of the matt agent is preferably 1 to 400 mg/m$^2$, more preferably 5 to 300 mg/m$^2$, in terms of a coating amount for 1 m$^2$ of the photosensitive material.

Any matt degree of the emulsion surface providing "stardust" flaws do not occur. Bekk smoothness is preferably from 30 seconds to 2,000 seconds, more preferably from 40 seconds to 1,500 seconds. The Bekk smoothness can easily be measured as in JIS P 8119, "Smoothness Test Method of Paper and Board with a Bekk Tester" and TAPPI Standard Method T479.

In the present invention, for matt degree of the back layer, the Bekk smoothness is preferably at most 1,200 seconds and at least 10 seconds, more preferably at most 800 seconds and at least 20 seconds, and further preferably at most 500 seconds and at least 40 seconds.

In the present invention, it is advisable that the matt agent is incorporated in an outermost surface layer or a layer that functions as an outermost surface layer of the photosensitive material, or in a layer close to the outermost surface, or in a layer that functions as a protecting layer.

A back layer that can be used in the present invention is described in JP-A No. 11-65021, paragraphs [0128] to [0130].

In the thermal development photosensitive material of the present invention, the pH of the film surface before thermal development is preferably 7.0 or less, more preferably 6.6 or less. Although a lower limit is not particularly specified, it is approximately 3. The most preferable pH range is 4 to 6.2. It is advisable, in view of decreasing the pH of the film surface, that the pH of the film surface is adjusted with organic acids such as phthalic acid derivatives, non-volatile acids such as sulfuric acid, or volatile bases such as ammonia. Especially, ammonia is preferable for attaining a low pH of the film surface because it is easily volatilized and can be removed before the coating step or thermal development. Further, a combination with a non-volatile base such as sodium hydroxide, potassium hydroxide or lithium hydroxide and ammonia is preferably used. A method of measuring pH of a film surface is described in Japanese Patent Application No. 11-87297, paragraph [0123].

A hardening agent may be used in the photosensitive layer, the protecting layer and the back layer of the present invention. Examples of the hardening agent are described in T. H. James, "The Theory Of The Photographic Process, Fourth Edition" (Macmillan Publishing Co., Inc., 1977), pp. 77–87. Preferable examples thereof include chrome alum, 2,4-dichloro-6-hydroxy-s-triazine sodium salt, N,N-ethylenebis(vinylsulfonacetamide), N,N-propylenebis (vinylsulfonacetamide), polyvalent metallic ions as shown on page 78 of the above document, polyisocyanates described in U.S. Pat. No. 4,281,060 and JP-A No. 6-208193, epoxy compounds described in U.S. Pat. No. 4,791,042 and vinylsulfone compounds described in JP-A No. 62-89048.

The hardening agent is added as a solution, and a time for adding the solution into a protecting layer coating solution is from 180 minutes before coating till just before coating, preferably from 60 minutes to 10 seconds before coating. A mixing method and mixing conditions are not particularly limited so long as the effects of the present invention are satisfactorily brought forth. Specific examples of the mixing method include a method using a tank in which an average retention time, calculated from an addition feed rate and an amount of a solution fed to a coater, becomes a desired time, and a method using a static mixer as described in chapter 8 of "Liquid Mixing Technology", N. Harnby, M. F. Edwards and A. W. Nienow, translated by Takahashi K. (Nikkan Kogyo Shinbunsha, 1989).

A surfactant which can be used in the present invention is described in JP-A No. 11-65021, paragraph [0132], a solvent in the same document, paragraph [0133], a substrate in the same document, paragraph [0134], an antistatic or conductive layer in the same document, paragraph [0135], a method of obtaining a color image in the same document, paragraph [0136], and a lubricant in JP-A No. 11-84573, paragraphs [0061] to [0064], and Japanese Patent Application No. 11-106881, paragraphs [0049] to [0062].

In a transparent substrate, a polyester, especially polyethylene terephthalate, which is heat-treated at a temperature of 130° C. to 185° C. is preferably used for relaxing internal strain remaining in the film in biaxial stretching and eliminating heat shrinkage strain generated during the thermal development. In the case of a thermal development photosensitive material for medical use, the transparent substrate may be colored with a blue dye (for example, dye-1 described in the Examples of JP-A No. 8-240877) or may be colorless. It is advisable that an undercoating technique of a water-soluble polyester in JP-A No. 11-84574, a styrene-butadiene copolymer in JP-A No. 10-186565 and a vinylidene chloride copolymer in JP-A No. 2000-39684 and Japanese Patent Application No. 11-106881, paragraphs [0063] to [0080], are applied to the substrate. Further, for an antistatic layer or undercoating, a technique described in JP-A Nos. 56-143430, 56-143431, 58-62646, 56-120519 and 11-84573, paragraphs [0040] to [0051], U.S. Pat. No. 5,575,957 and JP-A No. 11-223898, paragraphs [0078] to [0084], can be applied.

The thermal development photosensitive material is preferably of a mono-sheet type (a type with which an image can be formed on the thermal development photosensitive material without using another sheet, such as an image-receiving material).

The thermal development photosensitive material may further contain an antioxidant, a stabilizer, a plasticizer, an ultraviolet absorber and a coating aid. These additives are added to either the photosensitive layer or the non-photosensitive layer. With respect to these additives, WO 98/36322, EP 803764A1 and JP-A Nos. 10-186567 and 10-18568 can be referred to.

The thermal development photosensitive material in the present invention may be coated by any method. Specific examples of coating methods include various coating methods such as extrusion coating, slide coating, curtain coating, dip coating, knife coating, flow coating and extrusion coating with a hopper as described in U.S. Pat. No. 2,681,294. Extrusion coating or slide coating as described by Stephen F. Kistler and Peter M. Schweizer, "Liquid Film Coating", Chapman & Hall, 1997, pp. 399–536 is preferable. Slide coating is especially preferable. An example of the form of a slide coater used in the slide coating is shown in FIG. 11*b*.1 on page 427 of the same document. Further, it is also possible, if required, to coat two or more layers at the same time by the method described in the same document, pages 399 to 536, U.S. Pat. No. 2,761,791 and British Patent No. 837,095.

The organic silver salt-containing layer coating solution in the present invention is preferably a so-called thixotropic fluid. With regard thereto, JP-A No. 11-52509 can be referred to. For the organic silver salt-containing layer coating solution in the present invention, viscosity at a shear rate of 0.1 $s^{-1}$ is preferably from 400 mPa.s to 100,000 mPa.s, more preferably from 500 mPa.s to 20,000 mPa.s. Further, viscosity at a shear rate of 1,000 $s^{-1}$ is preferably from 1 mPa.s to 200 mPa.s, more preferably from 5 mPa.s to 80 mPa.s.

Technology that can be used for the thermal development photosensitive material of the present invention is described in EP 803764A1, EP 883022A1, WO 98/36322 and JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064 and 2000-171936.

The thermal development photosensitive material of the present invention may be developed by any method. Usually, the thermal development photosensitive material is exposed imagewise and developed by heating. A developing temperature is preferably 80 to 250° C., and more preferably 100° C. to 140° C. A developing time is preferably 1 to 60 seconds, more preferably 3 to 30 seconds, especially preferably 5 to 20 seconds, and most preferably 10 to 15 seconds.

A thermal development system is preferably a plate heater system. As the thermal development system with a plate heater, a system described in JP-A No. 11-133572 is preferable. This is a thermal development apparatus in which a visible image is obtained by contacting the thermal development photosensitive material having a latent image formed thereon with a heating unit through a thermal development section. The heating unit comprises the plate heater and plural pressing rollers mounted opposite to one surface of the plate heater, and the thermal development photosensitive material is passed between the pressing rollers and the plate heater to conduct the thermal development. It is advisable that the plate heater is divided into 2 to 6 stages and a temperature of a distal portion is decreased by 1 to 10° C. Such a method is described in JP-A No. 54-30032, can remove moisture or an organic solvent contained in the thermal development photosensitive material to outside the system, and can control a change in the shape of the substrate of the thermal development photosensitive material that is caused by abrupt heating of the thermal development photosensitive material.

The photosensitive material of the present invention may be exposed by any method. A laser having an exposure wavelength of 750 nm to 1,400 nm is preferable as an exposure light source. Preferable examples of the laser in the present invention include a gas laser, a YAG laser, a dye laser and a semiconductor laser. Further, a semiconductor laser and a second harmonic-generating element can also be used. Especially preferable is an infrared emission semiconductor laser.

The thermal development photosensitive material of the present invention forms a monochromic image by a silver image, and can be preferably used as a thermal development photosensitive material for medical diagnostics, industrial photography, printing or COM.

EXAMPLES

The present invention is now illustrated specifically by referring to Examples. However, the present invention is not limited thereto.

Example 1

Production of a PET Substrate

PET having an intrinsic viscosity (IV) of 0.66 (measured at 25° C. in phenol/tetrachloroethane=6/7 (weight ratio)) was obtained in a usual manner using terephthalic acid and ethylene glycol. This was pelletized, then dried at 130° C. for 4 hours, melted at 300° C., extruded from a T-die, and quenched to form an unoriented film having such a thickness that a film thickness after heat-setting reached 175 μm.

This film was longitudinally stretched to 3.3 times with rolls different in circumferential speeds, and then transversely stretched to 4.5 times with a tenter. At these times, respective temperatures were 110° C. and 130° C. Subsequently, the film was heat-set at 240° C. for 20 seconds, and then transversely relaxed by 4% at the same temperature. Thereafter, a chuck portion of the tenter was slit, and both ends were subjected to knurl processing. The product was taken up at a rate of 4 kg/cm$^2$ ($4\times10^4$ Pa) to obtain a roll having a thickness of 175 μm.

Both surfaces of this substrate were processed at a rate of 20 m/min under room temperature using a solid state corona processing machine (6KVA model manufactured by Pillar). From values of current and voltage read at this time, it was found that the substrate was processed at 0.375 kV.A.min/m$^2$. At this time, processing frequency was 9.6 kHz, and a gap clearance between an electrode and a dielectric roll was 1.6 mm.

Preparation of a Photosensitive Silver Halide Emulsion

Phthalic gelatin (22 g) and 30 mg of potassium bromide were dissolved in 700 ml of distilled water, and pH was adjusted to 5.0 while maintaining the liquid temperature at 35° C. Then, 18.6 g of silver nitrate and 0.9 g of ammonium nitrate were added to adjust the volume to 159 ml and thereby form an aqueous solution A. To the aqueous solution A was added an aqueous solution B, containing potassium bromide and potassium iodide in a molar ratio of 92:8, by a control double jet method over a period of 10 minutes, while maintaining pAg at 7.7, to form an aqueous solution C.

Subsequently, to the aqueous solution C were added 476 ml of an aqueous solution D, containing 55.4 g of silver nitrate and 2 g of ammonium nitrate, and an aqueous solution E, containing 10 μmol/liter of dipotassium hexachloroiridate and 1 mol/liter of potassium bromide, by a control double jet method over a period of 30 minutes while maintaining pAg at 7.7. Then, 1 g of 4-hydroxy-6-methyl-1,3,3a,7-tetrazaindene was added, and pH was further decreased to conduct agglomeration and precipitation, and a desalting treatment.

Thereafter, 0.1 g of phenoxyethanol was added, and pH was adjusted to 5.9 and pAg to 8.2 to complete preparation of silver iodobromide grains (cubic grains, iodine content: core 8 mol %; average 2 mol %, average size 0.05 μm, shadow area fluctuation coefficient 8%, (100) surface ratio 88%).

The thus-obtained silver halide grains were heated at 60° C., and, per mol of silver, 85 μmols of sodium thiophosphate, 11 μmols of 2,3,4,5,6-pentafluorophenyldiphenylphosphine selenide, 15 μmols of a tellurium compound A shown later, 3.4 μm of chloroauric acid and 200 μmols of thiocyanic acid were added. The mixture was aged for 120 minutes, and then quenched at 30° C. to obtain a silver halide emulsion.

Preparation of an Organic Silver Salt Emulsion

While 7 g of stearic acid, 4 g of arachidic acid, 36 g of behenic acid and 850 ml of distilled water were vigorously stirred, 187 ml of a 1N-NaOH aqueous solution was added, and a reaction was conducted for 60 minutes. Thereafter, 65 ml of 1N-nitric acid was added, and temperature was then decreased to 50° C. (aqueous solution F).

Subsequently, while the aqueous solution F was vigorously stirred, 0.6 g of N-bromosuccinimide was added. After 10 minutes, the above-formed silver halide emulsion was added such that an amount of the silver halide reached 6.2 mmols (aqueous solution G).

Further, 125 ml of an aqueous solution containing 21 g of silver nitrate was added to the solution G over a period of 100 seconds. The mixture was continuously stirred for 10 minutes in this state, and 0.6 g of N-bromosuccinimide was added thereto. The resulting mixture was further allowed to stand for 10 minutes. Then, solid matter was separated by suction filtration, and washed with water until conductivity of this filtrate reached 30 μS/cm.

To the thus-obtained solid matter was added 150 g of a butyl acetate solution containing 0.6% by weight of polyvinyl acetate, and this mixture was stirred. Then stirring was stopped and the resulting material was allowed to stand to separate an oil layer from an aqueous layer. The aqueous layer was removed along with contained salt to obtain the oil layer.

Subsequently, to this oil layer was added 80 g of a 2-butanone solution containing 2.5% by weight of polyvinyl butyral (DENKA BUTYRAL #3000-K manufactured by Electro Chemical Industrial Co., Ltd.), and the mixture was stirred. Further, 0.1 mmol of pyridinium perbromide and 0.1 mmol of calcium bromide dihydrate were added along with 0.7 g of methanol, 200 g of 2-butanone and 59 g of polyvinyl butyral (BUTVAR™ B-76 manufactured by Monsanto)

were further added. These were dispersed with a homogenizer to obtain an organic acid silver salt emulsion (acicular grains having an average short diameter of 0.04 μm, an average long diameter of 1 μm and a fluctuation coefficient of 30%).

Preparation of an Emulsion Layer Coating Solution

To the above-obtained organic acid silver emulsion were added the following chemicals in the following amounts per mol of silver at 25° C. with stirring, to obtain an emulsion layer coating solution.

Ten milligrams of sodium phenylthiosulfonate, 80 mg of a coloring matter A shown later, a hetero-aromatic mercapto compound (type and amount are shown in Table 1), a compound of formula (II) of the present invention (type and amount are shown in Table 1), 12 g of 4-chlorobenzophenone-2-carboxylic acid, 10 g of monobutyl phthalate, 580 g of 2-butanone and 220 g of dimethylformamide were added to the emulsion with stirring. Subsequently, 3 g of 5-tribromomethylsulfonyl-2-methylthiadiazole, 3 g of tribromomethylnaphthylsulfone, 6 g of tribromomethylphenylsulfone, 5 g of 4,6-dichloromethyl-2-phenyltriazine, a compound of formula (I) of the present invention (type and amount are shown in Table 1), 12 g of a dye A shown later, 1.1 g of a fluorine-based surfactant (MEGAFAC F-176P manufactured by Dainippon Ink And Chemicals, Inc.), 590 g of methyl ethyl ketone (MEK) and 10 g of methyl isobutyl ketone (MIBK) were also added.

Preparation of an emulsion surface protecting layer coating solution

A solution was prepared by dissolving 75 g of cellulose acetate butyrate (CAB 171-15S manufactured by Eastman Chemical K.K.), 5.7 g of 4-methylphthalic acid, 1.5 g of tetrachlorophthalic anhydride, 12.5 g of phthalazine, 5.1 g of tetrachlorophthalic acid, 0.3 g of MEGAFAC F-176P, 2 g of spherical silica (SILDEX H31 manufactured by Dokai Kagaku, average size 3 μm) and 7 g of polyisocyanate (SUMIDUR N3500 manufactured by Sumitomo Bayer Urethane) in 3,070 g of MEK and 30 g of ethyl acetate.

Coating for a Back Surface

Six grams of polyvinyl butyral (DENKA BUTYRAL #4000-2 manufactured by Electro Chemical Industrial Co., Ltd.), 0.2 g of spherical silica (SILDEX H121 manufactured by Dokai Kagaku, average size 12 μm), 0.2 g of spherical silica (SILDEX H51 manufactured by Dokai Kagaku, average size 5 μm) and 0.1 g of MEGAFAC F-176P were dissolved in 64 g of 2-propanol with stirring for mixing. Further, a solution of 420 mg of the dye A in 10 g of methanol and 20 g of acetone, and a solution of 1 g of 3-isocyanatomethyl-3,5,5-trimethylhexyl isocyanate in 7 g of ethyl acetate were added to prepare a coating solution.

This back surface coating solution was coated on the polyethylene terephthalate film, of which both surfaces were formed with a moistureproof undercoat containing vinylidene chloride to an optical density of 0.4 at 810 nm. Further, smoothness of the back surface (Bekk smoothness, measured by an Ohken type smoothness measurement instrument) was 80 seconds.

Preparation of a Photosensitive Material

The emulsion layer coating solution was coated as an emulsion layer on the above-obtained polyethylene terephthalate substrate having a thickness of 175 μm and having the back surface already coated, such that silver reached 2.3 g/m$^2$. Further, the emulsion surface protecting layer coating solution was further coated on this emulsion layer's surface as an emulsion surface protecting layer with a dry thickness of 2 μm. Thereafter, the product was dried for 10 minutes with a drying wind having a drying temperature of 75° C. and a dew-point temperature of 10° C.

Further, a solvent residual amount of the emulsion layer coating surface in the coating sample was measured by gas chromatography in the following manner.

The photosensitive material was cut to a film area of 46.3 cm$^2$, and chopped to pieces of approximately 5 mm. The chopped pieces were stored in a dedicated vial, sealed with a septum and an aluminium cap, and set in a gas chromatograph ((GC)5971 HEAD SPACE SAMPLER HP7694 manufactured by Hewlett Packard). In this GC, a flame ionization detector (FID) was used as a detector, and a DB-624, manufactured by J & W, as a column. As main measurement conditions, heating conditions of the head space sampler were 120° C. and 20 minutes, and GC introduction temperature was 150° C. The temperature was raised from 45° C. to 100° C. at a rate of 8° C./min for 3 minutes. A calibration curve was prepared using a peak area of the chromatograph obtained by storing a fixed amount of a butanol dilute solution of each solvent in the dedicated vial and then conducting the foregoing measurement.

The results of the measurement were 40 to 200 ppm of MEK, 10 to 100 ppm of MIBK and 40 to 120 ppm of butyl acetate based on the weight of the coating product.

Structural formulas of compounds used in the preparation of the thermal development photosensitive material of Example 1 are shown below.

1.Tellurium compound A

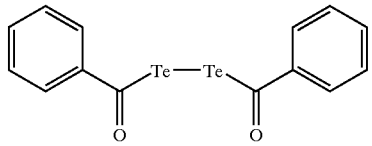

2. Coloring matter A

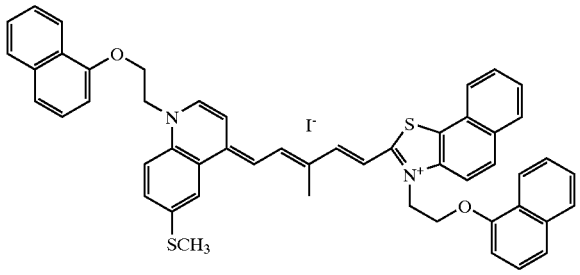

3. Dye A

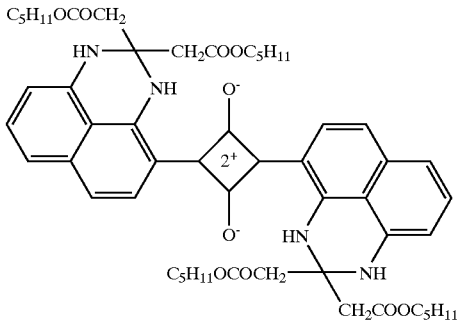

Evaluation of Photographic Performance

After the photographic material was exposed to a laser sensitometer fitted with an 810 nm diode, the photographic material was processed (developed) at 120° C. for 15 seconds, and a resulting image was evaluated with a densitometer. Sensitivity was evaluated from the reciprocal of a ratio of an exposure amount so as to give a density higher than a Dmin by 1.0, and expressed as a relative value, rating sensitivity of a Sample No. 1 of Table 1 as 100. The larger the value, the higher the sensitivity. From a practical point of view, the sensitivity should be 95 to 105. A room for exposure and development was at 23° C., 50% RH.

Evaluation of Image Tone

The tone of the image formed was visually evaluated. The most preferable tone was a pure black tone, and this was rated as 0. A strongest magenta tone was rated as −3. As the magenta tone was approached from the pure black tone, tones were rated as −1, −2 or −3. On the other hand, a strongest yellow tone was rated as +3. As the yellow tone was approached from the pure black tone, tones were rated as +1, +2 and +3. From a practical standpoint, the tone should be in the range of −1, 0, +1.

-continued

Mercapto-1

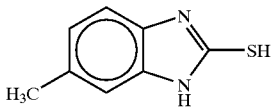

Mercapto-2

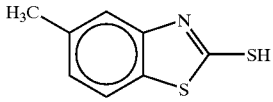

Mercapto-3

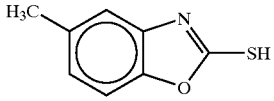

The results in Table 1 reveal that in the Examples of the present invention, in the evaluation of photographic performance, the sensitivity was in the range of 95 to 105, which is deemed preferable from a practical standpoint, and the image tone was evaluated to be in the range of −1, 0, +1, which is also deemed preferable from the practical standpoint.

Meanwhile, in Comparative Examples, it was shown that either the evaluated photographic performance or the evaluated image tone deviated from the above ranges deemed preferable from the practical standpoint.

TABLE 1

| Sample No. | Compound of formula (I) = α Type | Compound of formula (I) = α Amount (mol/mol-Ag) | Compound of formula (II) or (III) = B Type | Compound of formula (II) or (III) = B Amount (mol/mol-Ag) | Molar ratio B/α | Hetero-aromatic mercapto compound Type | Hetero-aromatic mercapto compound Amount (mol/mol-Ag) | Fresh properties Fogging | Fresh properties Sensitivity | Tone | Remarks |
|---|---|---|---|---|---|---|---|---|---|---|---|
| 1 | 1-1 | $4 \times 10^{-1}$ | 2-3 | $8 \times 10^{-3}$ | 0.02 | Mercapto-1 | $1 \times 10^{-2}$ | 0.15 | 100 | 0 | Inv |
| 2 | 1-1 | $4 \times 10^{-1}$ | — | — | — | Mercapto-1 | $1 \times 10^{-2}$ | 0.15 | 97 | −2 | CE |
| 3 | 1-1 | $4 \times 10^{-1}$ | 2-3 | $1.6 \times 10^{-2}$ | 0.04 | Mercapto-1 | $1 \times 10^{-2}$ | 0.15 | 103 | +1 | Inv |
| 4 | 1-1 | $4 \times 10^{-1}$ | — | — | — | — | — | 0.15 | 85 | 0 | CE |
| 4 | 1-1 | $4 \times 10^{-1}$ | 2-3 | $8 \times 10^{-3}$ | 0.02 | — | — | 0.15 | 95 | +1 | Inv |
| 5 | 1-1 | $4 \times 10^{-1}$ | 2-3 | $8 \times 10^{-3}$ | 0.02 | Mercapto-1 | $3 \times 10^{-2}$ | 0.15 | 103 | −1 | Inv |
| 6 | 1-1 | $4 \times 10^{-1}$ | 2-3 | $1.6 \times 10^{-2}$ | 0.04 | Mercapto-1 | $3 \times 10^{-2}$ | 0.15 | 105 | 0 | Inv |
| 7 | 1-1 | $4 \times 10^{-1}$ | 2-35 | $3.2 \times 10^{-2}$ | 0.08 | Mercapto-1 | $1 \times 10^{-2}$ | 0.15 | 101 | 0 | Inv |
| 8 | 1-1 | $4 \times 10^{-1}$ | 2-35 | $6.4 \times 10^{-2}$ | 0.16 | Mercapto-1 | $1 \times 10^{-2}$ | 0.15 | 103 | +1 | Inv |
| 9 | 1-1 | $4 \times 10^{-1}$ | 2-35 | $1 \times 10^{-1}$ | 0.25 | Mercapto-1 | $1 \times 10^{-2}$ | 0.15 | 107 | +2 | CE |
| 10 | Reducing agent complex A | $2.6 \times 10^{-1}$ | 2-3 | $8 \times 10^{-2}$ | 0.03 | Mercapto-1 | $1 \times 10^{-2}$ | 0.15 | 100 | 0 | Inv |
| 11 | 1-3 | $3 \times 10^{-1}$ | 2-3 | $8 \times 10^{-3}$ | 0.027 | Mercapto-1 | $1 \times 10^{-2}$ | 0.15 | 103 | 0 | Inv |
| 12 | 1-3 | $3 \times 10^{-1}$ | — | — | — | Mercapto-1 | $1 \times 10^{-2}$ | 0.15 | 97 | −2 | CE |
| 13 | 1-3 | $3 \times 10^{-1}$ | 2-3 | $8 \times 10^{-3}$ | 0.027 | — | — | 0.15 | 95 | +1 | Inv |
| 13 | 1-3 | $3 \times 10^{-1}$ | — | — | — | — | — | 0.15 | 87 | 0 | CE |
| 14 | 1-3 | $3 \times 10^{-1}$ | 2-35 | $3.2 \times 10^{-2}$ | 0.011 | Mercapto-1 | $1 \times 10^{-2}$ | 0.15 | 101 | 0 | Inv |
| 15 | 1-3 | $3 \times 10^{-1}$ | 2-36 | $3.2 \times 10^{-2}$ | 0.011 | Mercapto-1 | $1 \times 10^{-2}$ | 0.15 | 103 | 0 | Inv |
| 16 | 1-3 | $3 \times 10^{-1}$ | 2-37 | $3.2 \times 10^{-2}$ | 0.011 | Mercapto-1 | $1 \times 10^{-2}$ | 0.15 | 100 | 0 | Inv |
| 17 | 1-3 | $3 \times 10^{-1}$ | 2-3 | $8 \times 10^{-3}$ | 0.027 | Mercapto-2 | $1 \times 10^{-2}$ | 0.15 | 101 | 0 | Inv |
| 18 | 1-3 | $3 \times 10^{-1}$ | 2-3 | $8 \times 10^{-3}$ | 0.027 | Mercapto-3 | $1 \times 10^{-2}$ | 0.15 | 99 | 0 | Inv |

(Note) Mol/mol-Ag is molar amount of a material per mol of coating silver (sum of silver halide silver and organic acid silver) in the photosensitive material Structural formulas of compounds used in Example 1 are shown below.

Reducing agent complex A

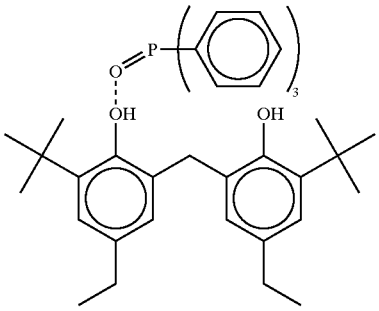

Example 2

Production of a Substrate

A substrate was produced in the same manner as in Example 1 except that both surfaces of a PET film with a thickness of 175 μm which was colored blue to a density of 0.170 (measured with a densitometer (PDA-65 manufactured by Konica)) were subjected to corona discharge at 8 $W/m^2$.min.

Preparation of a Photosensitive silver Halide Emulsion

Phenylcarbamoyl gelatin (88.3 g), 10 ml of a 10% methanol aqueous solution of a PAO compound ($HO(CH_2CH_2O)_n(CH(CH_3)CH_2O)_{17}(CH_2CH_2O)_mH$; m+n=5 to 7) and 0.32 g of potassium bromide were dissolved in 5,429 ml of distilled water to form an aqueous solution A.

Further, 0.703 mol/liter of potassium bromide and 0.013 mol/liter of potassium iodide were dissolved in 659 ml of an aqueous solution containing 0.67 mol/liter of silver nitrate to form an aqueous solution B. Subsequently, while the aqueous solution A was maintained at 45° C. and the aqueous solution B was adjusted to a pAg of 8.09, these aqueous solutions were mixed by a simultaneous mixing method using a mixing stirrer described in Japanese Patent Publication Nos. 58-58288 and 58-58289, over a period of 4 minutes 45 seconds, to form an aqueous solution C.

One minute later, 20 ml of a 0.63 N potassium hydroxide solution was added to the aqueous solution C. After a further 6 minutes had passed, 1,976 ml of an aqueous solution containing 0.67 mol/liter of silver nitrate and a solution containing 0.657 mol/liter of KBr, 0.013 mol/liter of potassium iodide and 30 μmol/liter of dipotassium hexachloroiridate was added to the aqueous solution C by a simultaneous mixing method over a period of 14 minutes 15 seconds while controlling the temperature to 45° C. and pAg to 8.09 to form an aqueous solution D. The aqueous solution D was stirred for 5 minutes, and the temperature was then decreased to 40° C.

The pH of the aqueous solution D was decreased by adding thereto 18 ml of a 56% acetic acid aqueous solution to conduct agglomeration and precipitation, and a desalting treatment. Thus, silver iodobromide grains were obtained.

Subsequently, a supernatant was removed by removing 2 liters of precipitate, and 10 liters of water was added to the solution. After this mixture was stirred, the silver iodohalide grains were re-precipitated. Further, a supernatant was removed by removing 1.5 liters of precipitate. Again, 10 liters of water was added. After the mixture was stirred, the silver halide grains were re-precipitated. A supernatant was removed by removing 1.5 liters of precipitate, a solution of 1.72 g of anhydrous sodium carbonate in 151 ml of water was added, and the temperature was raised to 60° C. In addition, the mixture was stirred for 120 minutes. Finally, the pH was adjusted to 5.0, and water was added such that the amount reached 1,161 g per mol of silver, to obtain silver halide grains.

Preparation of an Organic Silver Salt Powder

Behenic acid (130.8 g), 67.7 g of arachidic acid, 43.6 g of stearic acid and 2.3 g of palmitic acid were added to 4,720 ml of distilled water, and the mixture was vigorously stirred at 80° C. Then, 540.2 ml of a 1.5 N sodium hydroxide aqueous solution and 6.9 ml of conc. nitric acid were added. The mixture was then cooled to 55° C. to obtain an organic acid sodium salt solution. While the temperature of the organic acid sodium salt solution was maintained at 55° C., 45.3 g of the foregoing silver halide emulsion and 450 ml of pure water were added, and the mixture was stirred for 5 minutes using a homogenizer (ULTRA-TURRAXT-25 manufactured by IKA JAPAN) at 13,200 rpm (21.1 KHz as a mechanical vibration frequency). Subsequently, 702.6 ml of a solution containing 1 mol/liter of silver nitrate was added over a period of 2 minutes, and this mixture was stirred for 10 minutes to obtain an organic silver salt dispersion. Thereafter, the resulting organic silver salt dispersion was moved to a water-washing container, and stirred with addition of deionized water. The mixture was then allowed to stand, to separate the organic silver salt dispersion by floating and to remove water-soluble salts at a lower portion. Then, the resulting product was washed with deionized water until conductivity of an effluent reached 2 μS/cm. After centrifugal hydroextraction was performed, the product was dried with a hot air circulation dryer at 40° C. until weight loss was no longer observed, to obtain an organic silver salt powder.

Preparation of an Organic Silver Salt Emulsion

A polyvinyl butyral powder (BUTVAR B-79 manufactured by Monsanto, 14.57 g) was dissolved in 1,457 g of methyl ethyl ketone (MEK). While the solution was stirred with a dissolver (DISPERMAT CA-40M model manufactured by VMA-GETZMANN), 500 g of the organic silver salt powder was gradually added thereto, and the mixture was thoroughly stirred to form a slurry. The slurry was subjected to two-bath dispersion with a homogenizer (GM-2 model pressure homogenizer manufactured by S. M. T.) to prepare a photosensitive emulsion dispersion. At this time, treatment pressure in one bath was 280 kg/cm$^2$, and treatment pressure in the second bath was 560 kg/cm$^2$.

Preparation of an Emulsion Layer Coating Solution

MEK (15.1 g) was added to 50 g of the foregoing photosensitive emulsion dispersion. The mixture was maintained at 21° C. while being stirred with a dissolver-type homogenizer at 1,000 rpm. A methanol solution (390 μl) containing 10% by weight of an associated substance of 2 molecules of N,N-dimethylacetamide, 1 molecule of bromic acid and 1 molecule of bromine was added thereto. The resulting solution was stirred for 1 hour. Further, 494 μl of a methanol solution containing 10% by weight of calcium bromide was added thereto, and the mixture was stirred for 20 minutes. Then, 167 mg of a methanol solution containing 15.9% by weight of dibenzo-18-crown-6 and 4.9% by weight of potassium acetate was added thereto, and the mixture was stirred for 10 minutes. Subsequently, 0.24% by weight of a coloring matter B shown later, 18.3% by weight of 2-chlorobenzoic acid, 34.2% by weight of salicylic acid-p-toluenesulfonate and 2.6 g of an MEK solution of a hetero-aromatic mercapto compound (type and amount are shown in Table 2) were added thereto, and the mixture was stirred for 1 hour. Thereafter, the temperature was raised to 13° C., and stirring was further conducted for 30 minutes. While the temperature was maintained at 13° C., 13.31 g of polyvinyl butyral (BUTVAR B-79 manufactured by Monsanto) was added, and the mixture was stirred for 30 minutes. Then, 1.08 g of a solution containing 9.4% by weight of tetrachlorophthalic acid was added thereto, and the mixture was stirred for 15 minutes. While the stirring was continued, the compound of formula (I) of the present invention (type and amount are shown in Table 2), a compound of formula (II) of the present invention (type and amount are shown in Table 2), 1.1% by weight of 4-methylphthalic acid and 12.4 g of an MEK solution of a dye B were added, and 1.5 g of 10% by weight of aliphatic isocyanate (DESMODUR N3300 manufactured by Mobey) were successively added. Moreover, 4.27 g of an MEK solution containing 7.4% by weight of tribromomethyl-2-azaphenylsulfone and 7.2% by weight of phthalazine was added, to obtain a photosensitive layer coating solution.

Preparation of an Emulsion Layer Protecting Layer Coating Solution

While 865 g of MEK was stirred, 96 g of cellulose acetate butyrate (CAB171-15 manufactured by Eastman Chemical), 4.5 g of polymethyl methacrylate (PARALOYD A-21 manufactured by Rohm & Haas Company), 1.5 g of 1,3-divinylsulfonyl-2-propanol, 1.0 g of benzotriazole and 1.0 g of a fluorine-based activator (SURFLON KH40 manufactured by Asahi Glass Company, Ltd.) were dissolved therein. Then, 30 g of a dispersion, which was obtained by dispersing 13.6% by weight of cellulose acetate butyrate (CAB 171-15 manufactured by Eastman Chemical) and 9% by weight of calcium carbonate (SUPER-PFLEX 200 manufactured by Speciality Minerals) in MEK with a dissolver-type homogenizer at 8,000 rpm for 30 minutes, was added, and this mixture was stirred to prepare a surface protecting layer coating solution.

Coating for a Back surface

While 830 g of MEK was stirred, 84.2 g of cellulose acetate butyrate (CAB381-20 manufactured by Eastman Chemical) and 4.5 g of a polyester resin (VITEL PE2200B manufactured by Bostic) were dissolved therein. To this solution was added 0.30 g of a dye B shown later, a solution which was obtained by dissolving 4.5 g of a fluorine-based activator (SURFLON KH40 manufactured by Asahi Glass Company, Ltd.) and 2.3 g of a fluorine-based activator (MEGAFAC F120K manufactured by Dainippon Ink And Chemicals, Inc.) in 43.2 g of methanol was added thereto, and these were thoroughly stirred until thoroughly dissolved. Finally, 75 g of silica (SILOYD 64×6000 manufactured by W. R. Grace) dispersed in methyl ethyl ketone at a concentration of 1% by weight by a dissolver-type homogenizer was added, and this mixture was stirred to prepare a coating solution for a back surface.

The thus-obtained back surface coating solution was coated onto the surface by an extrusion coater such that dry film thickness reached 3.5 μm, and dried. The drying was conducted over a period of 5 minutes using a drying wind having a drying temperature of 100° C. and a dew-point temperature of 10° C.

Preparation of a Photosensitive Material

The emulsion layer coating solution and the emulsion layer surface protecting layer coating solution were subjected to simultaneous double-layer coating on the substrate having the coated back surface to prepare a photosensitive material. The coating was conducted such that the photosensitive layer reached 1.9 g/m$^2$ in terms of an amount of coating silver and the surface protecting layer reached 2.5 μm in terms of a dry film thickness. Subsequently, the drying was conducted for 10 minutes using a drying wind having a drying temperature of 75° C. and a dew-point temperature of 10° C.

A residual amount of the solvent in the coated surface of the emulsion layer in the coated sample was measured by gas chromatography in the same manner as in Example 1. As a result of the measurement, the content of the solvent in the photosensitive material was found to be 40 mg/m$^2$.

Further, the photosensitive material was cut to 100 cm$^2$. The photosensitive layer was separated in MEK, and decomposed with sulfuric acid and nitric acid using a microwave-type wet analyzer (MICRODIGEST A300 model manufactured by Prolabo), and analysis was conducted by a calibration curve method with an inductively coupled plasma mass analyzer (PQ-Ω type ICP-MS manufactured by VG Elemental). Consequently, the Zr content in the photosensitive material was found to be 10 μg or less per milligram of Ag.

Structural formulas of compounds used in Example 2 are shown below.

Coloring matter B

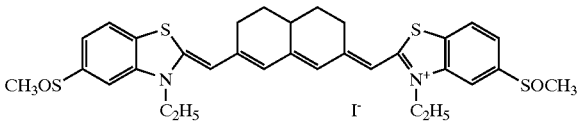

Dye B

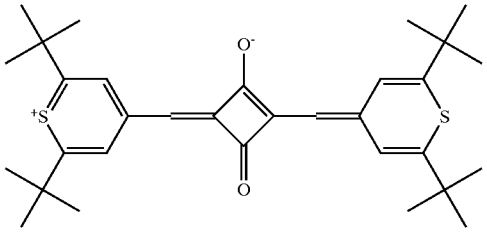

Evaluation of Photographic Performance

An exposure unit having, as a light source, a vertical multi-mode semiconductor laser with a wavelength of 800 nm to 820 nm by high frequency superposition was made for experimentation. Exposure by laser scanning with this exposure unit was applied to the emulsion side of the above-formed photosensitive material. At this time, an image was recorded such that an incident angle of the scanning laser on the exposure surface of the photosensitive material was set at 75°. Then, using an automatic developing unit having a heating drum, thermal development was conducted at 123° C. for 16 seconds such that the protecting layer of the photosensitive material was contacted with the drum surface. The resulting image was evaluated with a densitometer. At this time, a room for exposure and development was at 23° C. and 50% RH.

The photographic performance was evaluated as in Example 1. The results are shown in Table 2.

TABLE 2

| | Compound of formula (I) = α | | Compound of formula (II) or (III) = B | | Molar | Hetero-aromatic mercapto compound | | Fresh properties | | | |
|---|---|---|---|---|---|---|---|---|---|---|---|
| Sample No. | Type | Amount (mol/mol-Ag) | Type | Amount (mol/mol-Ag) | ratio B/α | Type | Amount (mol/mol-Ag) | Fogging | Sensitivity | Tone | Remarks |
| 1 | 1-4 | $4 \times 10^{-1}$ | 2-3 | $8 \times 10^{-3}$ | 0.02 | Mercapto-1 | $1 \times 10^{-2}$ | 0.18 | 100 | 0 | Inv |
| 2 | 1-4 | $4 \times 10^{-1}$ | — | — | — | Mercapto-1 | $1 \times 10^{-2}$ | 0.18 | 96 | −2 | CE |
| 3 | 1-4 | $4 \times 10^{-1}$ | 2-3 | $1.6 \times 10^{-2}$ | 0.04 | Mercapto-1 | $1 \times 10^{-2}$ | 0.18 | 104 | +1 | Inv |
| 4 | 1-4 | $4 \times 10^{-1}$ | 2-3 | $8 \times 10^{-3}$ | 0.02 | — | — | 0.18 | 95 | +1 | Inv |

TABLE 2-continued

| Sample No. | Compound of formula (I) = α Type | Amount (mol/mol-Ag) | Compound of formula (II) or (III) = B Type | Amount (mol/mol-Ag) | Molar ratio B/α | Hetero-aromatic mercapto compound Type | Amount (mol/mol-Ag) | Fresh properties Fogging | Sensitivity | Tone | Remarks |
|---|---|---|---|---|---|---|---|---|---|---|---|
| 5 | 1-4 | $4 \times 10^{-1}$ | 2-3 | $8 \times 10^{-3}$ | 0.02 | Mercapto-1 | $3 \times 10^{-2}$ | 0.18 | 102 | −1 | Inv |
| 6 | 1-4 | $4 \times 10^{-1}$ | 2-3 | $1.6 \times 10^{-2}$ | 0.04 | Mercapto-1 | $3 \times 10^{-2}$ | 0.18 | 103 | 0 | Inv |

(Note) Mol/mol-Ag is molar amount of a material per mol of coating silver (sum of silver halide silver and organic acid silver) in the photosensitive material The results in Table 2 show that the results of Example 2 have the same form as the results of Example 1.

Example 3

In the same manner as in Example 1, a PET substrate was produced and subjected to surface corona treatment.

(1) Preparation of an undercoat layer coating solution

| | |
|---|---|
| Formula (1) | |
| (for an undercoat layer on a photosensitive layer side) | |
| PESRESIN A-515GB manufactured by Takamatsu Yushi K.K. (30 mass % solution) | 234 g |
| Polyethylene glycol monononylphenyl ether (average ethylene oxide number = 8.5, 10 mass % solution) | 21.5 g |
| Polymer fine grains (MP-1000 manufactured by Soken Chemical Co., Ltd., average grain diameter 0.4 μm) | 0.91 g |
| Distilled water | 744 ml |
| Formula (2) | |
| (for a first layer on a back surface) | |
| Styrene-butadiene copolymer latex (solid content 40% by mass, styrene/butadiene mass ratio = 68/32) | 158 g |
| 2,4-Dichloro-6-hydroxy-S-triazine sodium salt (8 mass % aqueous solution) | 20 g |
| Sodium laurylbenzenesulfonate (1 mass % aqueous solution) | 10 ml |
| Distilled water | 854 ml |
| Formula (3) | |
| (for a second layer on a back surface) | |
| $SnO_2$/SbO (9/1 mass ratio, average grain diameter 0.038 pm, 17 mass % dispersion) | 84 g |
| Gelatin (10 mass % aqueous solution) | 89.2 g |
| Cellulose derivatives (METROSE TC-5 (2 mass % aqueous solution manufactured by Shin-etsu Chemical Industry Co., Ltd.)) | 8.6 g |
| Polymer fine grains (MP-1000 manufactured by Soken Chemical Co., Ltd.) | 0.01 g |
| Sodium dodecylbenzenesulfonate (1 mass % aqueous solution) | 10 ml |
| NaOH (1% by mass) | 6 ml |
| PROXEL (manufactured by ICI) | 1 ml |
| Distilled water | 805 ml |

Preparation of an Undercoat Substrate

Both surfaces of a biaxially oriented polyethylene terephthalate substrate having a thickness of 175 μm were subjected to corona discharge treatment. The undercoat coating solution of formula (1) was coated on one surface (a photosensitive layer surface) with a wire bar such that the wet coating amount reached 6.6 ml/m$^2$ (for one surface), and was dried at 180° C. for 5 minutes. Then, the undercoat coating solution of formula (2) was coated on the back surface with a wire bar such that the wet coating amount reached 5.7 ml/m$^2$, and was dried at 180° C. for 5 minutes. Further, the undercoat coating solution of formula (3) was coated on the back surface with a wire bar such that the wet coating amount reached 7.7 ml/m$^2$, and was dried at 180° C. for 6 minutes to prepare an undercoat substrate.

Preparation of a Back Surface Coating Solution

Preparation of a Solid Fine Grain Dispersion (a) of a Basic Precursor

A basic precursor compound 11 (64 g), 28 g of diphenylsulfone and 10 g of a surfactant (DEMOL N manufactured by Kao K. K.) were mixed with 220 ml of distilled water, and the mixed solution was bead-dispersed with a sand mill (¼ GALLON SAND GRINDER MILL manufactured by Aimex K. K.) to obtain a solid fine grain dispersion (a) of the basic precursor compound having an average grain diameter of 0.2 μm.

Preparation of a Dye Solid Fine Grain Dispersion

A cyanine dye compound 13 shown later (9.6 g) and 5.8 g of sodium p-dodecylbenzenesulfonate were mixed with 305 ml of distilled water, and the mixed solution was bead-dispersed with a sand mill (¼ GALLON SAND GRINDER MILL manufactured by Aimex K. K.) to obtain a dye solid fine grain dispersion having an average grain diameter of 0.2 μm.

Preparation of an Antihalation Layer Coating Solution

Gelatin (17 g), 9.6 g of polyacrylamide, 70 g of the solid fine grain dispersion (a) of the basic precursor, 56 g of the dye solid fine grain dispersion, 1.5 g of polydisperse polymethyl methacrylate fine grains (average grain size 8 μm, grain size standard deviation 0.4), 0.03 g of benzoisothiazolinone, 2.2 g of sodium polyethylenesulfonate, 0.2 g of a blue dye compound 14 shown later, 3.9 g of a yellow dye compound 15 and 844 ml of water were mixed to prepare an antihalation layer coating solution.

Preparation of a Back Surface Protecting Layer Coating Solution

A container was maintained at 40° C., and 50 g of gelatin, 0.2 g of sodium polystyrenesulfonate, 2.4 g of N,N-ethylenebis(vinylsulfonacetamide), 1 g of sodium tert-octylphenoxyethoxyethanesulfonate, 30 mg of benzoisothiazolinone, 37 mg of a fluorine-based surfactant (F-1: N-perfluorooctylsulfonyl-N-propylalanine potassium salt), 0.15 g of a fluorine-based surfactant (F-2: polyethylene glycol mono(N-perfluorooctylsulfonyl-N-propyl-2-amylethyl) ether, ethylene oxide average degree of polymerization 15), 64 mg of a fluorine-based surfactant (F-3), 32 mg of a fluorine-based surfactant (F-4), 8.8 g of an acrylic acid/ethyl acrylate copolymer (copolymerization mass ratio 5/95), 0.6 g of AEROSOL OT (manufactured by American Cyanamid), 1.8 g, as liquid paraffin, of liquid paraffin emulsion and 950 ml of water were mixed to form a back surface protecting layer coating solution.

Preparation of a Silver Halide Emulsion 1

A 1 mass % potassium bromide solution (3.1 ml) was added to 1,421 ml of distilled water, and 3.5 ml of sulfuric acid having a concentration of 0.5 mol/liter and 31.7 g of phthalic gelatin were further added thereto. The solution was maintained at 30° C. while being stirred in a stainless steel reaction vessel. A solution A obtained by diluting 22.22 g of silver nitrate to a volume of 95.4 ml with distilled water and a solution B obtained by diluting 15.3 g of potassium bromide and 0.8 g of potassium iodide to a volume of 97.4 ml with distilled water were completely added at a fixed flow rate over a period of 45 seconds. Subsequently, 10 ml of an aqueous solution containing 3.5% by mass of hydrogen peroxide was added, and 10.8 ml of an aqueous solution containing 10% by mass of benzimidazole was further added. Moreover, a solution C obtained by diluting 51.86 g of silver nitrate to a volume of 317.5 ml with distilled water and a solution D obtained by diluting 44.2 g of potassium bromide and 2.2 g of potassium iodide to a volume of 400 ml with distilled water were added, such that the solution C was completely added at a fixed flow rate over a period of 20 minutes and the solution D was added by a control double jet method while maintaining pAg at 8.1. Ten minutes after starting the addition of the solutions C and D, potassium hexachloroiridate (III) in an amount of $1\times10^{-4}$ mol per mol of silver was completely added. Five seconds after completing the addition of the solution C, an aqueous solution of potassium hexacyanoferrate (II) in an amount of $3\times10^{-4}$ mol per mol of silver was completely added. The solution was adjusted to a pH of 3.8 with sulfuric acid having a concentration of 0.5 mol/liter, stirring was stopped, and precipitation, desalting and water-washing steps were conducted. The resulting material was adjusted to a pH of 5.9 with sodium hydroxide having a concentration of 1 mol/liter to prepare a silver halide dispersion having a pAg of 8.0.

The silver halide dispersion was maintained at 38° C. with stirring, and 5 ml of a methanol solution containing 0.34% by mass of 1,2-benzoisothiazolin-3-one was added thereto. Forty minutes later, a methanol solution of a below-described spectral sensitization coloring matter A' and a below-described spectral sensitization coloring matter B' at a molar ratio of 1:1 was added in an amount of $1.2\times10^{-3}$ mol per mol of silver, in terms of the sum of the sensitization coloring matters A' and B'. One minute later, the temperature was elevated to 47° C. 20 minutes after the temperature elevation, a methanol solution of sodium benzenethiosulfonate in an amount of $7.6\times10^{-5}$ mol per mol of silver was added. Further, 5 minutes later, a methanol solution of the tellurium sensitizer C in an amount of $2.9\times10^{-4}$ mol per mol of silver was added, and the mixture was aged for 91 minutes. A methanol solution (1.3 ml) containing 0.8% by mass of N,N'-dihydroxy-N"-diethylmelamine was added. Moreover, 4 minutes later, a methanol solution of 5-methyl-2-mercaptobenzimidazole in an amount of $4.8\times10^{-3}$ mol per mol of silver and a methanol solution of 1-phenyl-2-heptyl-5-mercapto-1,3,4-triazole in an amount of $5.4\times10^{-3}$ mol per mol of silver were added to prepare a silver halide emulsion 1.

The grains in the thus-formed silver halide emulsion were silver iodobromide grains uniformly containing 3.5 mol % of iodine and having an average sphere equivalent diameter of 0.042 $\mu$m and a sphere equivalent diameter fluctuation coefficient of 20%. Grain size and the like were obtained from an average value of 1,000 grains using an electron microscope. A [100] surface ratio of the grains was found to be 80% by the Kubelka-Munk method.

Preparation of a Silver Halide Emulsion 2

A silver halide emulsion 2 was prepared in the same manner as the silver halide emulsion 1 except that the liquid temperature in forming the grains was changed from 30° C. to 47° C., the solution B was changed to a solution obtained by diluting 15.9 g of potassium bromide to a volume of 97.4 ml with distilled water, the solution D was changed to a solution obtained by diluting 45.8 g of potassium bromide to a volume of 400 ml with distilled water, the addition time of the solution C was 30 minutes and potassium hexacyanoferrate (II) was excluded. Precipitation, desalting, water-washing and dispersion were conducted as for the silver halide emulsion 1. Further, spectral sensitization, chemical sensitization and addition of 5-methyl-2-mercaptobenzimidazole and 1-phenyl-2-heptyl-5-mercapto-1,3,4-triazole were conducted as for the emulsion 1 except that the amount of the methanol solution of the spectral sensitization coloring matters A' and B' at the molar ratio of 1:1 was changed to $7.5\times10^{-4}$ mol per mol of silver in terms of the sum of the spectral sensitization coloring matters A' and B', the amount of the tellurium sensitizer C was changed to $1.1\times10^{-4}$ mol per mol of silver, and the amount of 1-phenyl-2-heptyl-5-mercapto-1,3,4-triazole was changed to $3.3\times10^{-3}$ mol to obtain a silver halide emulsion 2. The grains of the silver halide emulsion 2 were pure silver bromide cubic grains having an average sphere equivalent diameter of 0.080 $\mu$m and a sphere equivalent diameter fluctuation coefficient of 20%.

Preparation of a Silver Halide Emulsion 3

A silver halide emulsion 3 was prepared in the same manner as the silver halide emulsion 1 except that the liquid temperature in forming the grains was changed from 30° C. to 27° C. Further, precipitation, desalting, water-washing and dispersion were conducted as for the silver halide emulsion 1. The silver halide emulsion 3 was obtained in the same manner as the emulsion 1 except that the amount of the solid dispersion (gelatin aqueous solution) of the spectral sensitization coloring matters A' and B' at the molar ratio of 1:1 was $6\times10^{-3}$ mol per mol of silver in terms of the sum of the sensitization coloring matters A' and B', and the amount of the tellurium sensitizer C was changed to $5.2\times10^{-4}$ mol per mol of silver. The grains of the silver halide emulsion 3 were silver iodobromide grains uniformly containing 3.5 mol % of iodine and having an average sphere equivalent diameter of 0.034 $\mu$m and a sphere equivalent diameter fluctuation coefficient of 20%.

Preparation of a Mixed Emulsion A for a Coating Solution

The silver halide emulsion 1 (70% by mass), 15% by mass of the silver halide emulsion 2 and 15% by mass of the silver halide emulsion 3 were dissolved, and $7\times10^{-3}$ mol per mol of silver of benzothiazolium iodide was added in a 1 mass % aqueous solution. Further, water was added such that content of silver halide became 38.2 g per kilogram of this mixed emulsion for a coating solution.

Preparation of an Aliphatic Acid Silver Dispersion

Behenic acid (EDENOR C22-85R manufactured by Henkel, 87.6 g), 423 liters of distilled water, 49.2 liters of an NaOH aqueous solution having a concentration of 5 mol/liter, and 120 liters of tert-butanol were mixed and reacted at 75° C. for 1 hour with stirring to obtain a sodium behenate solution. Separately, 206.2 liters (pH 4.0) of an aqueous solution containing 40.4 kg of silver nitrate was prepared, and maintained at 10° C. A reaction vessel charged with 635 liters of distilled water and 30 liters of tert-butanol was maintained at 30° C., and the total amount of the sodium behenate solution and the total amount of the silver nitrate aqueous solution were added at a fixed flow rate over a period of 93 minutes 15 seconds and over a period of 90 minutes respectively while being fully stirred. At this time, for 11 minutes after starting the addition of the silver nitrate aqueous solution, the silver nitrate aqueous solution alone was added. Then the addition of the sodium behenate solution was started. For 14 minutes 15 seconds after completing the addition of the silver nitrate aqueous solution, the sodium behenate solution was added alone. At this time, the temperature inside the reaction vessel was set at 30° C., and the temperature was externally controlled such that the liquid temperature was constant. Further, the temperature of piping for the addition of the sodium behenate solution was controlled by circulating hot water at an outer side of a double tube, and liquid temperature at an outlet at the tip of an addition nozzle was adjusted to 75° C. The temperature of piping for addition of the silver nitrate aqueous solution was controlled by circulating cold water at an outer side of a double tube. The position at which the sodium behenate solution was added and the position at which the silver nitrate aqueous solution was added were arranged symmetrically about a stirring shaft, and the heights were adjusted so as not to contact the reaction solutions.

After the addition of the sodium behenate solution was completed, the mixture was allowed to stand at the same temperature for 20 minutes with stirring. The temperature was then raised to 35° C. over a period of 30 minutes. The reaction mixture was then aged for 210 minutes. Immediately after completion of the ageing, solid matter was separated by centrifugal filtration, and washed with water until conductivity of the filtrate reached 30 μS/cm. In this manner, an aliphatic acid silver salt was obtained. The resulting solid matter was stored as a wet cake without being dried.

The form of the resulting silver behenate grains was observed by photography with an electron microscope. Consequently, the grains were found to be flaky crystals with a=0.14 μm, b=0.4 μm, c=0.6 μm, an average aspect ratio of 5.2, an average sphere equivalent diameter of 0.52 μm and a sphere equivalent diameter fluctuation coefficient of 15%. (a, b and c are as defined earlier).

To the wet cake, which was in an amount equivalent to 260 kg of dry solid matter, were added 19.3 kg of polyvinyl alcohol (PVA-217 manufactured by Kuraray Co., Ltd.), and water to adjust the total amount to 1,000 kg. Then, this mixture was formed into a slurry with a dissolver blade, and further pre-dispersed with a pipeline mixer (PM-10 model manufactured by Mizuho Kogyo).

Subsequently, the pre-dispersed solution was treated three times by controlling pressure of a disperser (MICROFLUIDIZER M-610 manufactured by Microfluidex International Corporation, using a Z-shaped interaction chamber) to 1,260 kg/cm$^2$ to obtain a silver behenate dispersion. In the cooling procedure, coiled heat exchangers were mounted before and after the interaction chamber, and a dispersion temperature was set to 18° C. by controlling temperature of a coolant.

Preparation of a Reducing Agent-1 Dispersion

Water (16 kg) was added to 10 kg of a reducing agent-1 shown later (1,1-bis(2-hydroxy-3,5-dimethylphenyl)-3,5,5-trimethylhexane) and 10 kg of a 20 mass % aqueous solution of modified polyvinyl alcohol (POVAL MP203 manufactured by Kuraray Co., Ltd.), and these were thoroughly mixed to form a slurry. This slurry was fed with a diaphragm pump, and dispersed for 3.5 hours with a lateral bead mill (UVM-2 manufactured by Aimex K. K.) filled with zirconia beads having an average diameter of 0.5 mm. Then, 0.2 g of benzoisothiazolinone sodium salt and water were added to adjust the concentration of the reducing agent to 25% by mass. Thus, a reducing agent-1 dispersion was obtained. The reducing agent grains contained in the thus-obtained reducing agent dispersion had a median diameter of 0.42 μm and a maximum grain diameter of 2.0 μm or less. The reducing agent dispersion was filtered through a polypropylene filter having a pore diameter of 10.0 μm to remove foreign matter such as dust and the like, and then stored.

Preparation of a Reducing Agent-2 Dispersion

Water (16 kg) was added to 10 kg of a reducing agent-2 shown later (2,2-isobutylidenebis(4,6-dimethylphenol)) and 10 kg of a 20 mass % aqueous solution of modified polyvinyl alcohol (POVAL MP203 manufactured by Kuraray Co., Ltd.), and these were thoroughly mixed to form a slurry. This slurry was fed with a diaphragm pump, and dispersed for 3.5 hours with a lateral bead mill (UVM-2 manufactured by Aimex K. K.) filled with zirconia beads having an average diameter of 0.5 mm. Then, 0.2 g of benzoisothiazolinone sodium salt and water were added to adjust the concentration of the reducing agent to 25% by mass. Thus, a reducing agent-2 dispersion was obtained. The reducing agent grains contained in the reducing agent dispersion had a median diameter of 0.38 μm and a maximum grain diameter of 2.0 μm or less. The reducing agent dispersion was filtered through a polypropylene filter having a pore diameter of 10.0 μm to remove foreign matter such as dust and the like, and then stored.

Preparation of a reducing agent-3 dispersion

Water (7.2 kg) was added to 10 kg of a reducing agent complex-3 shown later (1:1 complex of 2,2'-methylenebis (4-ethyl-6-tert-butylphenol) and triphenylphosphine oxide), 0.12 kg of triphenylphosphine oxide and 16 kg of a 10 mass % aqueous solution of modified polyvinyl alcohol (POVAL MP203 manufactured by Kuraray Co., Ltd.), and these were thoroughly mixed to form a slurry. This slurry was fed with a diaphragm pump, and dispersed for 4.5 hours with a lateral bead mill (UVM-2 manufactured by Aimex K. K.) filled with zirconia beads having an average diameter of 0.5 mm. Then, 0.2 g of benzoisothiazolinone sodium salt and water were added to adjust the concentration of the reducing agent to 25% by mass. Thus, a reducing agent complex-3 dispersion was obtained. The reducing agent complex grains contained in the thus-obtained reducing agent complex dispersion had a median diameter of 0.46 μm and a maximum grain diameter of 1.6 μm or less. The thus-obtained reducing agent complex dispersion was filtered through a polypropylene filter having a pore diameter of 3.0 μm to remove foreign matter such as dust and the like, and then stored.

Preparation of a Reducing Agent-4 Dispersion

Six kilograms of water was added to 10 kg of a reducing agent-4 shown later (2,2'-methylenebis(4-ethyl-6-tert-butylphenol)) and 20 kg of a 10 mass % aqueous solution of modified polyvinyl alcohol (POVAL MP203 manufactured by Kuraray Co., Ltd.), and these were thoroughly mixed to form a slurry. This slurry was fed with a diaphragm pump, and dispersed for 3.5 hours with a lateral bead mill (UVM-2 manufactured by Aimex K. K.) filled with zirconia beads having an average diameter of 0.5 mm. Then, 0.2 g of benzoisothiazolinone sodium salt and water were added to adjust the concentration of the reducing agent to 25% by mass. Thus, a reducing agent-4 dispersion was obtained. The reducing agent grains contained in the reducing agent dispersion had a median diameter of 0.40 μm and a maximum grain diameter of 1.5 μm or less. The reducing agent dispersion was filtered through a polypropylene filter having a pore diameter of 3.0 μm to remove foreign matter such as dust and the like, and then stored.

Preparation of a Reducing Agent-5 Dispersion

Six kilograms of water was added to 10 kg of a reducing agent-5 shown later (2,2'-methylenebis(4-methyl-6-tert-butylphenol)) and 20 kg of a 10 mass % aqueous solution of modified polyvinyl alcohol (POVAL MP203 manufactured by Kuraray Co., Ltd.), and these were thoroughly mixed to form a slurry. This slurry was fed with a diaphragm pump, and dispersed for 3.5 hours with a lateral bead mill (UVM-2 manufactured by Aimex K. K.) filled with zirconia beads having an average diameter of 0.5 mm. Then, 0.2 g of benzoisothiazolinone sodium salt and water were added to adjust the concentration of the reducing agent to 25% by mass. Thus, a reducing agent-5 dispersion was obtained. The reducing agent grains contained in the reducing agent dispersion had a median diameter of 0.38 μm and a maximum grain diameter of 1.5 μm or less. The reducing agent dispersion was filtered through a polypropylene filter having a pore diameter of 3.0 μm to remove foreign matter such as dust and the like, and then stored.

Preparation of a dispersion of a compound of Formula (II) or (III)

Water (75 g) was added to 75 g of the compound of formula (II) or (III) (type and amount are shown in Table 3) and 150 g of a 10 mass % aqueous solution of modified polyvinyl alcohol (POVAL MP-203 manufactured by Kuraray Co., Ltd.), and these were thoroughly mixed to form a slurry. This slurry was bead-dispersed with zirconia beads having an average diameter of 0.5 mm and a sand mill (¼ GALLON SAND GRINDER MILL manufactured by Aimex K. K.) at 1,500 rpm for 10 hours to obtain a solid fine grain dispersion having a median diameter of 0.4 μm. The resulting dispersion was filtered through a polypropylene filter having a pore diameter of 3.0 μm to remove foreign matter such as dust and the like, and then stored.

Preparation of a Development Accelerator-1 Dispersion.

Water (75 g) was added to 75 g of a development accelerator-1 shown later and 150 g of a 10 mass % aqueous solution of modified polyvinyl alcohol (POVAL MP-203 manufactured by Kuraray Co., Ltd.), and these were thoroughly mixed to form a slurry. This slurry was bead-dispersed with zirconia beads having an average diameter of 0.5 mm and a sand mill (¼ GALLON SAND GRINDER MILL manufactured by Aimex K. K.) at 1,500 rpm for 10 hours to obtain a solid fine grain dispersion having a median diameter of 0.35 μm. The resulting dispersion was filtered through a polypropylene filter having a pore diameter of 3.0 μm to remove foreign matter such as dust and the like, and then stored.

Preparation of a Hydrogen-Bonding Compound-2 Dispersion

Ten kilograms of water was added to 10 kg of a hydrogen-bonding compound-2 shown later (tri(4-tert-butylphenyl) phosphine oxide) and 20 kg of a 10 mass % aqueous solution of modified polyvinyl alcohol (POVAL MP-203 manufactured by Kuraray Co., Ltd.), and these were thoroughly mixed to form a slurry. This slurry was fed with a diaphragm pump, and dispersed with a lateral bead mill (UVM-2 manufactured by Aimex K. K.) filled with zirconia beads having an average diameter of 0.5 mm for 3.5 hours. Then, 0.2 g of benzoisothiazolinone sodium salt and water were added to adjust the concentration of the reducing agent to 22% by mass. Thus, a hydrogen-bonding compound-2 dispersion was obtained. The hydrogen-bonding compound grains contained in the thus-obtained hydrogen-bonding compound-2 dispersion had a median diameter of 0.38 μm and a maximum grain diameter of 1.5 μm or less. The hydrogen-bonding compound dispersion was filtered through a polypropylene filter having a pore diameter of 3.0 μm to remove foreign matter such as dust and the like, and then stored.

Preparation of an Organic Polyhalogen Compound-1 Dispersion

Water (16 kg) was added to 10 kg of an organic polyhalogen compound-1 shown later (2-tribromomethanesulfonylnaphthalene), 10 kg of a 20 mass % aqueous solution of modified polyvinyl alcohol (POVAL MP203 manufactured by Kuraray Co., Ltd.) and 0.4 kg of a 20 mass % aqueous solution of sodium triisopropylnaphthalenesulfonate, and these were thoroughly mixed to form a slurry. This slurry was fed with a diaphragm pump, and dispersed for 3.5 hours with a lateral bead mill (UVM-2 manufactured by Aimex K. K.) filled with zirconia beads having an average diameter of 0.5 mm. Then, 0.2 g of benzoisothiazolinone sodium salt and water were added to adjust the concentration of the organic polyhalogen compound to 23.5% by mass. Thus, an organic polyhalogen compound-1 dispersion was obtained. The organic polyhalogen compound grains contained in the organic polyhalogen compound dispersion had a median diameter of 0.36 μm and a maximum grain diameter of 2.0 μm or less. The organic polyhalogen compound dispersion was filtered through a polypropylene filter having a pore diameter of 10.0 μm to remove foreign matter such as dust and the like, and then stored.

Preparation of an Organic Polyhalogen Compound-2 Dispersion

Water (14 kg) was added to 10 kg of an organic polyhalogen compound-2 shown later (tribromomethanesulfonylbenzene), 10 kg of a 20 mass % aqueous solution of modified polyvinyl alcohol (POVAL MP203 manufactured by Kuraray Co., Ltd.) and 0.4 kg of a 20 mass % aqueous solution of sodium triisopropylnaphthalenesulfonate, and these were thoroughly mixed to form a slurry. This slurry was fed with a diaphragm pump, and dispersed for 5 hours with a lateral bead mill (UVM-2 manufactured by Aimex K. K.) filled with zirconia beads having an average diameter of 0.5 mm. Then, 0.2 g of benzoisothiazolinone sodium salt and water were added to adjust the concentration of the organic polyhalogen compound to 26% by mass. Thus, an organic polyhalogen compound-2 dispersion was obtained. The organic polyhalogen compound grains contained in the organic polyhalogen compound dispersion had a median diameter of 0.41 μm and a maximum grain diameter of 2.0 μm or less. The organic polyhalogen compound dispersion was filtered through a polypropylene filter having a pore diameter of 10.0 μm to remove foreign matter such as dust and the like, and then stored.

Preparation of an Organic Polyhalogen Compound-3 Dispersion

Eight kilograms of water was added to 10 kg of an organic polyhalogen compound-3 shown later (N-butyl-3-tribromomethanesulfonylbenzamide), 20 kg of a 10 mass % aqueous solution of modified polyvinyl alcohol (POVAL MP203 manufactured by Kuraray Co., Ltd.) and 0.4 kg of a 20 mass % aqueous solution of sodium triisopropylnaphthalenesulfonate, and these were thoroughly mixed to form a slurry. This slurry was fed with a diaphragm pump, and dispersed for 5 hours with a lateral bead mill (UVM-2 manufactured by Aimex K. K.) filled with zirconia beads having an average diameter of 0.5 mm. Then, 0.2 g of benzoisothiazolinone sodium salt and water were added to adjust the concentration of the organic polyhalogen compound to 25% by mass. This dispersion was heated at 40° C. for 5 hours to obtain an organic polyhalogen compound-3 dispersion. The organic polyhalogen compound grains contained in the organic polyhalogen compound dispersion had a median diameter of 0.36 μm and a maximum grain diameter of 1.5 μm or less. The organic polyhalogen compound dispersion was filtered through a polypropylene filter having a pore diameter of 3.0 μm to remove foreign matter such as dust and the like, and then stored.

Preparation of a Phthalazine Compound-1 Solution

Eight kilograms of modified polyvinyl alcohol (MP203 manufactured by Kuraray Co., Ltd.) was dissolved in 174.57 kg of water. Then, 3.15 kg of a 20 mass % aqueous solution of sodium triisopropylnaphthalenesulfonate and 14.28 kg of a 70 mass % aqueous solution of a phthalazine compound-1 shown later (6-isopropylphthalazine) were added to prepare a 5 mass % solution of the phthalazine compound-1.

Preparation of a Mercapto Compound-1 Aqueous Solution

Seven grams of a mercapto compound-1 shown later (1-(3-sulfophenyl)-5-mercaptotetrazole sodium salt) was dissolved in 993 g of water to form a 0.7 mass % aqueous solution.

Preparation of a Pigment-1 Dispersion

Water (250 g) was added to 64 g of C. I. Pigment Blue 60 and 6.4 g of a sodium salt of a β-naphthalenesulfonic acid formalin condensate (DEMOL N manufactured by Kao K. K.), and these were thoroughly mixed to form a slurry. Eight-hundred grains of zirconia beads having an average diameter of 0.5 mm were arranged, and charged into a vessel along with the slurry. Dispersion was conducted with a disperser (¼ G SAND GRINDER MILL manufactured by Aimex K. K.) for 25 hours to obtain a pigment-1 dispersion. The pigment grains contained in the thus-obtained pigment dispersion had an average grain diameter of 0.21 μm.

Preparation of an SBR Latex Solution

An SBR latex having a Tg of 23° C. was prepared as follows.

Styrene (70.5 parts by mass), 26.5 parts by mass of butadiene and 3 parts by mass of acrylic acid were emulsion-polymerized using ammonium persulfate as a polymerization initiator and an anionic surfactant as an emulsifying agent, and this product was aged at 80° C. for 8 hours. Subsequently, the product was cooled to 40° C., and adjusted to a pH of 7.0 with aqueous ammonia. Further, SANDET BL, manufactured by Sanyo Chemical Industries Ltd., was added at a rate of 0.22%. A 5% sodium hydroxide aqueous solution was then added to adjust the pH to 8.3, and the pH was further adjusted to 8.4 with aqueous ammonia. A molar ratio of $Na^+$ ions to $NH_4^+$ ions at this time was 1:2.3. Further, 0.15 ml of a 7% aqueous solution of benzoisothiazolinone sodium salt was added to 1 kg of this solution to prepare an SBR latex solution.

(SBR Latex: St(70.5)-Bu(26.5)-AA(3)-Latex)

Tg was 23° C., average grain diameter 0.1 μm, concentration 43% by mass, equilibrium water content (at 25° C. and relative humidity 60%) 0.6% by mass, ion conductivity 4.2 mS/cm (measured at 25° C. with a conductivity meter CM-30S manufactured by Toa Denpa Kogyo K. K. using 43% by mass of a latex solution), and pH 8.4.

SBR latexes different in Tg were prepared in the same manner by suitably changing proportions of styrene and butadiene.

Preparation of an Emulsion Layer (Photosensitive Layer) Coating Solution-1

One-thousand grams of the aliphatic acid silver dispersion, 125 ml of water, 113 g of the reducing agent-1 dispersion, 91 g of the reducing agent-2 dispersion, the dispersion of the compound of formula (II) or (III) (type and amount are shown in Table 3), 27 g of the pigment-1 dispersion, 82 g of the organic polyhalogen compound-1 dispersion, 40 g of the organic polyhalogen compound-2 dispersion, 173 g of the phthalazine compound-1 solution, 1,082 g of the SBR latex (Tg: 20.5° C.) solution and 9 g of the mercapto compound-1 aqueous solution were added in this order, and 158 g of the silver halide mixed emulsion A was added just before coating. These were thoroughly mixed to form an emulsion layer coating solution, and this solution was directly fed to a coating die for coating.

Viscosity of the emulsion layer coating solution was measured with a Brookfield viscometer from Tokyo Precision Instrument Co., Ltd., and found to be 40 mPa.s at 40° C. (No. 1 rotor, 60 rpm).

Viscosities of the coating solution at 25° C. as measured with an RFS FLUID SPECTROMETER manufactured by Rheometrics Far East K. K. were 1,500, 220, 70, 40 and 20 mPa.s with shear rates of 0.1, 1, 10, 100 and 1,000 $s^{-1}$, respectively.

Preparation of an Emulsion Layer (Photosensitive Layer) Coating Solution-2

One-thousand grams of the aliphatic acid silver dispersion, 104 ml of water, 30 g of the pigment-1 dispersion, 21 g of the organic polyhalogen compound-2 dispersion, 69 g of the organic polyhalogen compound-3 dispersion, 173 g of the phthalazine compound-1 solution, 1,082 g of the SBR latex (Tg: 23° C.) solution, 258 g of the reducing agent complex-3 dispersion, the dispersion of the compound of formula (II) or (III) (type and amount are shown in Table 3) and 9 g of the mercapto compound-1 aqueous solution were added in this order, and 110 g of the silver halide mixed emulsion A was added just before coating. These were thoroughly mixed to form an emulsion layer coating solution, and this solution was directly fed to a coating die for coating.

Preparation of an Emulsion Layer (Photosensitive Layer) Coating Solution-3

One-thousand grams of the aliphatic acid silver dispersion, 95 ml of water, 73 g of the reducing agent-4 dispersion, 68 g of the reducing agent-5 dispersion, the dispersion of the compound of formula (II) or (III) (type and amount are shown in Table 3), 3.1 g of the development accelerator-1 dispersion, 30 g of the pigment-1 dispersion, 21 g of the organic polyhalogen compound-2 dispersion, 69 g of the organic polyhalogen compound-3 dispersion, 173 g of the phthalazine compound-1 solution, 1,082 g of an SBR core/shell latex (core Tg: 20° C./shell Tg:30° C.=70/30 mass ratio) solution, 124 g of the hydrogen-bonding compound-2 dispersion and 9 g of the mercapto compound-1 aqueous solution were added in this order, and 110 g of the silver halide mixed emulsion A was added just before coating. These were thoroughly mixed to form an emulsion layer coating solution, and this solution was directly fed to a coating die for coating.

Preparation of an Emulsion Surface Intermediate Layer Coating Solution

Two milliliters of a 5 mass % aqueous solution of AEROSOL OT (manufactured by American Cyanamid), 10.5 ml of a 20 mass % aqueous solution of diammonium phthalate and water, in such an amount as to adjust a total amount to 880 g, were added to 772 g of a 10 mass % aqueous solution of polyvinyl alcohol (PVA-205 manufactured by Kuraray Industries Co., Ltd.) with 5.3 g of a 20 mass % dispersion of a pigment and 226 g of a 27.5 mass % solution of a methyl methacrylate/styrene/butyl acrylate/hydroxyethyl methacrylate/acrylic acid copolymer (copolymerization mass ratio 64/9/20/5/2) latex, and pH was adjusted to 7.5 with NaOH to form an intermediate layer coating solution. This solution was fed to a coating die at a rate of 10 ml/$m^2$.

Viscosity of this coating solution was measured with a Brookfield viscometer at 40° C. (No. 1 rotor, 60 rpm), and found to be 21 mPa.s.

Preparation of an Emulsion Surface First Protecting Layer Coating Solution

Inert gelatin (64 g) was dissolved in water. A 27.5 mass % solution (80 g) of a methyl methacrylate/styrene/butyl acrylate/hydroxyethyl methacrylate/acrylic acid copolymer (copolymerization mass ratio 64/9/20/5/2) latex, 23 ml of a 10 mass % methanol solution of phthalic acid, 23 ml of a 10 mass % aqueous solution of 4-methylphthalic acid, 28 ml of sulfuric acid having a concentration of 0.5 mol/liter, 5 ml of a 5 mass % aqueous solution of AEROSOL OT (manufactured by American Cyanamid), 0.5 g of phenoxyethanol and 0.1 g of benzoisothiazolinone were added, and water was added such that the total amount reached 750 g, to form a coating solution. Just before coating, 26 ml of 4% by mass chrome alum was mixed in with a static mixer. The resulting coating solution was fed to a coating die at a rate of 18.6 ml/m$^2$.

Viscosity of the coating solution was measured with a Brookfield viscometer at 40° C. (No. 1 rotor, 60 rpm), and found to be 17 mPa.s.

Preparation of an Emulsion Surface Second Protecting Layer Coating Solution

Inert gelatin (80 g) was dissolved in water. A 27.5 mass % solution (102 g) of a methyl methacrylate/styrene/butyl acrylate/hydroxyethyl methacrylate/acrylic acid copolymer (copolymerization mass ratio 64/9/20/5/2) latex, 3.2 ml of a 5 mass % solution of a fluorine-based surfactant (F-1: N-perfluorooctylsulfonyl-N-propylalanine potassium salt), 32 ml of a 2 mass % aqueous solution of a fluorine-based surfactant (F-2: polyethylene glycol mono(n-perfluorooctylsulfonyl-N-propyl-2-aminoethyl) ether (ethylene oxide average degree of polymerization=15), 23 ml of a 5 mass % solution of AEROSOL OT (manufactured by American Cyanamid), 4 g of polymethyl methacrylate fine grains (average grain diameter 0.7 μm), 21 g of polymethyl methacrylate fine grains (average grain diameter 4.5 μm), 1.6 g of 4-methylphthalic acid, 4.8 g of phthalic acid, 44 ml of sulfuric acid having a concentration of 0.5 mol/liter and 10 mg of benzoisothiazolinone were added, and water was added such that the total amount reached 650 g. Just before coating, 445 ml of an aqueous solution containing 4% by mass of chrome alum and 0.67% by mass of phthalic acid was mixed therewith through a static mixer to form a surface protecting layer coating solution. The resulting coating solution was fed to a coating die at a rate of 8.3 ml/m$^2$.

Viscosity of the coating solution was measured with a Brookfield viscometer at 40° C. (No. 1 rotor, 60 rpm), and found to be 9 mPa.s.

Preparation of a Thermal Development Photosensitive Material-1

On the back surface of the undercoat substrate, the antihalation layer coating solution and the back surface protecting layer coating solution were subjected to simultaneous double-layer coating such that coating solid content of the solid fine grain dye of the antihalation layer coating solution reached 0.04 g/m$^2$ and the gelatin coating amount of the latter coating solution reached 1.7 g/m$^2$, and the product was dried to form a back layer.

On the surface opposite to the back surface, the emulsion layer, the intermediate layer, the first protecting layer and the second protecting layer were subjected to simultaneous double-layer coating in this order from the undercoat surface by a slide bead coating method, to form a sample of a thermal development photosensitive material. At this time, the emulsion layer and the intermediate layer were adjusted to a temperature of 31° C., the first protecting layer to a temperature of 36° C. and the second protecting layer to a temperature of 37° C.

The coating amounts (g/m$^2$) of the compounds of the emulsion layer were as follows.

| | |
|---|---|
| Silver behenate | 6.19 |
| Reducing agent-1 | 0.67 |
| Reducing agent-2 | 0.54 |
| Compound of formula (II) or (III) | Type and amount shown in Table 3 |
| Pigment (C. I. Pigment Blue 60) | 0.032 |
| Polyhalogen compound-1 | 0.46 |
| Polyhalogen compound-2 | 0.25 |
| Phthalazine compound-1 | 0.21 |
| SBR latex | 11.1 |
| Mercapto compound-1 | 0.002 |
| Silver halide (as Ag) | 0.145 |

The coating and drying conditions were as follows.

The coating was conducted at a speed of 160 m/min, clearance between a tip of a coating die and a substrate was set from 0.10 mm to 0.30 mm, and pressure of a vacuum chamber was set to be lower than atmospheric pressure by 196 to 882 Pa. The substrate was subjected to removal of electricity with an ionic wind before coating.

In a subsequent chilling zone, the coating solution was cooled with a wind having a dry-bulb temperature of 10° C. to 20° C., subjected to no-contact transportation, and dried with a helical non-contact dryer with a drying wind having a dry-bulb temperature of 23 to 45° C. and a wet-bulb temperature of 15 to 21° C.

After the drying, moisture conditioning was conducted at 25° C. and relative humidity 40 to 60%. Subsequently, the film surface was heated to between 70 and 90° C. After the heating, the film surface was cooled to 25° C.

With respect to matt degree of the thus-formed thermal development photosensitive material, that of the photosensitive layer surface was 550 seconds, and that of the back surface was 130 seconds, in terms of Bekk smoothness. Further, the pH of the film surface of the photosensitive layer was measured, and found to be 6.0.

Preparation of a Thermal Development Photosensitive Material-2

A thermal development photosensitive material-2 was prepared in the same manner as the thermal development photosensitive material-1 except that the emulsion layer coating solution-1 was changed to the emulsion layer coating solution-2 and the yellow dye compound 15 was removed from the antihalation layer.

At this time, coating amounts (g/m$^2$) of the compounds of the emulsion layer were as follows.

| | |
|---|---|
| Silver behenate | 6.19 |
| Pigment (C. I. Pigment Blue 60) | 0.036 |
| Polyhalogen compound-2 | 0.13 |
| Polyhalogen compound-3 | 0.41 |
| Phthalazine compound-1 | 0.21 |
| SBR latex | 11.1 |
| Reducing agent complex-3 | 1.54 |
| Compound of formula (II) or (III) | Type and amount shown in Table 3 |
| Mercapto compound-1 | 0.002 |
| Silver halide (as Ag) | 0.10 |

Preparation of a Thermal Development Photosensitive Material-3

A thermal development photosensitive material-3 was prepared in the same manner as the thermal development photosensitive material-1 except that the emulsion layer coating solution-1 was changed to the emulsion layer coating solution-3, the yellow dye compound 15 was removed from the antihalation layer, and the fluorine-based surfactants F-1, F-2, F-3 and F-4 of the second protecting layer and the back surface protecting layer were changed to F-5, F-6, F-7 and F-8, shown later, in the same amounts.

At this time, coating amounts ($g/m^2$) of the compounds of the emulsion layer were as follows.

| | |
|---|---|
| Silver behenate | 5.57 |
| Pigment (C. I. Pigment Blue 60) | 0.032 |
| Reducing agent-4 | 0.40 |
| Reducing agent-5 | 0.36 |
| Compound of formula (II) or (III) | Type and amount shown in Table 3 |
| Development accelerator-1 | 0.017 |
| Polyhalogen compound-2 | 0.12 |
| Polyhalogen compound-3 | 0.37 |
| Phthalazine compound- 1 | 0.19 |
| SBR latex | 10.0 |
| Hydrogen-bonding compound-2 | 0.59 |
| Mercapto compound-1 | 0.002 |
| Silver halide (as Ag) | 0.09 |

The reducing agents 1 to 5 were included in the compound of formula (I). When two types of the reducing agents were contained in the photosensitive material, the amount of the compound of formula (I) was the sum of the two types.

The chemical structures of the compounds used in Example 3 of the present invention are shown below.

Spectral sensitization coloring matter A′

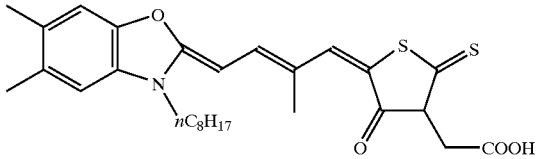

Spectral sensitization coloring matter B′

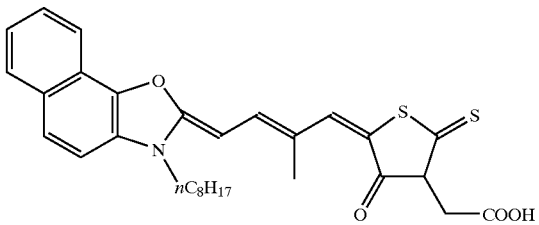

Tellurium sensitizer C

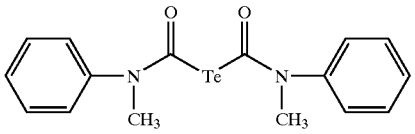

Basic precursor compound 11

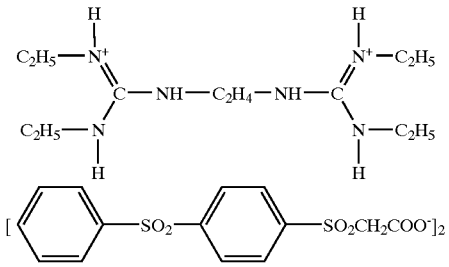

-continued

Cyanine dye compound 13

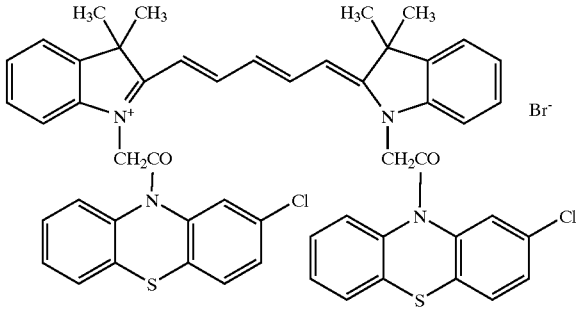

Blue dye compound 14

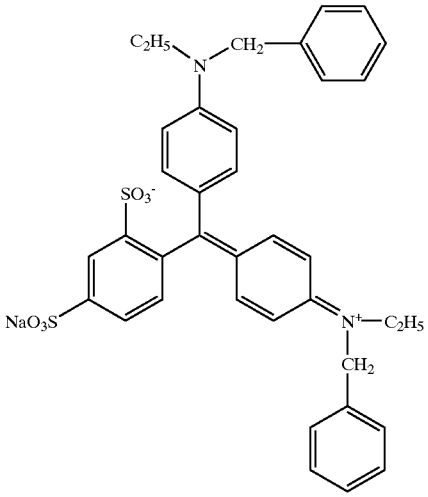

Yellow dye compound 15

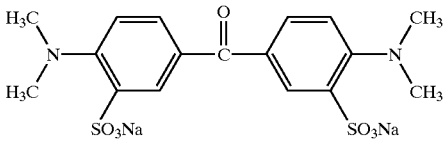

(Reducing agent-1)

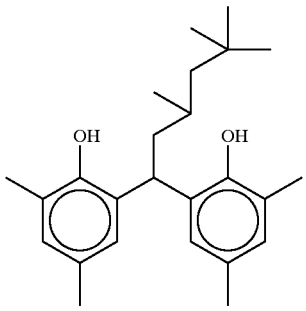

(Reducing agent-2)

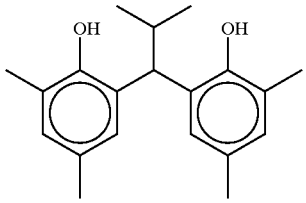

-continued (Reducing agent complex-3)

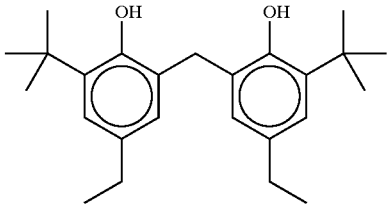

and

1:1 Complex of

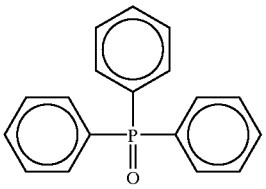

(Reducing agent-4)

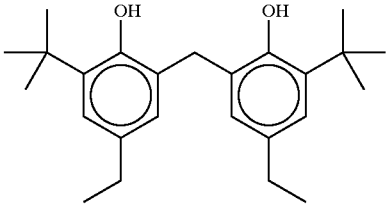

(Reducing agent-5)

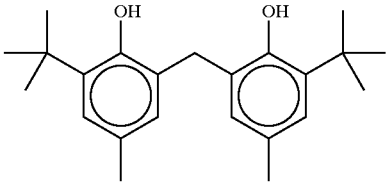

(Hydrogen-bonding compound-2)

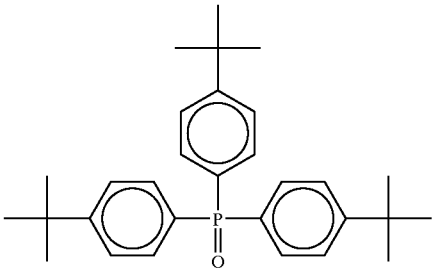

(Polyhalogen compound-1)

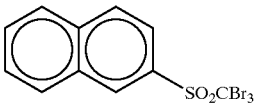

(Polyhalogen compound-2)

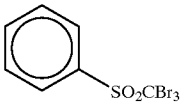

-continued (Polyhalogen compound-3)

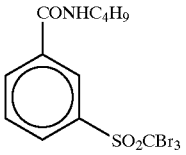

(Mercapto compound-1)

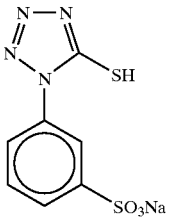

(Phthalazine compound-1)

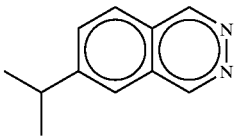

(Development accelerator-1)

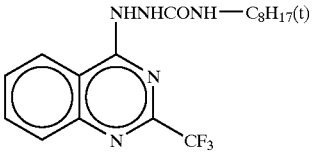

(F-1)

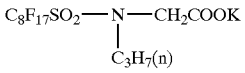

(F-2)

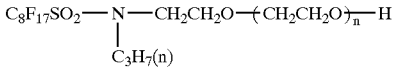

n = 15 (average)

(F-3)

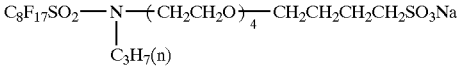

(F-4)

$C_8F_{17}SO_3K$ (F-5)

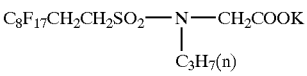

(F-6)

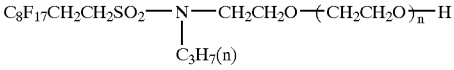

n = 15 (average)

(F-7)

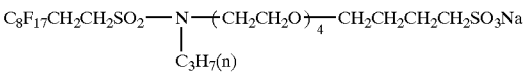

(F-8)

$C_8F_{17}CH_2CH_2SO_3K$

Evaluation of Photographic Performance

The photographic material was exposed to a semiconductor laser (Fuji Medical Dry Laser Imager FM-DPL, 660 nm semiconductor laser with a maximum 60 mW (IIIB) output). After exposure, thermal development was conducted with a remodeled thermal development unit, FM-DPL (with four panel heaters set at 112° C., 119° C., 121° C. and 121° C. for a total of 24 seconds=standard development time of 24 seconds). The resulting image was evaluated with a densitometer. In this remodeled heat development unit, the development time could be varied.

The sensitivity was evaluated from the reciprocal of a ratio of an exposure amount so as to give a density higher than Dmin by 1.0, and shown as a relative value by defining sensitivity of fresh performance of a sample No. 1 as 100. The larger the value, the higher the sensitivity. From the practical standpoint, the range of 95 to 105 is required.

Samples of the thermal development photosensitive material-3 were evaluated using a thermal development time of 14 seconds as a standard development time.

Developability

Development was conducted for a development time which was 75% of the standard development time. The developability was evaluated in terms of a relative sensitivity difference between the standard development time and the 75% development time. If the value was large, the developable width was narrow, and the developability was excellent.

Evaluation of Image Tone

The tone of the image formed was visually evaluated. The most preferable tone was a pure black tone, and this was rated as 0. The strongest magenta tone was rated as −3. As magenta tone was increased from the pure black tone, it was rated as −1, −2 or −3. On the other hand, the strongest yellow tone was rated as +3. As yellow tone was increased from the pure black tone, it was rated as +1, +2 or +3. The tone should be in the range −1, 0, +1, from the practical standpoint.

The results obtained by the foregoing evaluations are shown in Table 3. From the results in Table 3, it was found that the thermal development photosensitive materials of the present invention were better than those of the Comparative Examples in photographic performance, tone and developability.

Example 4

In the same way as sample Nos. 1 to 18 in Table 3 of Example 3, thermal development photosensitive materials (Example 4 (1) photosensitive materials) in which the compound of formula (II) or (III) added to the emulsion layer was added not to the emulsion layer but to the intermediate layer in the same coating amount as in Example 3 were prepared.

Further, in the same way as sample Nos. 1 to 18 in Table 3 of Example 3, thermal development photosensitive materials (Example 4 (2) photosensitive materials) in which the compound of formula (II) or (III) added to the emulsion layer was added not to the emulsion layer but to the first protecting layer in a coating amount which was twice as large as the coating amount in Example 3 were prepared.

The Examples 4(1) and 4(2) thermal development photosensitive materials were subjected to the same evaluations as in Example 3, and the same effects as in Example 3 were observed.

As has been thus far stated, the combinations of the present invention can provide thermal development photosensitive materials having good sensitivity and a desirable tone close to a pure black tone.

What is claimed is:

1. A thermal development photosensitive material comprising, on one surface of a substrate, at least one photosensitive silver halide, a non-photosensitive organic silver salt, a reducing agent for silver ions and a binder, the reducing agent including:

(a) at least one of polyphenol compounds represented by the following formula (I); and (b) at least one of hindered phenol compounds represented by the following formula (II), wherein a molar addition ratio of the at least one compound represented by formula (II) to the at least one compound represented by formula (I) is from 0.001 to 0.2:

TABLE 3

| Sample No. | Thermal development photosensitive material No. | Compound of formula (I) = α Type | Compound of formula (I) = α Amount (mol/m$^2$) | Compound of formula (II) or (III) = B Type | Compound of formula (II) or (III) = B Amount (mol/m$^2$) | Molar ratio B/α | Thermal development time (sec) | Fresh properties Fogging | Fresh properties Sensitivity | Tone | Developability (sensitivity difference) | Remarks |
|---|---|---|---|---|---|---|---|---|---|---|---|---|
| 1 | 1 | Reducing agent-1, 2 | $3.6 \times 10^{-3}$ | 11-3 | $4.5 \times 10^{-5}$ | 0.012 | 24 | 0.15 | 100 | 0 | 7 | Inv |
| 2 | 1 | Reducing agent-1, 2 | $3.6 \times 10^{-3}$ | — | — | — | 24 | 0.15 | 95 | −2 | 10 | CE |
| 3 | 1 | Reducing agent-1, 2 | $3.6 \times 10^{-3}$ | 11-3 | $9 \times 10^{-5}$ | 0.024 | 24 | 0.15 | 103 | +1 | 5 | Inv |
| 4 | 2 | Reducing agent complex-3 | $2.4 \times 10^{-3}$ | — | — | — | 24 | 0.15 | 96 | −2 | 11 | CE |
| 5 | 2 | Reducing agent complex-3 | $2.4 \times 10^{-3}$ | 11-3 | $4.5 \times 10^{-5}$ | 0.019 | 24 | 0.15 | 99 | 0 | 7 | Inv |
| 6 | 2 | Reducing agent complex-3 | $2.4 \times 10^{-3}$ | 11-3 | $9 \times 10^{-5}$ | 0.038 | 24 | 0.15 | 102 | +1 | 6 | Inv |
| 7 | 2 | Reducing agent complex-3 | $2.4 \times 10^{-3}$ | 11-35 | $4.5 \times 10^{-5}$ | 0.019 | 24 | 0.15 | 100 | 0 | 7 | Inv |
| 8 | 3 | Reducing agent-4, 5 | $2.4 \times 10^{-3}$ | 11-3 | $4.5 \times 10^{-5}$ | 0.019 | 14 | 0.15 | 100 | −1 | 7 | Inv |
| 9 | 3 | Reducing agent-4, 5 | $2.4 \times 10^{-3}$ | — | — | — | 14 | 0.15 | 96 | −3 | 13 | CE |
| 10 | 3 | Reducing agent-4, 5 | $2.4 \times 10^{-3}$ | 11-3 | $9 \times 10^{-5}$ | 0.038 | 14 | 0.15 | 102 | 0 | 5 | Inv |
| 11 | 3 | Reducing agent-4, 5 | $2.4 \times 10^{-3}$ | 11-3 | $2.4 \times 10^{-4}$ | 0.100 | 14 | 0.15 | 99 | +1 | 4 | Inv |
| 12 | 3 | Reducing agent-4, 5 | $2.4 \times 10^{-3}$ | 11-35 | $9 \times 10^{-5}$ | 0.038 | 14 | 0.15 | 99 | −1 | 6 | Inv |
| 13 | 3 | Reducing agent-4, 5 | $2.4 \times 10^{-3}$ | 11-35 | $2 \times 10^{-4}$ | 0.083 | 14 | 0.15 | 101 | 0 | 5 | Inv |
| 14 | 3 | Reducing agent-4, 5 | $2.4 \times 10^{-3}$ | 11-35 | $4.8 \times 10^{-2}$ | 0.200 | 14 | 0.15 | 103 | +1 | 4 | Inv |
| 15 | 3 | Reducing agent-4, 5 | $2.4 \times 10^{-3}$ | 11-35 | $6 \times 10^{-4}$ | 0.250 | 14 | 0.15 | 106 | +2 | 4 | CE |
| 16 | 3 | Reducing agent-4, 5 | $2.4 \times 10^{-3}$ | 11-36 | $2 \times 10^{-4}$ | 0.083 | 14 | 0.15 | 100 | 0 | 6 | Inv |
| 17 | 3 | Reducing agent-4, 5 | $2.4 \times 10^{-3}$ | 11-37 | $2 \times 10^{-4}$ | 0.083 | 14 | 0.15 | 100 | 0 | 5 | Inv |
| 18 | 3 | Reducing agent-4, 5 | $2.4 \times 10^{-3}$ | 11-40 | $2 \times 10^{-4}$ | 0.083 | 14 | 0.15 | 100 | 0 | 6 | Inv |

Formula (I)

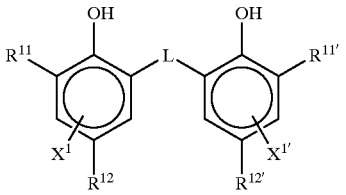

in which formula $R^{11}$ and $R^{11'}$ each independently represents an alkyl group having 1 to 20 carbon atoms; $R^{12}$ and $R^{12'}$ each independently represents a hydrogen atom or a substituent that is substitutable to a benzene ring; L represents —S— or —$CHR^{13}$—; $R^{13}$ represents a hydrogen atom or an optionally substituted alkyl group having 1 to 20 carbon atoms; and $X^1$ and $X^{1'}$ each independently represents a hydrogen atom or a group that is substitutable to a benzene ring, and:

Formula (II)

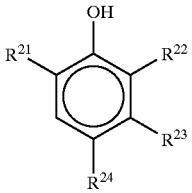

in which formula $R^{21}$ and $R^{22}$ each independently represents a hydrogen atom, an optionally substituted alkyl group or an optionally substituted acylamino group; neither of $R^{21}$ and $R^{22}$ is a 2-hydroxyphenylmethyl group; $R^{21}$ and $R^{22}$ are not both hydrogen atoms; $R^{23}$ represents a hydrogen atom or an optionally substituted alkyl group; and $R^{24}$ represents a substituent that is substitutable to a benzene ring.

2. The thermal development photosensitive material as claimed in claim 1, wherein, in formula (II), $R^{21}$ is an optionally substituted alkyl group.

3. The thermal development photosensitive material as claimed in claim 1, wherein the photosensitive silver halide is infrared-sensitized.

4. The thermal development photosensitive material as claimed in claim 1, wherein the molar addition ratio of the at least one compound represented by formula (II) to the at least one compound represented by formula (I) is from 0.005 to 0.1.

5. The thermal development photosensitive material as claimed in claim 2, wherein the molar addition ratio of the at least one compound represented by formula (II) to the at least one compound represented by formula (I) is from 0.005 to 0.1.

6. The thermal development photosensitive material as claimed in claim 3, wherein the molar addition ratio of the at least one compound represented by formula (II) to the at least one compound represented by formula (I) is from 0.005 to 0.1.

7. The thermal development photosensitive material as claimed in claim 1, further comprising at least one compound selected from the group consisting of hetero-aromatic mercapto compounds and hetero-aromatic disulfide compounds.

8. The thermal development photosensitive material as claimed in claim 2, further comprising at least one compound selected from the group consisting of hetero-aromatic mercapto compounds and hetero-aromatic disulfide compounds.

9. The thermal development photosensitive material as claimed in claim 3, further comprising at least one compound selected from the group consisting of hetero-aromatic mercapto compounds and hetero-aromatic disulfide compounds.

10. The thermal development photosensitive material as claimed in claim 6, further comprising at least one compound selected from the group consisting of hetero-aromatic mercapto compounds and hetero-aromatic disulfide compounds.

11. The thermal development photosensitive material as claimed in claim 1, wherein the at least one compound represented by formula (II) comprises a compound represented by formula (III):

Formula (III)

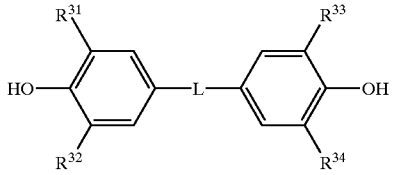

wherein $R^{31}$, $R^{32}$, $R^{33}$ and $R^{34}$ each independently represents a substituted or unsubstituted alkyl group having 1 to 20 carbon atoms; L represents —S— or —$CHR^{35}$—; and $R^{35}$ represents a hydrogen atom or an optionally substituted alkyl group having 1 to 20 carbon atoms.

12. The thermal development photosensitive material as claimed in claim 11, wherein the photosensitive silver halide is infrared-sensitized.

13. The thermal development photosensitive material as claimed in claim 11, wherein a molar addition ratio of the compound represented by formula (III) to the at least one compound represented by formula (I) is from 0.005 to 0.1.

14. The thermal development photosensitive material as claimed in claim 11, further comprising at least one compound selected from the group consisting of hetero-aromatic mercapto compounds and hetero-aromatic disulfide compounds.

15. The thermal development photosensitive material as claimed in claim 3, wherein, at a time of image-forming, the material is exposed with a laser having an exposure wavelength of 750 nm to 1,400 nm.

16. The thermal development photosensitive material as claimed in claim 6, wherein, at a time of image-forming, the material is exposed with a laser having an exposure wavelength of 750 nm to 1,400 nm.

17. The thermal development photosensitive material as claimed in claim 9, wherein, at a time of image-forming, the material is exposed with a laser having an exposure wavelength of 750 nm to 1,400 nm.

18. The thermal development photosensitive material as claimed in claim 2, wherein processing comprises a thermal development time of 5 to 20 seconds.

19. A method for forming a thermal development photosensitive material, the method comprising the steps of:

(i) providing at least one of polyphenol compounds represented by the following formula (I);

(ii) providing at least one of hindered phenol compounds represented by the following formula (II);

(iii) combining the at least one polyphenol compound and the at least one hindered phenol compound to provide a reducing agent for silver ions, a molar addition ratio of the at least one compound represented by formula (II) to the at least one compound represented by formula (I) being from 0.001 to 0.2; and (iv) disposing, on one surface of a substrate, layers that include at least one infrared-sensitized photosensitive silver halide, a non-photosensitive organic silver salt, the reducing agent for silver ions and a binder, wherein the material can be exposed by a laser having an exposure wavelength of 750 nm to 1,400 nm:

Formula (I)

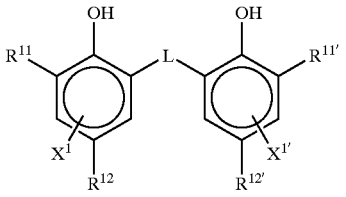

in which formula $R^{11}$ and $R^{11'}$ each independently represents an alkyl group having 1 to 20 carbon atoms; $R^{12}$ and $R^{12'}$ each independently represents a hydrogen atom or a substituent that is substitutable to a benzene ring; L represents —S— or —$CHR^{13}$—; $R^{13}$ represents a hydrogen atom or an optionally substituted alkyl group having 1 to 20 carbon atoms; and $X^1$ and $X^{1'}$ each independently represents a hydrogen atom or a group that is substitutable to a benzene ring, and:

Formula (II)

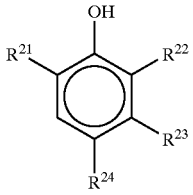

in which formula $R^{21}$ and $R^{22}$ each independently represents a hydrogen atom, an optionally substituted alkyl group or an optionally substituted acylamino group; neither of $R^{21}$ and $R^{22}$ is a 2-hydroxyphenylmethyl group; $R^{21}$ and $R^{22}$ are not both hydrogen atoms; $R^{23}$ represents a hydrogen atom or an optionally substituted alkyl group; and $R^{24}$ represents a substituent that is substitutable to a benzene ring.

20. A method for forming a thermal development photosensitive material, the method comprising the steps of:

(i) providing at least one of polyphenol compounds represented by the following formula (I);

(ii) providing at least one of hindered phenol compounds represented by the following formula (II);

(iii) combining the at least one polyphenol compound and the at least one hindered phenol compound to provide a reducing agent for silver ions, a molar addition ratio of the at least one compound represented by formula (II) to the at least one compound represented by formula (I) being from 0.001 to 0.2; and (iv) disposing, on one surface of a substrate, layers that include at least one photosensitive silver halide, a non-photosensitive organic silver salt, the reducing agent for silver ions and a binder, wherein the material can be developed by a process including a thermal development time of 5 to 20 seconds:

Formula (I)

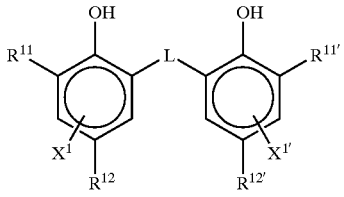

in which formula $R^{11}$ and $R^{11'}$ each independently represents an alkyl group having 1 to 20 carbon atoms; $R^{12}$ and $R^{12'}$ each independently represents a hydrogen atom or a substituent that is substitutable to a benzene ring; L represents —S— or —$CHR^{13}$—; $R^{13}$ represents a hydrogen atom or an optionally substituted alkyl group having 1 to 20 carbon atoms; and $X^1$ and $X^{1'}$ each independently represents a hydrogen atom or a group that is substitutable to a benzene ring, and:

Formula (II)

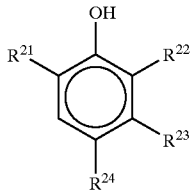

in which formula $R^{21}$ represents an optionally substituted alkyl group; $R^{22}$ represents a hydrogen atom, an optionally substituted alkyl group or an optionally substituted acylamino group; neither of $R^{21}$ and $R^{22}$ is a 2-hydroxyphenylmethyl group; $R^{23}$ represents a hydrogen atom or an optionally substituted alkyl group; and $R^{24}$ represents a substituent that is substitutable to a benzene ring.

* * * * *